US005566726A

United States Patent [19]

Marelin

[11] Patent Number: 5,566,726

[45] Date of Patent: Oct. 22, 1996

[54] ADAPTABLE BANDING TOOL

[75] Inventor: Miklos Marelin, Aurora, Colo.

[73] Assignee: Band-It-Idex, Inc., Denver, Colo.

[21] Appl. No.: 253,121

[22] Filed: Jun. 2, 1994

Related U.S. Application Data

[63] Continuation-in-part of Ser. No. 594,377, Oct. 5, 1990, Pat. No. 5,127,446, Ser. No. 908,983, Jul. 6, 1992, Pat. No. 5,322,091, and Ser. No. 163,815, Dec. 6, 1993.

[51] Int. Cl.[6] ..... B21F 9/00

[52] U.S. Cl. ..... 140/123.6; 140/93.4

[58] Field of Search ..... 140/93.4, 123.6

[56] References Cited

U.S. PATENT DOCUMENTS

| | | | |
|---|---|---|---|
| 356,083 | 1/1887 | Schrader et al. . | |
| 997,186 | 7/1911 | Flora . | |
| 1,000,083 | 8/1911 | Flora . | |
| 1,649,363 | 11/1927 | Parsons . | |
| 1,670,201 | 5/1928 | McGary . | |
| 1,990,820 | 2/1935 | Flader | 81/9.3 |
| 2,075,720 | 3/1937 | Hoffmann | 81/9.1 |
| 2,087,655 | 7/1937 | Prestwich | 81/9.1 |
| 2,118,158 | 5/1938 | Carlson | 24/23 |
| 2,214,110 | 9/1940 | Ott | 153/2 |
| 2,349,608 | 5/1944 | Bramble | 254/79 |
| 2,536,536 | 1/1951 | Childress et al. | 140/93.4 |
| 2,871,738 | 2/1959 | Abbiati | 81/9.3 |
| 2,928,434 | 3/1960 | McAneny | 140/93.4 |
| 3,061,302 | 10/1962 | Dennis | 269/9 |
| 3,067,640 | 12/1962 | Lodholm | 81/9.3 |
| 3,344,815 | 10/1967 | Lawson et al. | 140/123.6 |
| 4,041,993 | 8/1977 | Angarola | 140/123.6 |
| 4,056,128 | 11/1977 | Konrad | 140/93.4 |
| 4,333,210 | 6/1982 | Burnett | 24/30.5 |
| 4,646,393 | 3/1987 | Young | 24/20 R |
| 4,696,327 | 9/1987 | Wolcott | 140/150 |
| 4,726,403 | 2/1988 | Young et al. | 140/93.4 |
| 4,733,701 | 3/1988 | Loisel et al. | 140/93.2 |
| 4,896,402 | 1/1990 | Jansen et al. | 24/20 R |
| 4,928,738 | 5/1990 | Marelin et al. | 140/93.4 |
| 4,934,416 | 6/1990 | Tonkiss | 140/93.2 |
| 5,000,232 | 3/1991 | Wolcott | 140/93.4 |
| 5,007,465 | 4/1991 | Tonkiss | 140/150 |

FOREIGN PATENT DOCUMENTS

| | | | |
|---|---|---|---|
| 658135 | 2/1963 | Canada | 140/117 |

*Primary Examiner*—Lowell A. Larson
*Assistant Examiner*—Ed Tolan
*Attorney, Agent, or Firm*—Sheridan Ross & McIntosh

[57] ABSTRACT

The present invention is a novel banding tool which, prior to being used to provide a securing lock for a band clamp, can extract an unspecified length of excess band from the band clamp during a band clamp tightening operation without the banding tool itself expanding. The tightening is accomplished by the cranking or rotating of a tensioning rod for moving a band gripping assembly along the length of the tensioning rod whereby the band gripping assembly extracts a length of band from the band clamp. The present invention also includes a novel manual tension activation assembly for use in cranking the tension rod. The tension activation assembly can be attached to an end of the tensioning rod at a plurality of torque varying positions according to operator convenience and cranking space restrictions. Alternatively, cranking can be provided by a power drive rather than the manual tension activation assembly. The present invention is also of a modular design whereby the included lock forming components can be replaced, thereby providing various alternatives for the type of lock to be formed in securing the band clamp about an object.

18 Claims, 42 Drawing Sheets

544
548b
548a
552
306
128
304
540
556

544
224
564
540
504
512a
556
306
512b
568
304

308
302
324
304
504

300a
302
308
17

308
128
224
548b
552
544
548a
389
302
540
346
300a 544
389
568a
560
346
302
540
568b
300a

560

404
306
304
406

404
224
604
600
304
406

300a
304

404
304
128
308
600
302
406
300a
224
17

ADAPTABLE BANDING TOOL

CROSS-REFERENCE TO RELATED APPLICATION

This application is a continuation-in-part application of three prior applications identified as follows: Ser. No. 07/594,377, filed Oct. 5, 1990, now U.S. Pat. No. 5,127,446 issued Jul. 7, 1992, Ser. No. 07/908,983 filed Jul. 6, 1992 now U.S. Pat. No. 5,322,091 and Ser. No. 08/163,815, filed Dec. 6, 1993.

FIELD OF THE INVENTION

This invention relates to a method and apparatus for securing a band clamp about an object, and in particular, to a relatively compact banding tool that facilitates tensioning of a band.

BACKGROUND OF THE INVENTION

The use of a hand tool to tighten a band clamp has long been known. Band clamps are typically used to secure bundles of materials together and to secure pipes, wiring, etc. In one such application, a band clamp is applied to secure a protective metal braiding around a bundle of wiring which is connected to a plug or coupler known as a back shell.

Back shells are frequently used in military and aero-space applications where wiring carrying low voltage signals are conducted. Both the cables and the connectors must be protectively covered with a metallic substance to limit the harmful effects of radiation thereon. This metallic shielding must be without any "windows" (openings) and must in all parts have a ground connection with only low resistance to effectively minimize any electrical potential this "shielding" system may receive due to external or internal electromagnetic radiation (such as radio emission, cosmic rays, lightning strike, explosion of an atomic device, etc.). The diameter of the back shell body is typically larger than the diameter of the cable entering thereinto, and in order to have a satisfactory interconnection, a banding tool must be capable of applying a band clamp proximate the intersection of the back shell body and the cable entry stem. Thus the banding tool should be approximately the same width as the band clamp to be applied and should be capable of applying the band clamp from any direction.

One tool for tightening band clamps to a back shell is disclosed in U.S. Pat. No. 4,726,403, to Young et al., Feb. 23, 1988. The Young et al. device uses a toggle arrangement to tension the band clamp in place. Upon reaching the appropriate tension in the band clamp, the tool locks in a closed condition. To sever the tail from the tightened band clamp, a cutting arm must be rotated outwardly and upwardly from the side of the banding tool.

Due to the externally attached cutting device, the Young et al. banding tool is capable of applying a band clamp close to the back shell from only one direction. If a band is attempted to be connected from the opposite direction, the cutting device may prevent proper installation. The Young et al. tool is therefore limited in its application and becomes difficult to operate in confined spaces such as are found in aircraft fuselages.

Additionally, Young's tool uses toggles to transfer tension and toggles generally have a short power stroke in order to make the tool usable by an average person. Therefore, a larger size tool is required to sufficiently tension the band.

Another banding tool is disclosed in U.S. Pat. No. 4,928,738 to Marelin et al., May 29, 1990, assigned to the same assignee as the present invention. The '738 tool uses toggles to provide the power stroke and counteracting springs to achieve the desired tension in a band. It is necessary to force the band to bend around internal portions of the tool during tensioning. Additionally, the tool is not designed with overall width as a primary consideration.

Still another banding tool is disclosed in U.S. Pat. No. 2,087,655 to Prestwich, Jul. 20, 1937, the '655 device has a gripper section which holds one end of the band to be tensioned while a tensioning section grips and pull the other end of the band. The tensioning section comprises a double set of knurled wheels with a first set fixed and a second set movable. While the first set prevents slippage of the band, the second set tensions the band. While there is an angle between the tensioning section and the gripper section, this angular relationship does not provide the advantages of the present invention. Thus there is a need for a method and apparatus to allow tensioning of a band clamp to a back shell from either direction.

An additional concern is the lock established between the band and the buckle of a band clamp. Particularly, the type of lock that is of concern is one in which the free end of a band, whose other end is operatively attached to a buckle, is wrapped about an object and inserted through a passageway extending through the buckle and then bent to create a surface which engages the exterior of the buckle preventing the band from pulling back through. The lock itself is defined by the engagement of the band to the exterior of the buckle. For example, in one lock of this type known to those skilled in the art, the lock is formed by bending the band transverse to the length of the band and away from the object about which the band clamp is wrapped to create the surface, a lip, which engages the upper exterior surface of the buckle to lock the band in place.

The known locks of the type that are formed by bending the band to create a surface that engages the exterior surface of the buckle suffer from many deficiencies and inadequacies. Particularly, a problem prevalent among known locks of this type is their lack of holding power in certain circumstances. One such circumstance is when the lock is used to secure a band clamp about an object which is capable of expansion and contraction. In this situation, the known locks of the aforementioned type are susceptible to failure upon expansion of the object. Consequently, there is a need for a lock of the aforementioned type that exhibits improved strength in these and like circumstances.

A further problem of known locks of the stated type is the force required of the banding tool to create the lock. In many instances, the force necessary to create the locks necessitates the use of a power tool or if a hand tool is employed, considerable force must typically be applied by the operator. For example, in the lock in which the band is bent transverse to its longitudinal axis and away from the object about which the band clamp is wrapped, the devices presently used to shear off the excess band make the entire cut at one time. Further, the force necessary to make the entire cut at once increases as the width of the band increases and as the thickness of the band increases. However, the use of a power tool is not practical in many applications. Similarly, in many situations it is not possible for an operator to apply the requisite force to a hand tool. Consequently, there is a further need for a lock that can be readily formed with hand banding tools.

An additional problem in the aforementioned type of lock is its susceptibility to snagging. Specifically, the known locks of this type are formed in a manner in which they are susceptible to failure due to edges of the lock snagging on articles that can destroy the lock between the band and the buckle by "unbending" the band. For example, the lock formed by bending the band transverse to its longitudinal axis typically has an exposed edge where the excess band has been sheared that is readily snagged. Further, the snagged edge of the lock may damage the material or object that has been snagged. As is apparent, there is a further need for a lock of the defined type that is less susceptible to snagging.

A further problem in the known locks of the aforementioned type is their susceptibility to tampering. For example, the known lock in which the edge of the band is bent away from the object about which the band is wrapped can be defeated with simple tools, such as a pair of pliers, and by hand in some instances. Therefore, there is an additional need for a lock of the defined type that is less susceptible to tampering.

A further problem for locks of the aforementioned type, and especially those in which the band is bent transverse to the length of the band to create a lip that engages the upper exterior surface of the buckle, is that the tool which is used to create the lock and the clamped object must be rotated relative to one another to form the lip. During this rotation process, it is necessary to release some of the tension in the band to prevent the portion where the lock is to be established from thinning or breaking. Hence there is a need for a lock that can be formed while substantially avoiding having to release tension in the band, relative rotation between the band and the clamped object, or thinning of the band in the lock area due to rotation. Concomitantly, there is a need for a tool for forming such a lock.

A further problem of the known locks of the aforementioned type is the inability of one banding tool to create the locks with various widths of the band. Consequently, a separate banding tool must be acquired for each width of band and associated buckle that is employed. Hence, there is a need for a lock that can be formed in band clamps of varying widths by one banding tool.

An additional problem of the known locks is their relative short life. Band clamps are often used in circumstances where they are unprotected from various elements, including the weather, and under great force. In these circumstances, the formation of known locks do not provide the long-life characteristics desired.

A further problem of the known locks is the difficulty in forming a proper lock in circumstances wherein the bundle or object sought to be secured is, for example, at a remote location. The known locks are inadequately designed to be formed by hand-held tools as opposed to machine tools, due to the forces required to form the lock.

In addition, presently available banding tools lack versatility in that each such tool is used in a relatively narrow context. For example, banding tools used with large or heavy duty bands (e.g., bands having a band width of 1" or greater) are relatively large or expand during use. Thus, they can be cumbersome or impossible to operate in banding objects whose access is substantially restricted. Further, banding tools are typically either power-driven or manually operated and it is not possible to use the same banding tool with or without a power drive. Additionally, there is typically no versatility in the lock configuration used in securing a band clamp about an object.

A further drawback of substantially all available banding tools is that they are complex. That is, available banding tools typically have a large number of cooperatively arranged components. Therefore, such tools are more likely to fail during operation and/or are relatively expensive to manufacture than a banding tool of simple design.

Based on the foregoing, there exists a need for an improved lock for a band clamp that is of the type in which the band is bent to form a surface that engages the exterior surface of the buckle and method for making same that exhibits improved strength characteristics. Among other things, there exists a need for a lock of this type that exhibits improved strength characteristics, that can be readily made with hand tools as well as mechanized tools, that is less susceptible to snagging, that is tamper resistant, that permits a single tool to be used to create a lock in band clamps of different widths, and that can be formed while substantially avoiding the release of any tension in the band, relative rotation in the band, rotation between the band and the clamped object, or thinning of the buckle. Moreover, there is a need for a tool and method for forming such a lock.

Further, there exists a need to have a simple banding tool with greater flexibility than those presently available. For example, it is desirable to have a banding tool such that at least the above mentioned operational constraints are alleviated. It would be desirable to have a banding tool that remains compact during use, can be used with heavy duty bands, can be operated successfully entirely manually or with a power drive and further can easily provide different band clamp lock configurations.

SUMMARY OF THE INVENTION

The present invention disclosed herein comprises a method and apparatus for a banding tool using a force storing device which substantially eliminates or reduces problems associated with prior banding tools. The present invention allows the installation of a band to a coupling in which the tool must be placed proximate the coupling from either side thereof.

Further, the present invention disclosed herein comprises a novel compact banding tool of simple design which remains compact during use, is capable of use with heavy duty band clamps and is able to be operated entirely manually or used with a power drive. Additionally, the banding tool of the present invention is of a modular design such that the included components for deforming a portion of a band to form a band clamp lock are interchangeable with other lock-forming components so that an operator has a choice on the type of lock with which to secure a band clamp.

In accordance with one aspect of the invention, a tool for tensioning a band is provided. The tool comprises a tensioning means having a first longitudinal axis therethrough. Means for transferring tension from the tensioning means to the band is interconnected to the tensioning means at an angle thereto.

The tensioning means comprises a force storing device within a hollow handle of the tool. A tension adjustment plunger, a tension adjustment screw and a connecting rod are interconnected to the force storing device and the means for transferring tension. In a preferred embodiment the force storing device comprises a compression spring which is precompressed a desired amount by the adjustment plunger.

The means for transferring tension comprises a tension transfer lever interconnected to the tensioning means and a tensioning block. At least one push link is connected on a first end thereof to the tensioning means and on a second end to the lever arm. A tension block having an elongated slot and a tension pin therein is connected to the lever arm, wherein the tension block pulls the band into tension.

It is a technical advantage of the present invention that a band may be tensioned around a back shell from either direction. It is a further advantage of the present invention that a precompressed spring is used for achieving a desired tension in the band. It is a still further advantage of the present invention that levers are used to transfer tension rather than toggles resulting in a more work efficient tool.

The present invention disclosed herein further comprises a band clamp with an improved lock of the type in which the band is bent to create a surface that engages an exterior surface of the buckle and method for making such an improved lock which addresses the problems associated with known locks of this type. Accordingly, the present invention provides a lock that is formed by engaging the band with the buckle in a manner to increase the strength of the resulting lock. This is accomplished, at least in part, by bending the band along a line that is other than transverse to the passageway of the buckle or to the longitudinal axis of the band to establish the surface which engages the exterior of the buckle in contradistinction to the known locks of this type. This way of forming the lock contributes to the ability of the lock to withstand greater forces.

In accordance with one embodiment of the invention, the edges of the band are bent to form a locking surface with a substantially V-shaped transverse cross-section for engaging an external portion of the buckle. Further, the end of the band is cut in a manner that does not require a cutting edge to make the entire cut at one time. In one embodiment, this is achieved by cutting the band along a curve. Formed in this way, the lock can be readily formed by a hand banding tool as well as a powered banding tool.

In accordance with another embodiment of the invention, the edges of the band are bent to form a surface for engaging the exterior of the buckle that has a substantially "U" shaped transverse cross-section. Formed this way, in order for the lock to fail, the edges engaging the exterior of the buckle must be defeated along their entire length. As consequence, the instant invention provides a strong and generally long-lasting lock.

In accordance with a further embodiment of the invention, a portion of the band located intermediate to the lateral edges of the band is bent substantially parallel to the passageway of the buckle to create the surface that engages the exterior of the buckle to form a lock. Stated another way, the band is bent in a manner that produces a substantially Ω-shaped transverse cross-section. Formed in this way, the exposed edges are reduced thereby reducing the chances that the integrity of the lock will be compromised.

In a further embodiment of the invention, a lock cover is added to the upper portion of the buckle to protect the aforementioned Ω-shaped lock against tampering. Further, the lock cover and lock permit a banding tool to be designed that can be used to form the lock with bands and buckles of various widths.

In yet a further embodiment of the invention, the band and the buckle are separate. Thus, in addition to forming a band locking surface, the banding tool is used to form a retaining member on the band such that, when the band is inserted into a passageway of the buckle, the retaining member inhibits the buckle from slipping off the band. Moreover, it is noteworthy that the retaining member and the locking surface are formed by the same embodiment of the banding tool.

In a further embodiment of the invention, an embodiment of the banding tool is provided that is useful for forming both a retaining member and a locking surface and is both pneumatically controlled and powered. Thus, the forces required for forming the retaining member, the locking surface and the tensioning of the band are produced by pneumatic cylinders.

In a further embodiment of the invention, an embodiment of the banding tool is provided whereby the banding tool is operated by supplying a circular cranking motion when tightening or tensioning a band clamp about an object. However, the banding tool does not expand during the tightening process regardless of the length of excess band that is extracted from the band clamp prior to securing the band clamp with a band lock. The cranking motion can be accomplished by a novel, manual tension activation assembly which is detachable from the remainder of the banding tool. When attached, however, the novel tension activation assembly or crank is attached to an end of a threaded tensioning rod so that by revolving the crank the tensioning rod rotates and the rotation is used for pulling a free band end of a band clamp along the length of the rod and away from the object being banded during tensioning. The novel tension activation assembly can be secured to the end of the tensioning rod in any of a plurality of torque varying positions depending on operator convenience and/or any space constraints in the surroundings where the present invention embodiment is used. Alternatively, the tension activation assembly can be detached from the tensioning rod and a power drive may be attached to the tensioning rod so that the cranking motion during band tensioning can be provided by the power drive.

It is an aspect of this latter embodiment of the present invention that, as the tensioning rod is rotated, via for example, the above discussed crank, the tensioning rod end opposite where the crank may be attached is in contact with a bearingless pivot pin for both securing the tensioning rod within the banding tool and distributing the stresses on the tension rod resulting from band clamp tensioning. The pivot pin has a tapered portion projecting forward of the tensioning rod such that the mating of this tapered portion and a cavity or pin receptacle in a band lock forming assembly provides a cost-effective reduced friction pivot point for securing the tensioning rod.

It is a further aspect of this latter embodiment of the present invention that it provides a novel cost-effective band gripping and tensioning capability whereby as the tensioning rod is rotated, a band gripping platform, through which the tensioning rod is threaded, moves along the length of the rod. The gripping platform has opposing parallel walls, each with identical wall-piercing angled cut-outs in which a novel band gripping cylinder slides. When the gripping platform is urged, via the rotation of the tensioning rod, to move away from an object being banded (and thereby tensioning the band), the gripping cylinder is urged by the orientation of the angled cut-outs to move toward a band gripping surface of the gripping platform and thereby causing any band between the gripping cylinder and the gripping surface to be gripped such that the gripping cylinder, the gripping platform and the band portion therebetween move in unison.

Conversely, as the gripping platform is urged toward the object being banded, via the threaded tensioning rod, the gripping cylinder slides in an opposite direction within the angled cut-outs so that the gripping cylinder releases any band being gripped. Thus, the gripping cylinder pinches the band without the aid of sharp features such as teeth. Therefore, the useful life of the invention is increased in comparison to band gripping mechanisms having sharp features. It is worth while to note that the cylinder ends of the gripping cylinder are compressible and, in fact, the cylinder ends are compressed against parallel walls of a housing or casing of the banding tool. The compression against the walls of the casing is sufficient to frictionally stabilize and maintain the gripping cylinder positionally within the angled cut-outs in the absence of forces induced by the movement of the gripping platform along the tensioning rod. However, the compression induced friction is also easily overcome by the movement of the gripping platform along the tensioning rod such that as mentioned above, movement of the gripping platform causes the gripping cylinder to either grip or release a band depending on the direction of movement of the gripping platform.

It is yet a further aspect of this latter embodiment of the present invention that, when in use with a band clamp that can substantially retain band tension in the absence of tension from the banding tool, the band gripping action provided by the interaction of the gripping platform in the gripping cylinder can be repeatedly applied and released during the band tensioning operation such that each successive gripping action applied further tightens the band about the object being band clamped. For example, during a band tensioning operation, once the gripping platform has travelled to the distal end of the banding tool opposite to where the band clamp band is inserted into the banding tool, the cranking direction can be reversed, thereby causing the gripping cylinder to release the band when the gripping platform moves in the opposite direction. By continuing to crank in the reverse direction, the gripping platform can be moved nearer the band insertion point of the banding tool so that the band can be gripped at a different position nearer the object being banded and thereby tensioned further by again reversing the cranking direction such that the band is once again gripped as the gripping platform moves again toward the distal end of the banding tool.

Thus, the following aspects of this latter embodiment of the invention are noteworthy:

(1.1) It is an aspect of the invention to be able to extract an unspecified length of band from a band clamp by iteratively reversing the cranking motion used in tightening the band clamp.

(1.2) It is a further aspect of the present invention to extract the above mentioned length of band without expansion of the invention.

(1.3) It is a further aspect of the present invention to provide a manual detachable tension activation assembly where different tensioning torques can be applied during tensioning of a band clamp band depending upon how the tension activation assembly is attached to the banding tool.

(1.4) It is a further aspect of the present invention to provide a stable rotation of the tensioning rod during band tensioning wherein an end of the tensioning rod is supported by one of the following: (a) a bearingless pivot pin, pin receiving cavity combination, or (b) an axial ball, roller or needle bearing.

(1.5) It is a further aspect of the present invention to provide a housing about the band tensioning components for frictionally engaging a gripping cylinder to stabilize its position and in addition to provide an exterior form to the banding tool that can be conveniently handled by an operator without the need to handle lubricated and/or irregularly shaped banding tool components.

Based on the foregoing, the present invention provides a lock which is able to withstand greater forces, and in various embodiments is long lasting, less susceptible to snagging or tampering, able to be easily formed, and can be formed while substantially avoiding the release of tension in the band, relative rotation between the band and the clamped object, or thinning of the band in the regions of the lock due to this rotation. The present invention, in at least one embodiment, provides a lock so that a banding tool can be designed to accommodate band clamps of various widths. Furthermore, the present invention provides a tool and a method for forming such a lock. Additionally, an embodiment of the invention is disclosed providing a compact non-extending banding tool.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION OF THE INVENTION

Figure 1:
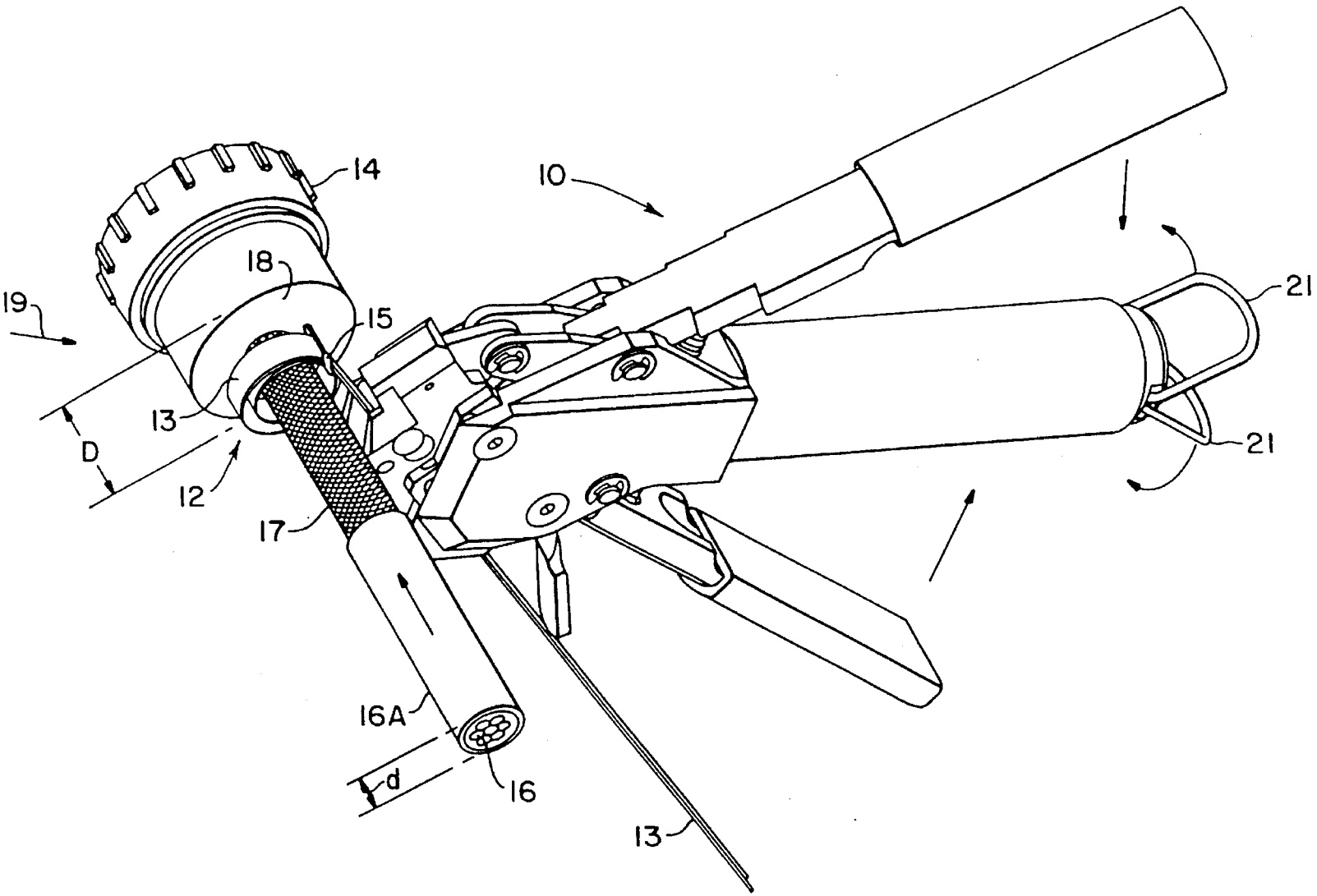
FIG. 1 is a perspective view of a tool constructed in accordance with the preferred embodiment of the present invention in use.

Referring first to FIG. 1, a perspective view of a tool constructed in accordance with the preferred embodiment of the present invention is generally identified by the reference numeral 10. The banding tool 10 is used to attach a band clamp 12 comprising a band 13 and a buckle 15 to a coupler 14 such as, for example, a back shell. The band clamp 12 is used to secure a protective shield 17 covering a cable 16 which is in turn attached to the coupler 14. Optional protective cover **16*a* such as heat shrink tubing can be installed to cover the shield 17 and the buckle 15**.

Due to a larger diameter D of the coupler 14 in comparison to a diameter d of the shield 17, a flange 18 is formed proximate the connection therebetween. As a result of the banding tool 10, the band clamp 12 may be positioned proximate the flange 18 as required for the preferred connection configuration. Also, due to the symmetrical design of the tool 10, the band clamp 12 may be positioned proximate the flange 18 from either direction (i.e., the tool 10 may also be used to apply the clamp 12 from a direction indicated by an arrow 19, directly opposite the direction as shown in FIG. 1) with equal success. It should be noted that the tool 10 may be provided with handle locks 21 that allow the tool 10 to be stored in a more compact and space efficient manner.

Figure 2A:
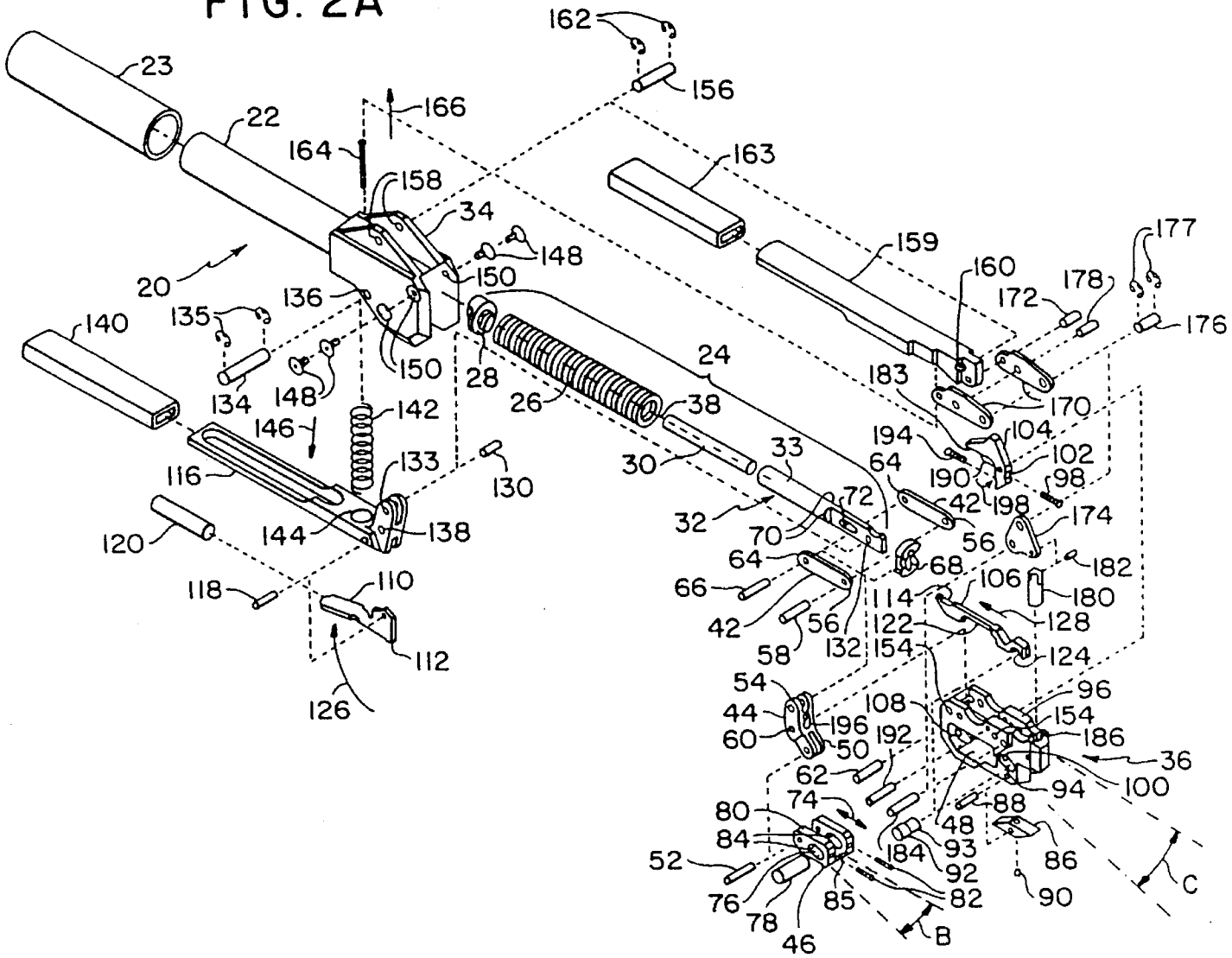
FIGS. 2A, B, and C are exploded perspective views of the tool of the present invention.
Figure 2C:
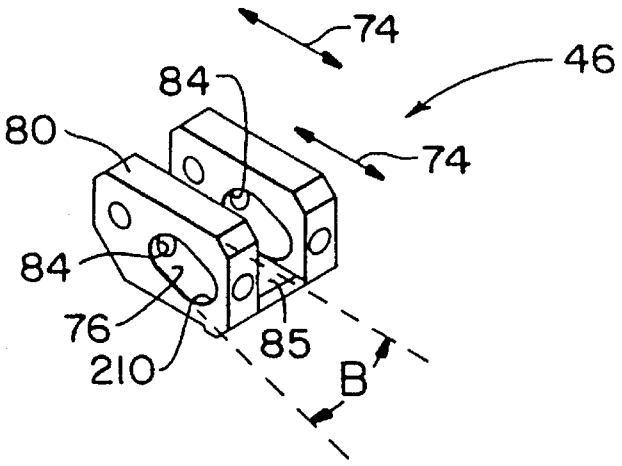
Figure 2B:
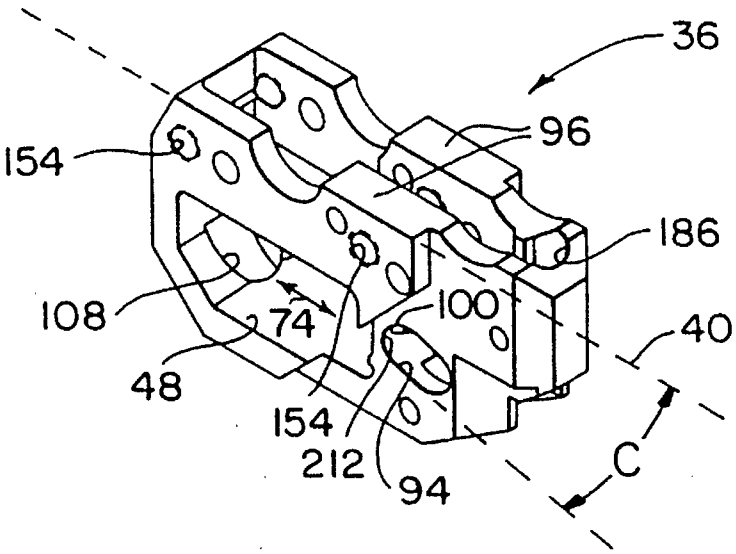

Referring simultaneously to FIGS. 2A, 2B and 2C, an exploded perspective view of the tool 10 is shown. A housing 20 receives and interconnects the various parts of the tool 10. Within a hollow handle 22 (the handle 22 may be provided with a protective covering 23 of a pliant material for comfort during use) of the housing 20 is a tensioning assembly 24. The tensioning assembly 24 comprises a force storing device 26, a tension adjustment plunger 28, a tension adjustment screw 30 and a connecting rod 32. The device 26 may comprise, for example, a compression spring, a rubber block or any other device capable of storing energy. Alternatively, the device 26 may comprise a power unit such as a hydraulic or pneumatic cylinder for powered actuation of the tool 10.

The screw 30 is threadably received into a tubular portion 33 of the rod 32. The plunger 28, upon assembly, is secured to the adjustment screw 30 to precompress the device 26 by threading into or out of the tubular portion 33 of the rod 32. A special tool (not shown) is preferably required to turn the plunger 28 and thus the screw 30 to prevent unauthorized changing of the setting of the desired recompression of the device 26. As will be subsequently described in greater detail, the device 26 is precompressed to allow a desired tension to be applied to the band clamp 12 around an object to be clamped.

The housing 20 also comprises a head receptacle 34 in which a head 36 (See FIG. 2B) is operably interconnected to the tensioning assembly 24. It is an important aspect of the present invention to note that upon assembly, a linear axis 38 passing through the tensioning assembly 24 intersects a linear axis 40 through the head 36 at an angle A (see FIG. 3A). The angle A may vary so long as the axis 38 and the axis 40 are not parallel to each other. The angular relationship between the assembly 24 and the head 36 allows the band 13 to be inserted into and through the tool 10 without the necessity of bending around an obstruction in the tool 10. Therefore, in comparison to prior devices the tool 10 is easy to load and most of the force in the tool 10 is used to tension the band 13 rather than to bend the band 13 around an obstruction.

The head 36 is interconnected to the assembly 24 by push links 42, tension transfer lever 44 and tension block 46. The tension block 46 is slidably inserted into a cavity 48 in the head 36 and connected to a first end 50 of the lever 44 by a pin 52. The lever 44 is also pivotally connected through a center hole 60 to the head 36 by a pin 62. A second end 54 of the lever 44 is pivotally connected to a first end 56 of the links 42 by a pin 58.

The links 42 are connected at a second end 64 to the connecting rod 32 by a pin 66. A support plunger 68 is secured to the rod 32 forcing pin 66 against forward end of elongated slot 72 on the rod 32 through which the pin 66 is positioned. Due to the slot 72, the pin 66 has a predetermined travel distance along the linear axis 38, as will be subsequently described in greater detail.

The cavity 48 in the head 36 is dimensioned to allow the tension block 46 to slide in a back-and-forth direction as indicated by a double-headed arrow 74. Received within an elongated slot 76 (see FIG. 2C) in the tension block 46 is a tension pin 78. The slot 76 is formed at an angle B (which may comprise, for example 10°–17°) relative to a top surface 80 of the block 46 to allow pressure to be applied and released by the tension pin 78 to the band 13 of the band clamp 12, as will be subsequently described in greater detail. A pair of springs 82 are inserted into holes 84 in the block 46 to bias the pin 78 toward an edge 210 (see FIG. 2C) of the slot 76 and into contact with the band 13 of the band clamp 12 which passes therebetween and a bottom surface 85 of the block 46.

A tension holding pin 92 is slidably received within an elongated slot 94 in the head 36. The pin 92 is held within the slot 94 by engagement of a groove 93 therein by a tension hold/release link 106. Thus the width of the tool 10 at the head 36 is kept to approximately the same width as the buckle 15.

The slot 94 is formed at an angle C (which may comprise, for example, 10°–17°) relative to a top surface 96 of the head 36 (see FIG. 2B). The pin 92 is biased away from an edge 212 of the slot 94 by a spring 98 which fits through the head 36 in opening 100. The spring 98 is held in place by a recess 102 in a tension holding hook 104. The band 13 of the band clamp 12 is gripped between the tension holding pin 92 and a cut-off blade 86. Thus the tension holding pin 92 is biased to hold the band 13 from slipping or being pulled from the tool 10. The cut-off blade 86 may be reversibly fixed within the head 36 by a pin 88. A jam screw 90 is threadable into the blade 86 to hold pin 88 in place and to provide convenient means to remove cut-off blade 86.

The tension hold/release link 106 fits within the head 36 through an opening 108 for cooperation with a tension hold/release hook 110. The link 106 and hook 110 are interconnected by the mating of a male portion 112 on the hook 110 with a slot 114 on the link 106. The hook 110 is pivotally connected to a pull-up handle 116 by a pin 118. The hook 110 may be provided with a pliant cover 120 for comfort of use.

The link 106 has a first cut-out 122 and a second cut-out 124. When the link 106 is installed within the head 36, the first cut-out 122 interacts with the tension pin 78 of the tension block 46 while the second cut-out 124 interacts with the tension holding pin 92 within the elongated slot 94 of the head 36. By actuating the hook 110 in a direction indicted by an arrow 126 the hook 110 pivots about the pin 118 to pull the link 106 in a direction indicated by an arrow 128.

The first cut-out 122 and the second cut-out 124 thus contact the tension pin 78 and the tension holding pin 92, respectively, and pull the pins against their spring bias. Thus, an operator is able to insert a band 13 of the band clamp 12 without interference from the tool 10.

The link 106 also provides an automatic self adjustment when clamping various materials such as steel versus rubber. For example, if the band clamp 12 encircles a rubber tube, there will be a greater tendency (than with steel) for the rubber to try to re-expand and to pull the tension holding pin 92 into the elongated slot 94 away from the edge 212 (thus gripping the band 13 tighter). This forward motion of pin 92 would reduce the total stroke tool 10 could apply to band 13, resulting in lower tensioning force. Due to the interconnection with the tension pin 78 through the link 106, the tension pin 78 will be similarly allowed to move farther into its elongated slot 76 toward the edge 210 for greater gripping strength, thus adjusting automatically for a longer stroke.

The pull up handle 116 is pivotally connected to the connection rod 32 by a pin 130 passing through holes 132 and 133. The pull up handle 116 is pivotally connected to the head receptacle 34 by a pin 134 through a hole 136 in the head 34 and a hole 138 in the handle 116 and is held in position by snap rings 135. The handle 116 may be provided with a pliant cover 140 for comfort of operation. A spring 142 is inserted into a receptacle 144 in the handle 116 and into the head receptacle 34 to bias the handle 116 in a direction indicated by an arrow 146.

A plurality of bolts 148 fit into holes 150 in the head receptacle 34 and are threadably received by the head 36 within holes 152 therein. Thus, the head 36 is secured within the head receptacle 34 by the bolts 148.

A cutoff handle 154 is pivotally attached to the head receptacle 34 by a pin 156, secured in place by a pair of snap rings 162, passing through holes 158 in the receptacle 34 and a hole 160 in the handle 154. A spring 164 is positioned between the handle 154 and the head receptacle 34 to bias the handle 154 in a direction indicated by an arrow 166. The handle 154 may also be provided with a pliant cover 168 for comfort of operation.

A pair of cutoff links 170 are pivotally attached to the handle 154 by a pin 172. The cutoff links 170 are pivotally attached at an end opposite the handle 154 to a cutoff arm 174 by a pin 176 which is held in place by snap rings 177. A pin 178 passes through the links 170 for interaction with the tension holding hook 104, as will be subsequently described in greater detail. The cutoff arm 174 is pivotally connected to a cutoff knife 180 by a pin 182 and to the head 36 by a pin 184. The cutoff knife 180 is slidably received within a receptacle 186 in the head 36 for cooperation with the cutoff blade 86 to sever the band 13, as will be subsequently described in greater detail.

The tension holding hook 104 has a hook 188 and a cam surface 190. The tension holding hook 104 is pivotally connected to the head 36 by a pin 192. A spring 194 is received by the tension holding hook 104 and a receptacle 196 in the tension transfer lever 44. The spring 194 biases the tension holding link 104 in a counterclockwise direction, as indicated by an arrow 198, about the pin 192.

Figure 3A:
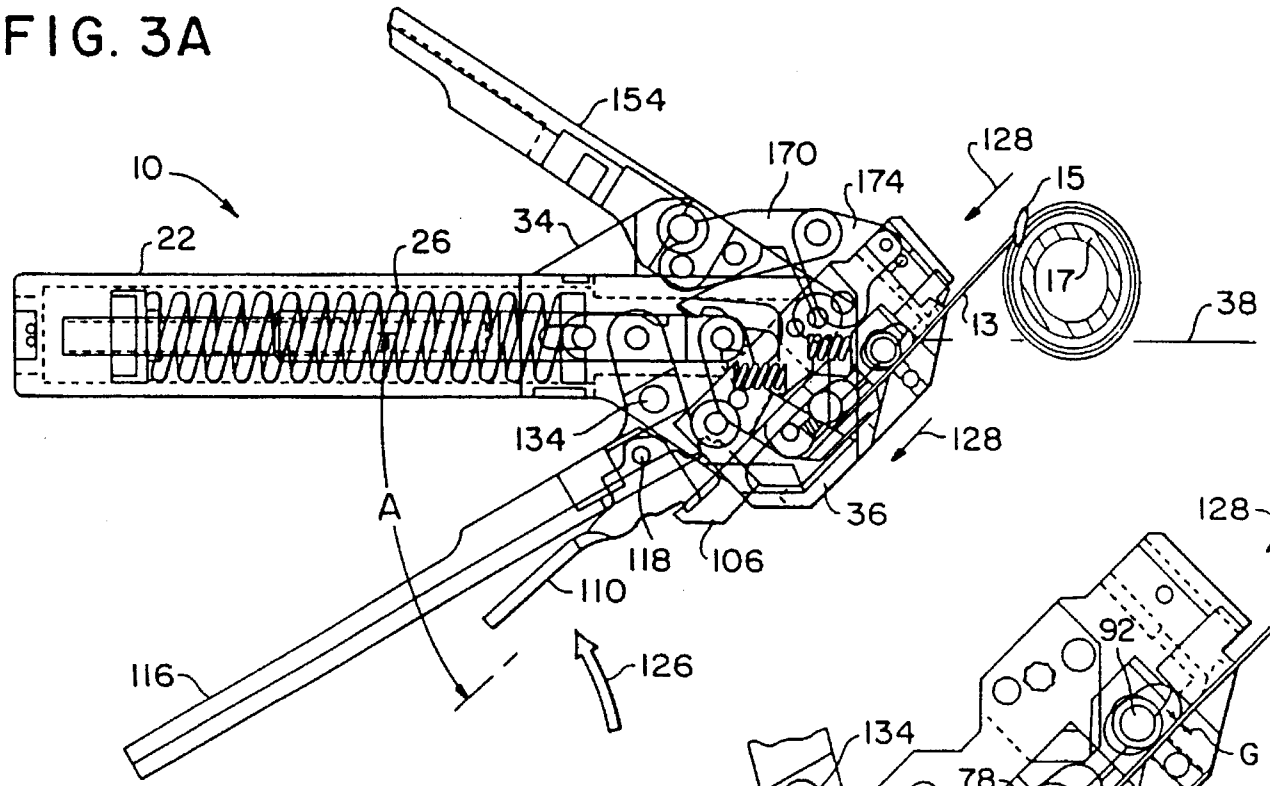
FIGS. 3A and B are cross-sectional views of the tool with a band clamp to be tensioned being inserted therein.
Figure 3B:
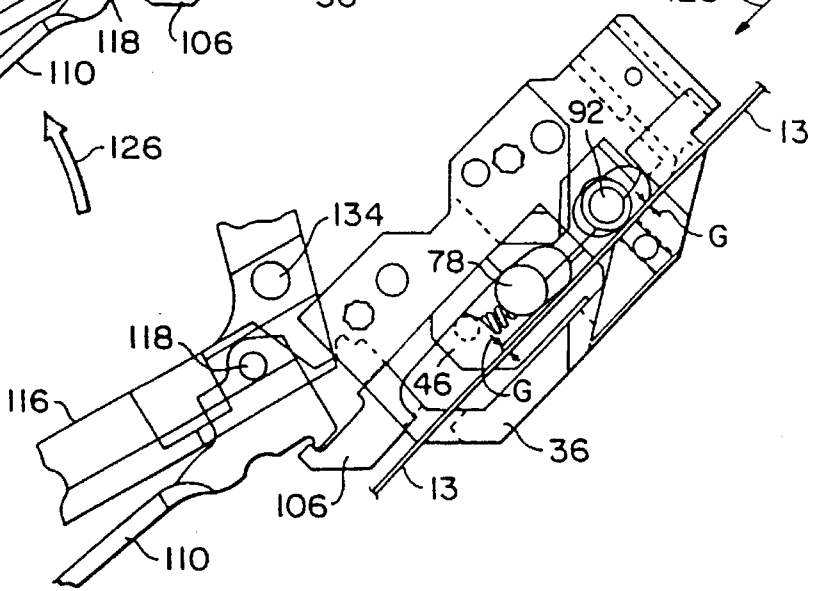

The operation of the tool 10 will now be discussed with reference to FIGS. 3 through 8. Referring first to FIGS. 3A and 3B, the insertion of a band clamp 12 into the tool 10 is illustrated. With the pull up handle 116 and the cutoff handle 154 in their spring biased positions, the tension hold/release hook 110 is grasped by an operator and moved in the direction 126. Movement of the hook 110 in the direction 126 causes the tension hold/release link 106 to move in the direction 128. Thus, the tension pin 78 and the tension holding pin 92 are moved in their respective holes against their spring bias to form gaps G therebetween and the bottom surface 85 of the tension block 46 and the cutoff blade 86 which are at least slightly greater than the thickness of the band 13. The gaps G thus formed allow the band 13 to be inserted in the direction 128 into the tool 10. Due to the angle A between the linear axis 38 of the tensioning means 24 and the linear axis 40, the band 13 is maintained straight without the necessity of bending thereof around internal parts of the tool 10. Thus, tensioning of the band 13 and insertion thereof into the tool 10 is relatively easier than in prior art devices.

Figure 4B:
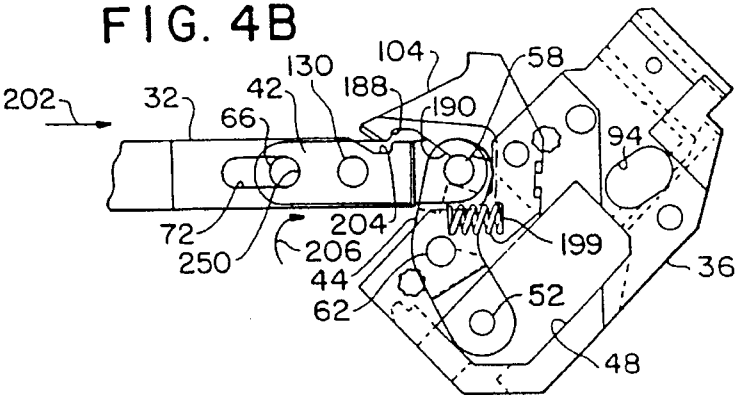
FIGS. 4A, B and C are cross-sectional views of the tool in an upstroke position.
Figure 4C:
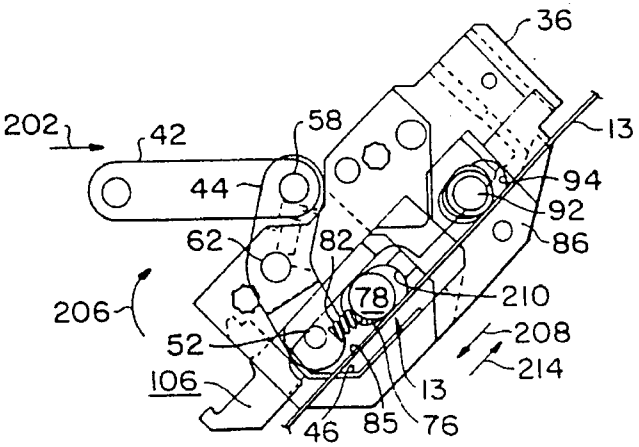
Figure 4A:
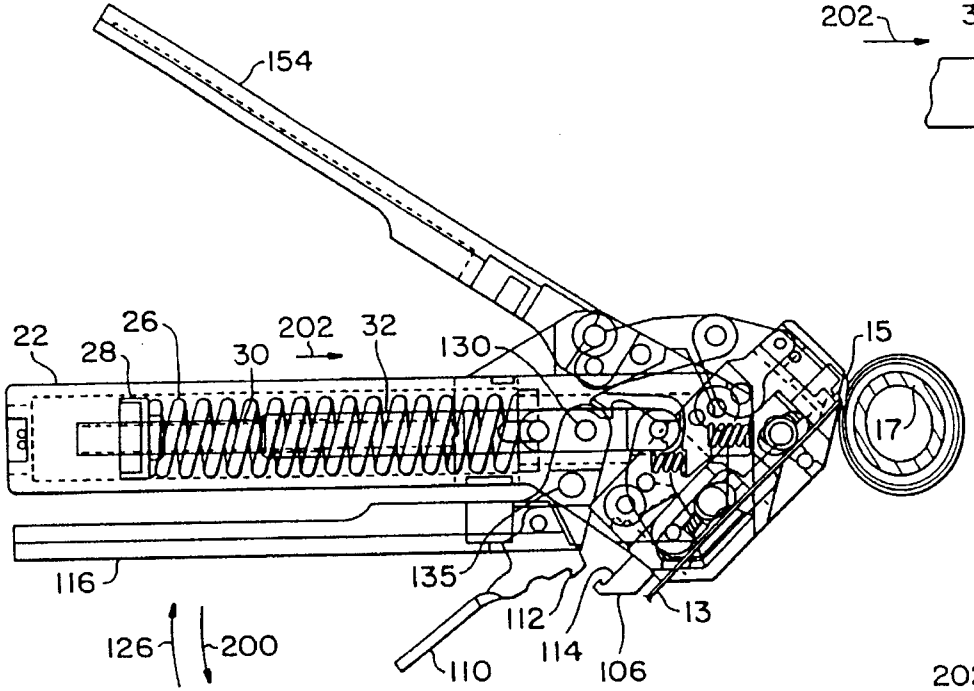

Referring to FIGS. 4A, 4B and 4C the tool 10 is shown in the tensioning mode. The pull up handle 116 is pulled back-and-forth as indicated by the arrow 126 and an arrow 200 between the position as shown in FIG. 4A and the position as shown in FIG. 3A. As the handle 116 is moved in the direction 126, the tension hold/release hook 110 is not engaged with the tension hold/release link 106.

As the handle 116 pivots about the pin 135, the connecting rod 32 is moved in a direction indicated by an arrow 202 as a result of the interconnection thereto by the pin 130. As can be seen in FIG. 4B, movement of the rod 32 similarly causes movement of the push links 42 in the direction 202. Movement of the links 42 in the direction 202 is caused by the pin 66 engaging a front edge 250 of the slot 72 in the connecting rod 32. The pin 66 is held against the edge 250 by the support plunger 68 which is in turn pushed in the direction 202 by the storing device 26. As long as the tension in the band 13 does not overcome the recompression of the device 26 the pin 66 is held against the edge 250. In other words, the assembly 24 acts as a solid rod until the band 13 reaches the predetermined tension.

Therefore, as the link 42 moves in the direction 202 the tension transfer lever 44 is forced to pivot in a clockwise direction as indicated by an arrow 206 about the pin 62 as a result of the interconnection therebetween with the link 42 by pin 58. As the pin 58 moves in the direction 202 it slides along the cam surface 190 of the tension holding hook 104 against the bias of the spring 194 and the hook 188 thereof is held out of the slot 204 in the connecting rod 32. Thus, an operator knows that the band 13 has not been tensioned the desired amount and further cycling of the handle 116 is required.

Referring to FIG. 4C, as the link 42 moves in the direction 202, the transfer lever 44 pivots in the clockwise direction 206. Due to the interconnection between the lever 44 and the tension block 46 by the pin 52, the tension block 46 is moved in a direction indicated by an arrow 208. Movement of the tension block 46 in the direction 208 forces the tension pin 78 toward the edge 210 of the elongated slot 76 therein, and the band 13 is gripped between the pin 78 and the bottom surface 85 of the block 46. Thus as the handle 116 moves in the direction 126, the band 13 is moved in the direction 208 to increase the tension therein. As the band 13 is moved in the direction 208 by the pin 78 and the block 46, the pin 92 is moved toward the edge 212 of the elongated slot 94. Thus the band 13 is allowed to pass between the pin 92 and the cut-off blade 86.

When the handle 116 is moved in the direction 200, the block 46 is moved in a direction indicated by an arrow 214. As the block 46 moves in the direction 214, tension in the band 13 causes the band 13 to also try to move in the direction 214. The tension in the band 13 and the bias of the spring 98 thus moves the pin 92 away from the edge 212 in the slot 94 and holds the band 13 from movement in the direction 214. Similarly, movement of the block 46 in the direction 214 causes the pin 78 to move against the bias of the spring 82 and away from the edge 210 in the slot 76, allowing the pin 78 to pass freely over the band 13. Therefore, the handle 116 is cycled in the direction 126 and 200 as described to gradually tension the band 13 around the shield 17.

It is an advantage of the tool 10 that the handle 116 and lever 44 is used rather than toggles, as are found in the prior art. The handle 116 and the lever 44 provide a mechanical advantage over toggles allowing fewer cycles of the handle 116 to move the band farther than in a corresponding toggle tool. Although not shown, it is to be understood that by varying the length of the lever 44 about the pin 62, various mechanical advantages may be achieved. Additionally, the use of the force storing device 26 such as a precompressed spring allows the tool 10 to be smoother, easier to operate and more accurate than prior devices.

Figure 5A:
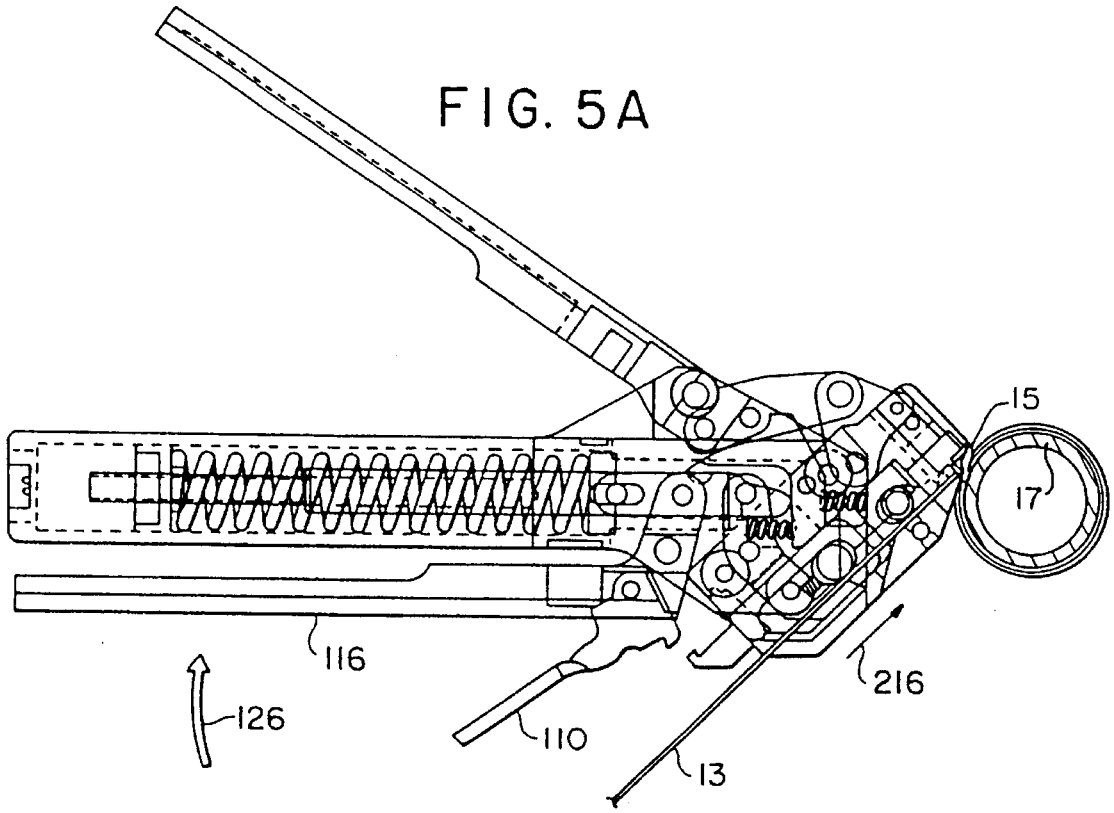
FIGS. 5A and B are cross-sectional views of the tool in the signal position.
Figure 5B:
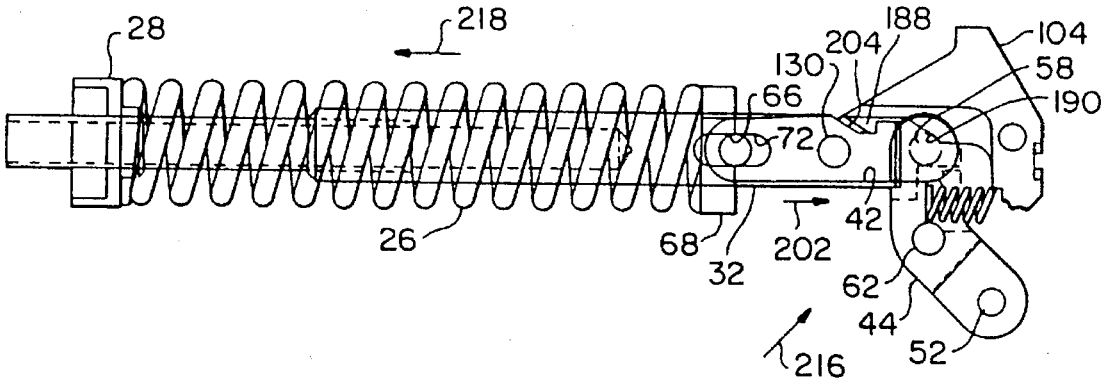

Referring to FIGS. 5A and 5B, the band 13 has been pulled to the desired tension within the tool 10. When the desired tension is reached, the handle 116 is locked in the position as shown in FIG. 5A. In the locked condition, the spring 142 (see FIG. 2A) is unable to return the handle 116 to the position shown in FIG. 3A, and the operator knows that the desired tension has been reached.

As best seen in FIG. 5B, when the tension in the band 13, as indicated an arrow 216, exceeds the recompression of the storing device 26, the device 26 further compresses in a direction indicated by an arrow 218. Thus the support plunger 68 and the pin 66 also move in the direction 218 as the connecting rod 32 moves in the direction 202. Since the pin 58 is also connected to the push links 42, the pin 58 does not move in the direction 202 and does not ride along the cam surface 190 of the tension holding hook 104. Thus the hook 188 thereon enters the slot 204 on the connecting rod 32 to lock the handle 116 in the position as shown in FIGS. 5A and 5B.

Figure 6A:
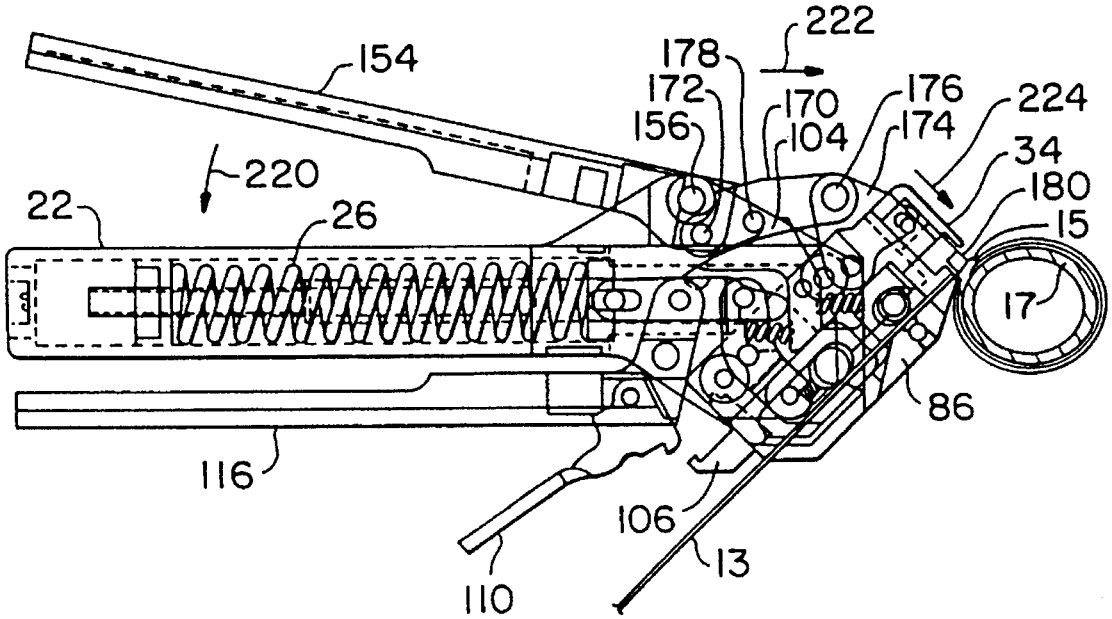
FIGS. 6A, B and C are side cross-sectional views of the cutting operation.
Figure 6B:
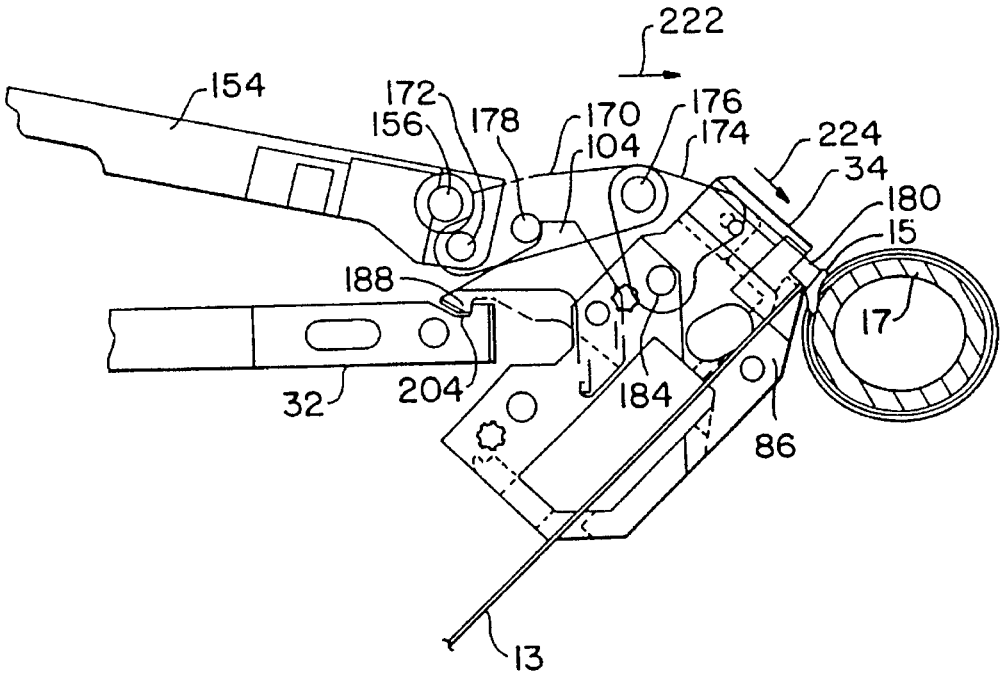
Figure 6C:
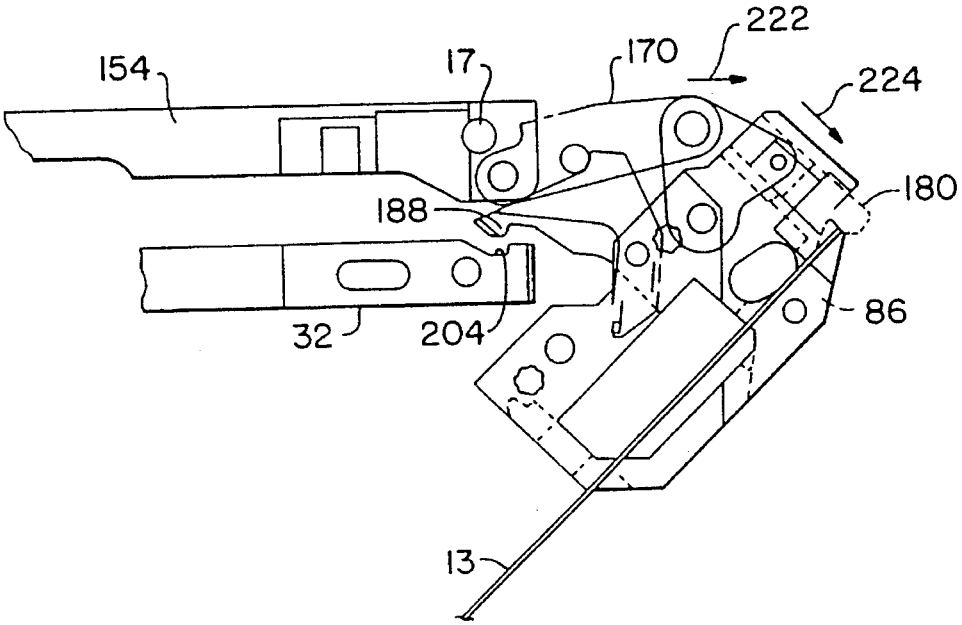

Referring to FIGS. 6A, 6B and 6C, the cut-off sequence is illustrated. Referring first to FIGS. 6A and 6B, the pull up handle 116 is in the uppermost locked position. The cut-off handle 154 pivots in a direction as indicated by an arrow 220 about pin 156 which moves the cut-off links 170 in a direction indicated by an arrow 222. Movement of the links 170 in the direction 222 causes the cut-off arm 174 to pivot clockwise about the pin 184. The clockwise rotation of the cut-off arm 174 moves the cut-off knife 180 in a direction indicated by an arrow 224. The cut-off knife 180 first contacts the buckle 15 and then bends and severs the band 13 therebetween and the cut-off blade 86, as will be subsequently described in greater detail. Simultaneously, the pin 178 contacts the tension holding hook 104 to push the hook 104 in the direction 222 and thus release the hook 188 from the slot 204 (as shown in FIG. 6C) which will allow the pull up handle 116 to return to the extended position as shown in FIG. 3A.

Figures 7A, 7B, 7C:
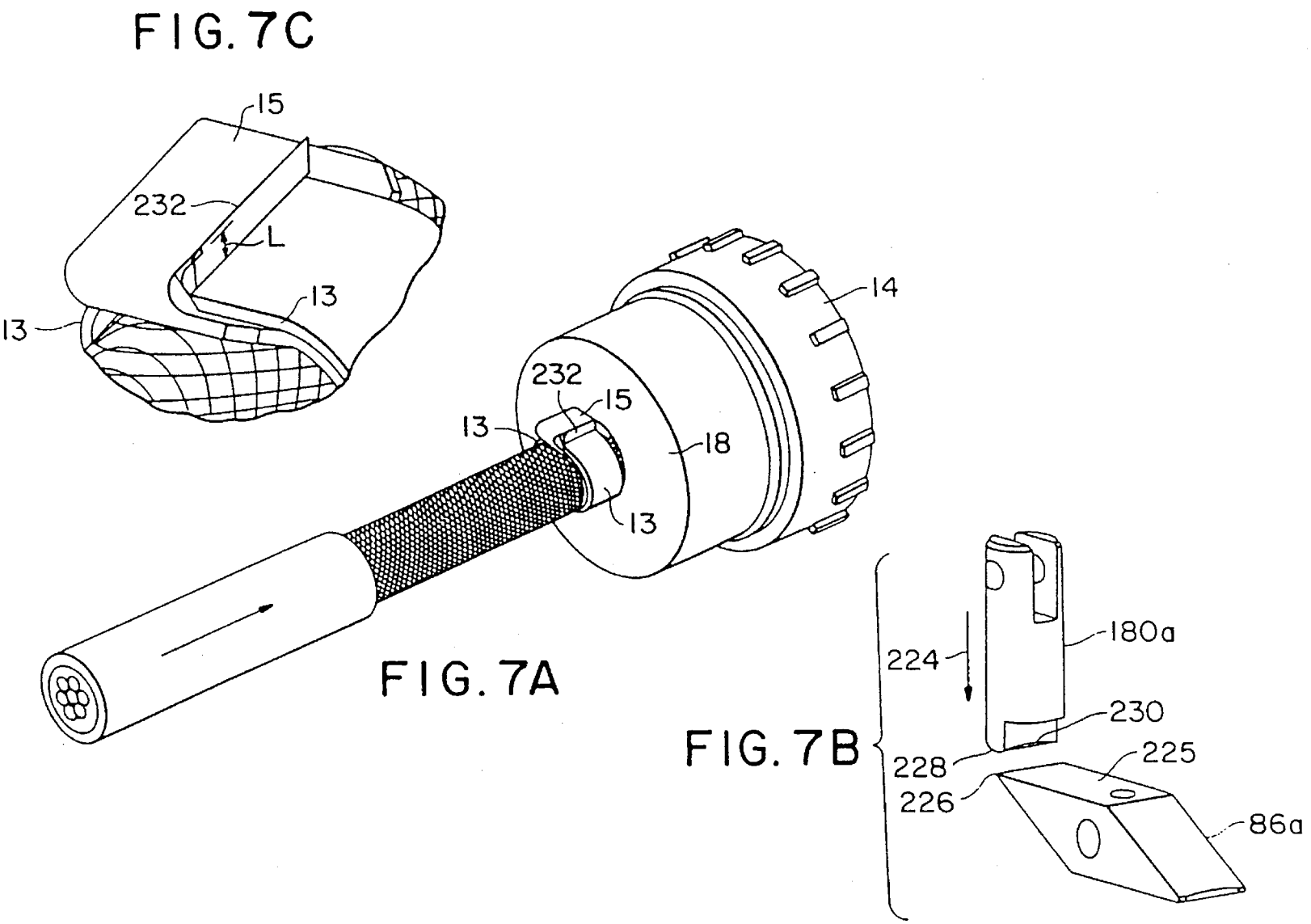
FIGS. 7A–7C are isometric views of one embodiment of a locking tab and the hardware required for formation thereof.

Referring to FIGS. 7A and 7B, one embodiment of a cut-off arrangement is illustrated. Referring first to FIG. 7B, the cut-off blade 86 and the cut-off knife 180 are shown in perspective. The cut-off blade 86 which is reversible within the tool 10, provides a flat surface 225 for cooperation with the tension holding pin 92 to hold the band 13 therebetween. A cutting and bending edge 226 is provided for cooperation with the knife 180*a*.

As the knife 180*a*is pushed in the direction 224 by movement of the cut-off handle 154, a lower surface 228 thereof first contacts the buckle 15. Interaction between the lower surface 228, the buckle 15 and the upper surface 225 of the blade 86*a* causes the band 13 to be first bent and then severed. Due to an arcuate cutter 230 on the cut-off knife 180*a*, an arcuate tab 232 as shown in FIG. 7A is formed. The length L of the tab 232 is controlled by the thickness of the buckle 15 and the vertical location of the arcuate cutting edge 230. As the buckle 15 is pushed in the direction 224 by the knife 180*a* , the band 13 is bent by the buckle 15 before being severed by the arcuate cutter 230.

Figures 8A, 8B, 8C:
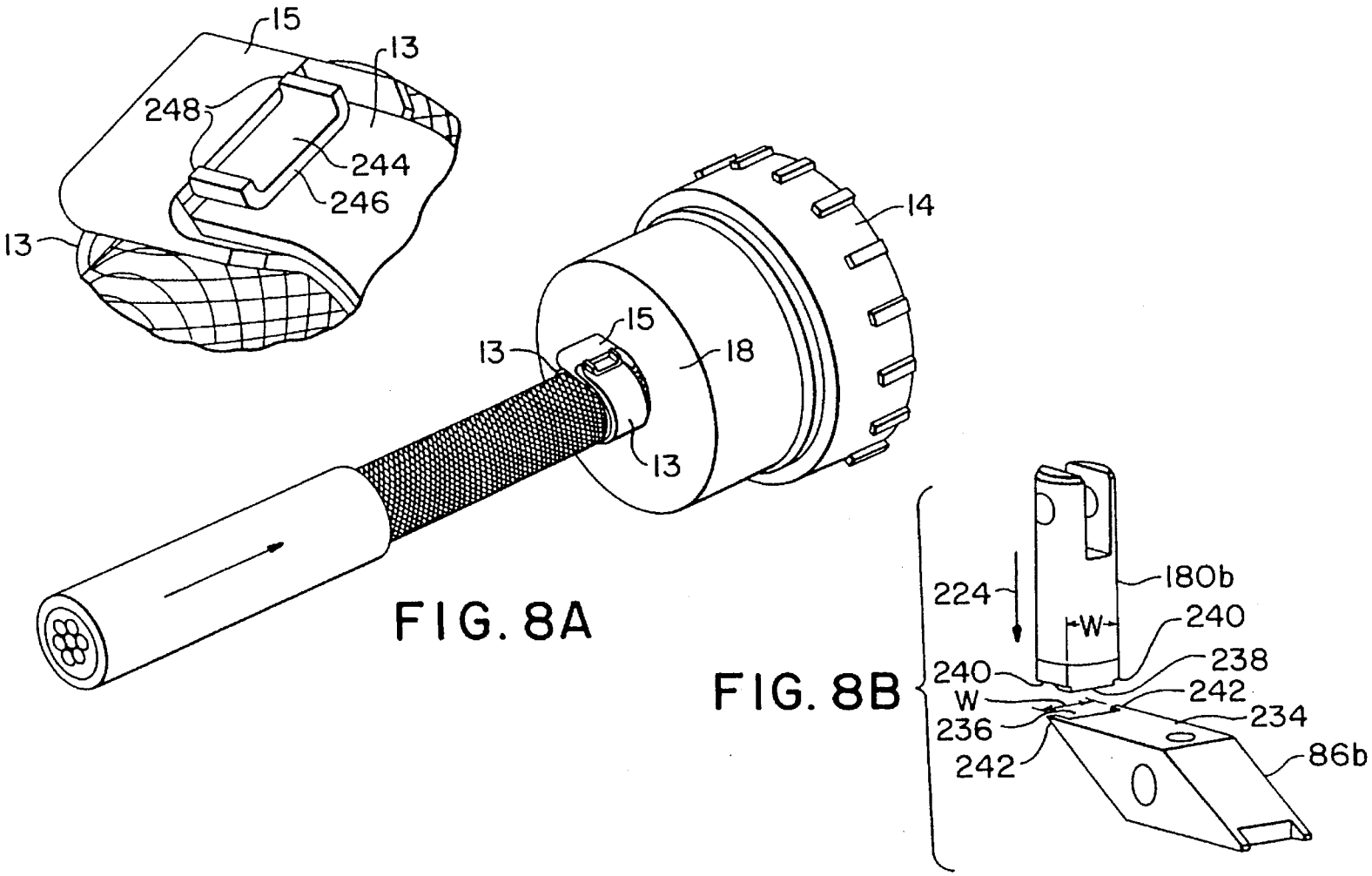
FIGS. 8A–8C are isometric views of another embodiment of a locking tab and the hardware required for formation thereof.
Figure 9A:
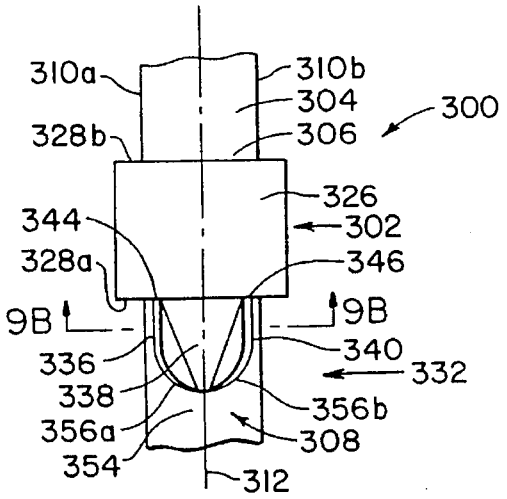
FIGS. 9A–9D are, respectively, top, cross-sectional end, side, and perspective views of one embodiment of a lock.
Figure 9C:
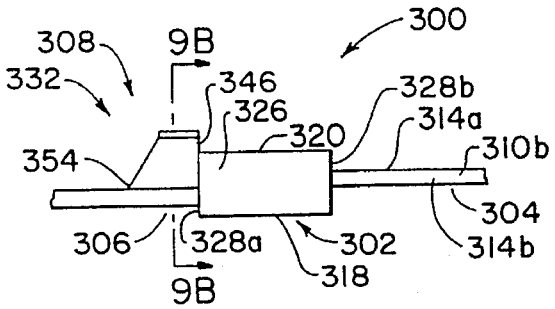
Figure 9B:
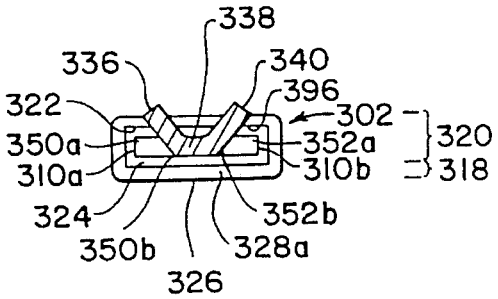
Figure 9D:
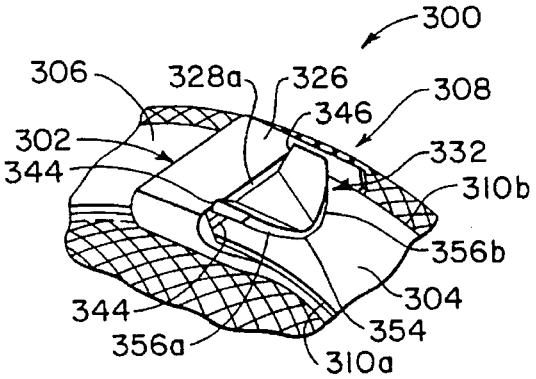
Figure 10A:
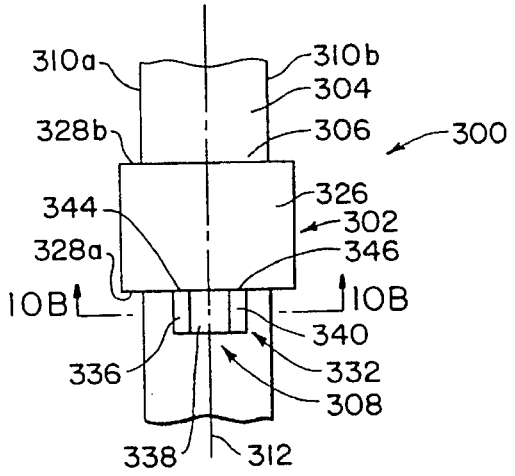
FIGS. 10A–10D are, respectively, top, cross-sectional end, side, and perspective views of another embodiment of a lock.
Figure 10C:
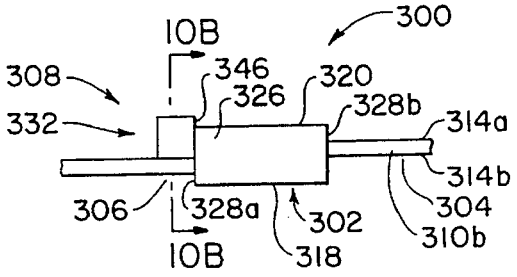
Figure 10B:
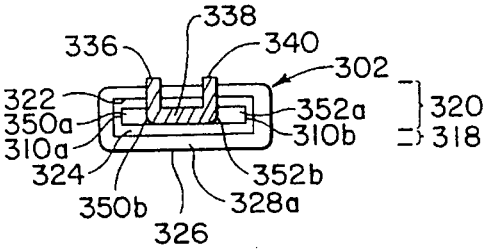
Figure 10D:
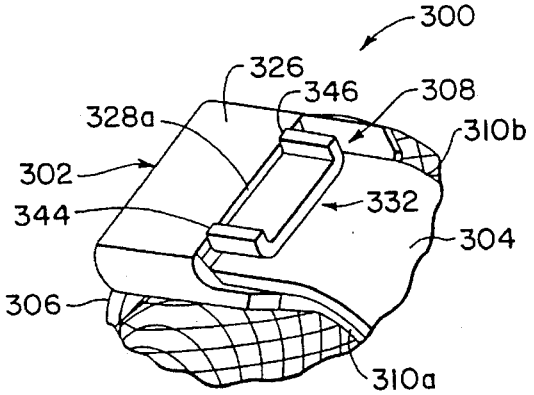
Figure 11A:
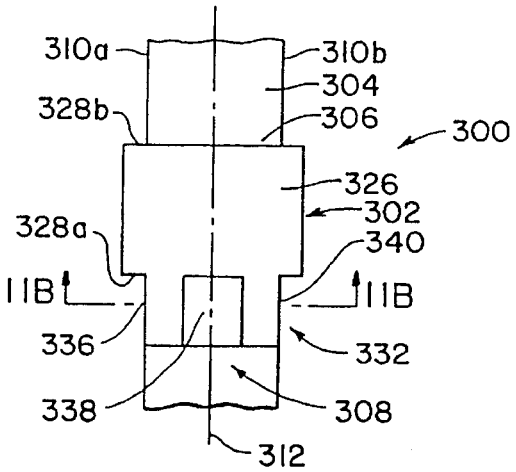
FIGS. 11A–11D are, respectively, top, cross-sectional end, side, and perspective views of another embodiment of a lock.
Figure 11C:
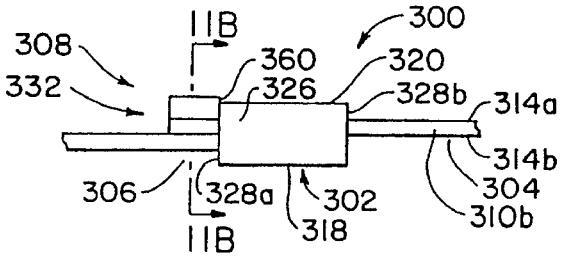
Figure 11B:
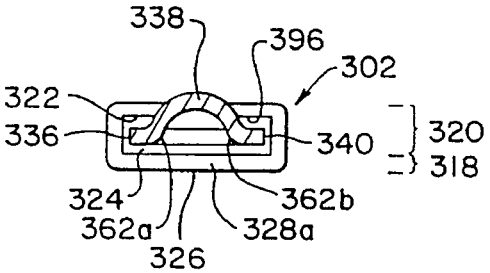
Figure 11D:
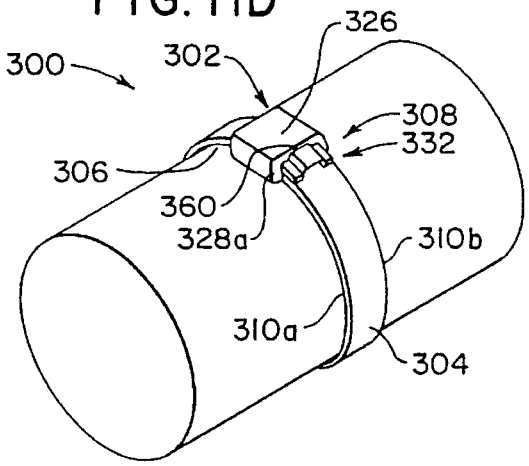
Figure 12A:
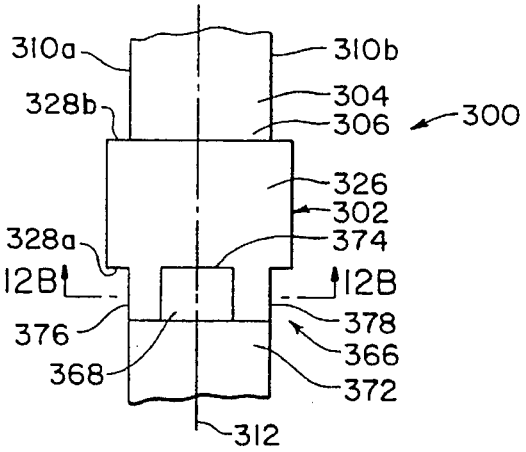
FIGS. 12A–12D are, respectively, top, cross-sectional end, side, and perspective views of another embodiment of a lock.
Figure 12C:
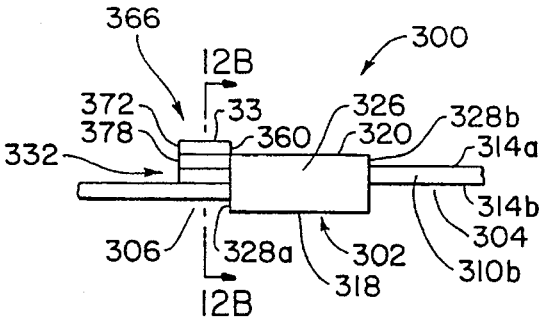
Figure 12B:
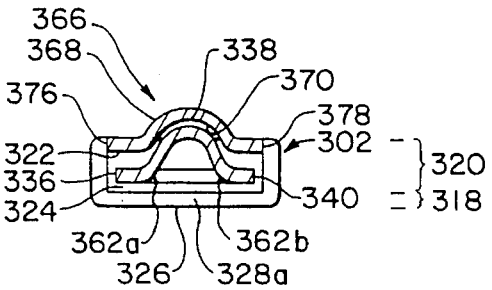
Figure 12D:
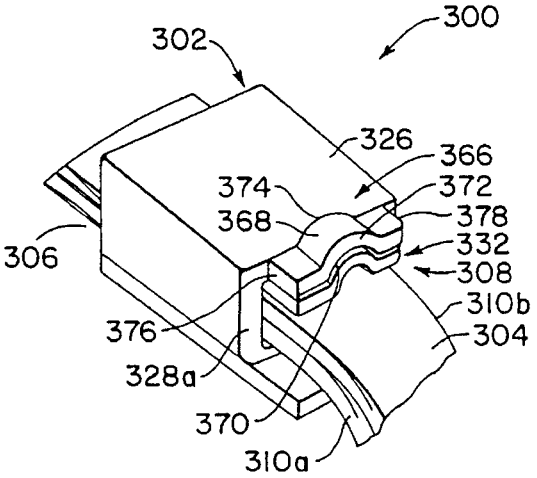
Figure 13C:
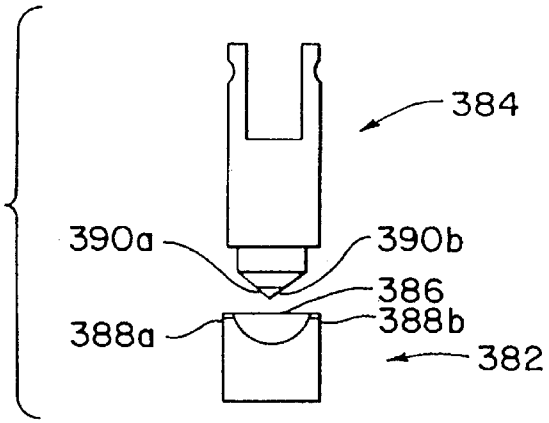
FIGS. 13A–13D are, respectively, side, bottom, front, and perspective views of a cut-off knife and cut-off blade used to form the lock illustrated in FIGS. 9A–9D.
Figure 13D:
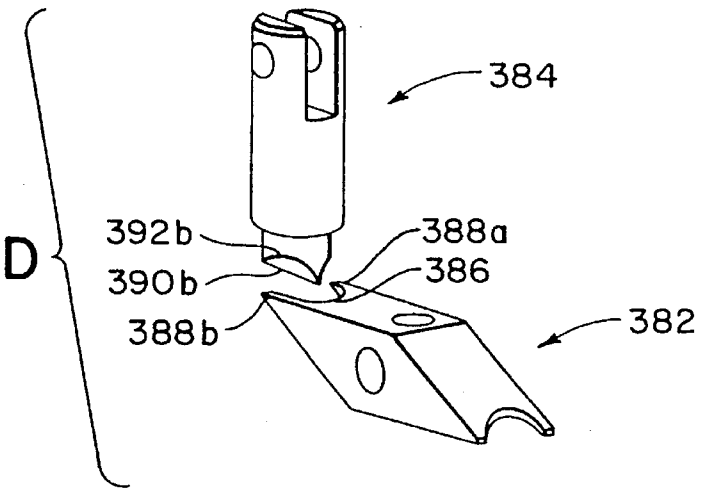
Figure 13A:
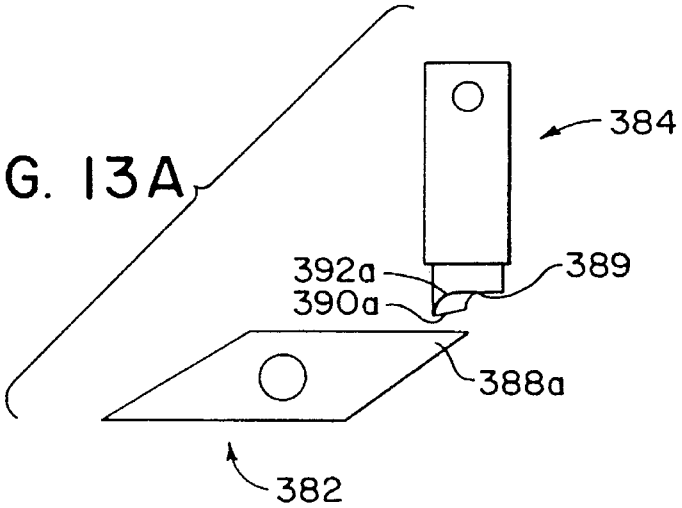
Figure 13B:
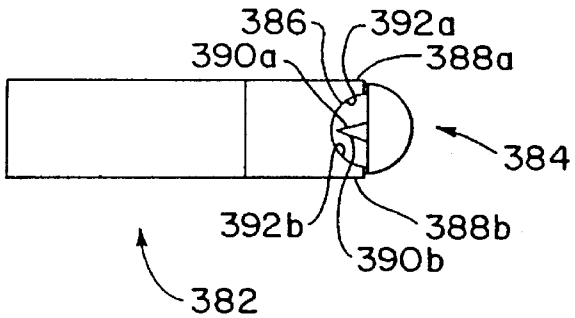
Figure 14C:
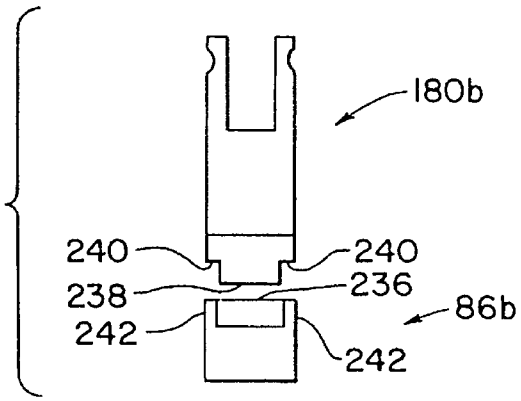
FIGS. 14A–14D are, respectively, side, bottom, front, and perspective views of a cut-off knife and cut-off blade used to form the lock illustrated in FIGS. 10A–10D.
Figure 14D:
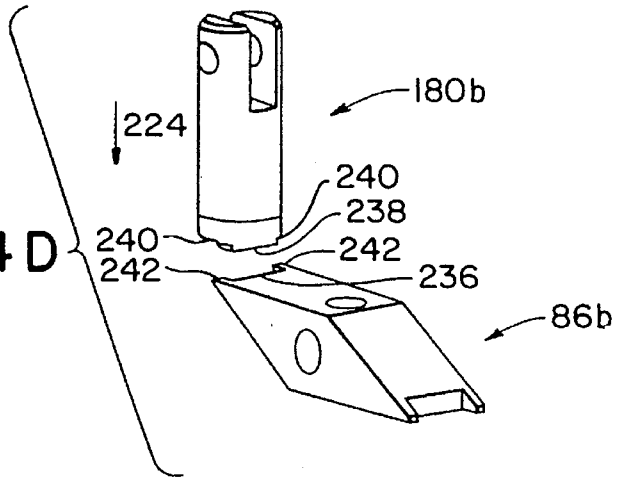
Figure 14A:
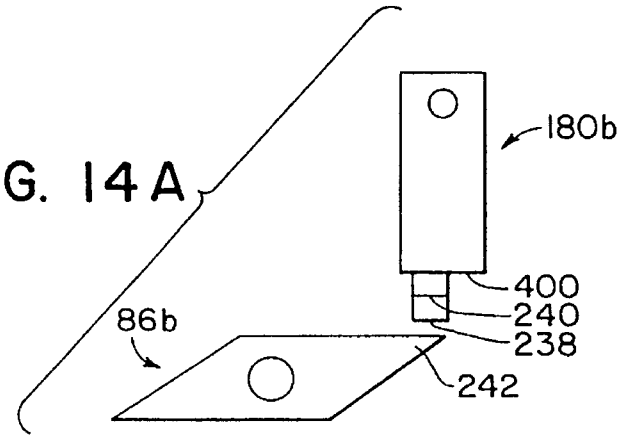
Figure 14B:
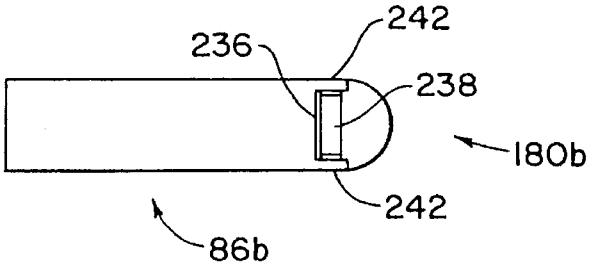
Figure 15C:
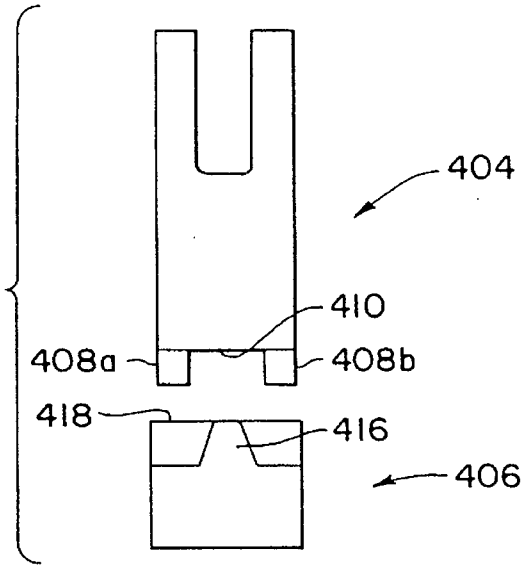
FIGS. 15A–15D are, respectively, side, bottom, front, and perspective views of a cut-off knife and cut-off blade used to form the lock illustrated in FIGS. 11A–11D and 12A–12D.
Figure 15D:
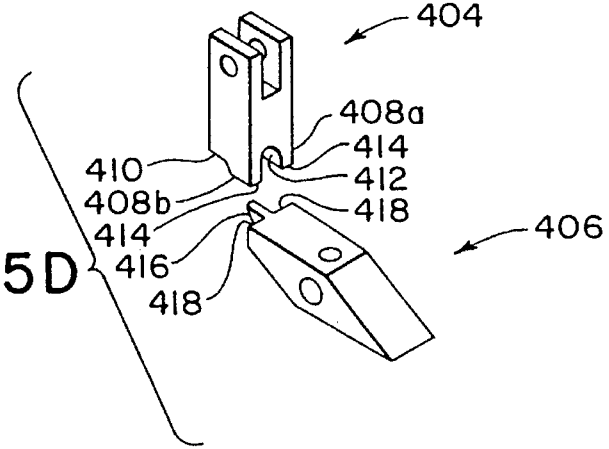
Figure 15A:
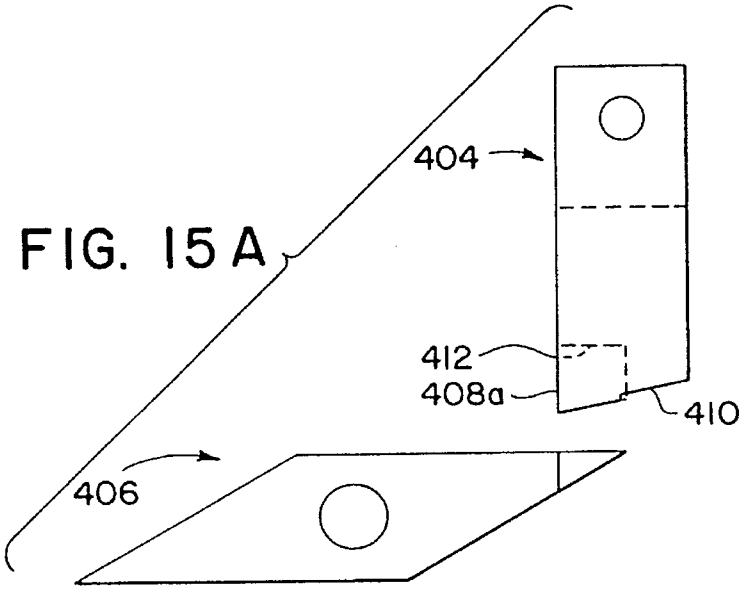
Figure 15B:
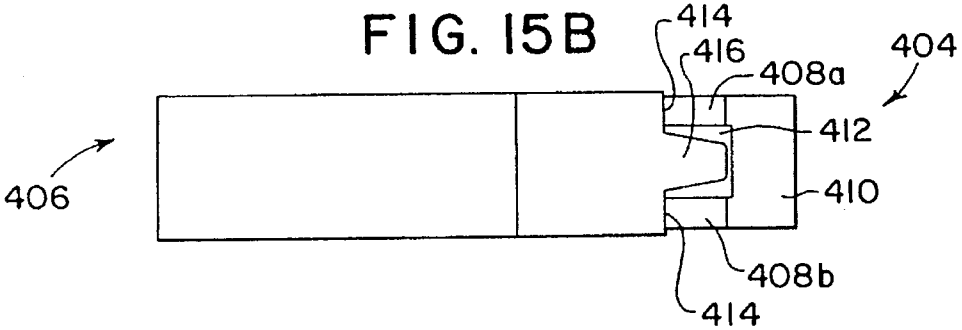

Referring to FIGS. 8A and 8B, an alternative cutting arrangement is illustrated. Referring first to FIG. 8B, a cut-off blade 86*b* and a cut-off knife 180*b* are shown. The cut-off blade 86*b* has a flat surface 234 and a bending/cutting edge 236. The blade 86*b* has a stepped bottom surface 238 having a width W matching a width w of the bending/cutting edge 236. Thus as the knife 180*b* moves in the direction 224, the lower surface 238 comes into contact with the band 13 beyond the buckle 15. The band 13 is forced into the width w of the blade 86*b* by the bottom surface 238. When the shoulders 240 of the knife 180*b* come into contact with the extensions 242 of the blade 86*b*, the band 13 has been bent and severed into a tab 244 as shown in FIG. 8A. Thus the tab 244 is formed with a straight cut-off edge 246 and a pair of retention ears 248. The retention ears 248 help secure the band 13 to the buckle 15 to prevent loss of tension therein.

Since it is important to the convenient use of the tool 10 to be able to tension the clamp 12 proximate the couple 14, the width of the tool 10 has been designed to be as close to the width of the band 13 as possible. Thus it is possible to place the tool 10 against the flange 18 and have the clamp 12 installed with a minimum amount of space therebetween. Similarly, the tool 10 has been designed for ease of operation by using the lever 44 rather than toggles as is found in the prior art. Finally, the angular relationship between the tensioning assembly and the head 36 provides a tool that is easy to load and that applies more of the work force to tensioning the band 13 than in previous devices.

FIGS. 9–12 illustrate various embodiments of a lock for use with a band clamp in which the lock provides improved strength characteristics relative to known locks in which the lock is formed by bending the band portion of the band clamp to create a locking surface that engages an exterior surface of a buckle portion of the band clamp.

In order to describe the lock of the present invention, it is believed to be useful to first describe the band clamp with which the lock is employed. With reference to FIGS. 9–12, the band clamp 300 includes a buckle 302 and a band 304 with a first end 306 that is operatively attached to the buckle 302 and a second end 308 that can be wrapped about an object and then engaged to the buckle 302. The band 304 is further defined by a first lateral edge 310*a* that is substantially parallel to a second lateral edge 310*b*. A longitudinal axis 312 extends from the first end 306 to the second end 308 and is substantially perpendicular to a line extending from a first point on the first lateral edge 310*a* to second point on the second lateral edge 310*b* that is the same distance from the first end 306 or the second end 308 as the first point. The band 304 further includes a first face 314*a* that is substantially parallel to a second face 314*b*. The band 304 is made of a material that can be wrapped about an object and then bent, deformed or otherwise processed to lock the band 304 to the buckle 302. Typically, the band 304 is made from a metal material, such as steel or aluminum. However, other materials, such as plastic, can also be used.

The buckle 302 can be generally described as an open-ended sleeve-like structure with a lower member 318 that is positioned substantially adjacent to the object about which the band 304 is wrapped and an upper member 320 that is separated from the object of interest by the lower member 318. The lower member 318 and the upper member 320 define an interior surface 322 that, in turn, defines a passageway 324 for receiving the band 304 after it has been wrapped about an object. The lower member 318 and the upper member 320 also define an exterior surface that includes an exterior side surface 326, a first exterior end surface 328*a*, and a second exterior end surface 328*b*. The buckle 302, like the band 304, is typically made of a metal material, such as steel or aluminum, but other materials, such as plastic, can also be employed.

Having described the band clamp 300, the lock of the present invention is now described with reference to FIGS. 9–12. Characteristic of each embodiment of the lock is that a lateral cross-section of a locking surface 332 that is established in a portion of the second end 308 of the band 304 that emerges from the buckle 302 after the band 304 has been passed through the passageway 324 is that a first point 336 on the first lateral edge 310*a* is a different distance from the lower member 318 of the buckle 302 than an intermediate point 338 on the band 304 that is located in between the first point 336 and a second point 340 on the second lateral edge 310*b*. The locking surface 332 engages the first exterior end surface 328*a* of the buckle 302 to prevent the band 304 from being pulled back through the passageway 324 of the buckle 302 as well as exhibits improved strength characteristics relative to known band clamp locks in which the band is bent, deformed, or otherwise processed to create a locking surface that engages the exterior of a buckle.

FIGS. 9A–9D and 10A–10D illustrate two embodiments of the lock of the present invention. In these embodiments of the lock, the lateral cross-section of the locking surface 332 has a first point 336 on the first lateral edge 310*a* which is greater distance from the lower member 318 of the buckle 302 than the intermediate point 338 on the band 304 that is located in between the first point 336 and the second point 340 on the second lateral edge 310*b*. These embodiments of the lock can be further characterized in that the second point 340 on the second lateral edge 310*b* is a greater distance from the lower member 318 of the buckle 302 than the intermediate point 338 on the band 304. Further, the distance of the first point 336 on the first lateral edge 310*a* to the lower member 318 of the buckle 302 and the distance of the second point 340 on the second lateral edge 310*b* to the lower member 318 of the buckle 302 are substantially equal.

Further, in these embodiments of the lock, the locking surface 332 comprises a first inner edge 344 and a second inner edge 346 which are formed by cutting portions of the band that emerge from the buckle 302 after the band 304 has been passed through the passageway 324. Particularly, the first inner edge 344 is a surface intermediate to the first face 314*a* and the second face 314*b* and is formed by cutting the band 304 traverse to the longitudinal axis 312 from a first cutting point 350*a* on the first lateral edge 310*a* to a first intermediate cutting point 350*b*. The second inner edge 346 is a surface intermediate to the first face 314*a* and second face 314*b* and is formed by cutting the band 304 traverse to the longitudinal axis 312 from a second cutting point 352*a* on the second lateral edge 310*b*, which is substantially opposite to the first cutting point 350*a*, to a second intermediate cutting point 352*b*. The locking surface 332 is formed by bending, deforming or otherwise processing the first lateral edge 310*a* and second lateral edge 310*b*. The lock is established by engaging the first inner edge 344 and the second inner edge 346 of the locking surface 332 and the first exterior end surface 328*a* of the buckle 302.

Referring to FIGS. 9A–9D, this embodiment of the lock is further characterized by the lateral cross-section of the locking surface 332 being substantially V-shaped. It is a further characteristic of this embodiment of the lock that the band 304 has a second end 308 which comprises a point 354 where a first angled edge 356*a* and a second angled edge 356*b* merge. Particularly, when the first lateral edge 310*a* and second lateral edge 310*b* are being bent, deformed or otherwise processed to form the locking surface 332, the second end 308 of the band 304 is cut inwardly at an angle from the first lateral edge 310*a* to form a first inward angled edge 356*a* and from the second lateral edge 310*b* to form a second inward angled edge 356*b*. The first angled edge 356*a* and the second angled edge 356*b* of the band 304 beginning where the first lateral edge 310*a* and second lateral edge 310*b* end, respectively. Formed this way, the force required to sever the excess portion of the second end 308 of the band 304 is substantially reduced and as a result can be readily formed by a hand banding tool as well as a powered banding tool.

Referring to FIGS. 10A–10D, this embodiment of the lock is further characterized by the lateral cross-section of the locking surface 332 being substantially U-shaped. Consequently, the locking surface 332 is established by bending the first and second lateral edges 310*a*, 310*b* substantially parallel to the longitudinal axis 312. To ruin this embodiment of the lock would require the first lateral edge 310*a* and the second lateral edge 310*b* to be defeated along their entire length. The consequence being that this embodiment of lock, in addition to exhibiting the improved strength characteristics shown by the various embodiments of the present invention, also has generally long lasting qualities.

FIGS. 11A–11D and 12A–12D illustrate two embodiments of the lock of the present invention. In these embodiments of the lock, the lateral cross-section of the locking surface 332 is such that the intermediate point 338 that is located in between the first point 336 on the first lateral edge 310*a* and the second point 340 on the second lateral edge 310*b* is a greater distance from the lower member 318 of the buckle 302 than the first point 336 on the first lateral edge 310*a*. Further, the intermediate point 338 on the band 304 is a greater distance from the lower member 318 of the buckle 302 than the second point 340 on the second lateral edge 310*b*. In addition, the locking surface 332 is further characterized by the distance of the first point 336 on the first lateral edge 310*a* to the lower member 318 of the buckle 302 and the distance of the second point 340 on the second lateral edge 310*b* to the lower member 318 of the buckle 302 being substantially equal. Further, the locking surface is established by bending the first and second lateral edges 310*a*, 310*b* substantially parallel to the longitudinal axis 312 of the band 304.

Further, in these embodiments of the lock, the locking surface 332 comprises an intermediate edge 360 which is formed by cutting an intermediate portion 334 of the band 304 that emerges from the buckle 302 after the band 304 has been passed through the passageway 324. Particularly, the intermediate edge 360 is a surface intermediate to the first face 314*a* and the second face 314*b* of the band 304 and is formed by cutting the band 304 traverse to the longitudinal axis 312 from a first internal cutting point 362*a* to a second internal cutting point 362*b*, which is substantially opposite to the first internal cutting point 362*a* relative to the longitudinal axis 312. The locking surface 332 is formed by bending, deforming or otherwise processing the intermediate edge 360. The lock is established by engaging the intermediate edge 360 and the first exterior end surface 328*a* of the buckle 302.

These embodiments of the lock can be further characterized by the lateral cross-section of the locking surface 332 being substantially Ω-shaped. Further, the intermediate edge 360 is substantially even with upper member 320 of the buckle 302. In addition to exhibiting strength characteristics, these embodiments are formed in such a way to reduce the probability that the integrity of the lock will be compromised. Particularly, in these embodiments of the lock, the exposed edges are reduced to reduce the chances that the lock will defeated because of snagging. An additional advantage of these embodiments of the lock is that, due to the surface in between the first and second lateral edges 310*a*, 310*b* being displaced relative to the lower member 318 of the buckle 302 rather than the first and second lateral edges 310*a*, 310*b*, it allows a banding tool to be designed which can be used to form the lock for various band and buckle widths.

With reference to FIGS. 12A–12D, in this embodiment of the lock, the exterior surface of the buckle 302 that engages the locking surface 334 further comprises a lock cover 366 to protect the locking surface 334 against tampering. The lock cover 366 comprises a cover exterior surface 368, a cover interior surface 370, a first cover end surface 372 and a second cover end surface 374, a first cover side surface 376, and a second cover side surface 378. Particularly, the lock cover 366 extends from the upper member 320 and over the portion of the band 304 that emerges from the buckle 302 after the band 304 has been passed through the passageway 324. The lateral cross-section of the lock cover 366 is substantially similar to the lateral cross-section of the locking surface 332 being covered. In this embodiment of the lock, the lateral cross-section of the cover exterior surface 368 is substantially Ω-shaped.

In addition to providing protection for the lock, the lock cover 366 provides a reference point for the banding tool that is used to form the lock. Particularly, when the locking surface 332 is formed, the intermediate edge 360 of the locking surface 334 conforms with the cover interior surface 370 of the lock cover 366. The lock is established by engaging the intermediate edge 360 of the locking surface 334 and the portion of the first exterior end surface 328*a* of the buckle 302 which is left exposed by the lock cover 366.

Having described the various embodiments of the lock of the present invention, the method of forming the various embodiments of the lock illustrated in FIGS. 9–12 and the tools for forming these locks will now be described. It is a characteristic of each embodiment of the lock that the locking surface 332 is established by shaping the portion of the second end 308 of the band 304 that emerges from the buckle 302 after being passed through the passageway 324, so that if the locking surface 332 is viewed in a lateral cross-section, the first point 336 on the first lateral edge 310*a* is a different distance from the lower member 318 of the buckle 302 than the intermediate point 338 located in between the first point 336 and the second point 340 on the second lateral edge 310*b*. The locking surface 332 can then engage the first exterior end surface 328*a* of the buckle 302 to prevent the band 304 from being pulled back through the passageway 324 of the buckle 302 as well as exhibits improved strength characteristics relative to known band clamp locks in which the band is shaped to create a locking surface that engages the exterior of the buckle.

As discussed earlier, FIGS. 9A–9D and 10A–10D illustrate two embodiments of the lock of the present invention. In these embodiments of the lock, the locking surface 332 is formed by shaping the portion of the second end 308 of the band 304 that emerges from the buckle 302 after the band 304 has passed through the passageway 324 so that if the locking surface 332 is viewed in lateral cross-section, the first point 336 on the first lateral edge 310*a* is a greater distance from the lower member 318 of the buckle 302 than the intermediate point 338 on the band 304; the second point 340 on the second lateral edge 310*b* is also a greater distance from the lower member 318 of the buckle 302 than the intermediate point 338; and the distances between the first point 336 and the lower member 318 and between the second point 340 and the lower member 318 of the buckle 302 are substantially equal.

Referring to FIGS. 9A–9D, this embodiment of the lock is further characterized by shaping the portion of the second end 308 of the band 304 that emerges from the buckle 302 so that the lateral cross-section of the locking surface 332 is substantially V-shaped in accordance with the method previously discussed. The forming of the locking surface 332 also includes cutting the second end 308 of the band 304 from the first cutting point 350*a* to the first intermediate cutting point 350*b* and from the second cutting point 352*a* to the second intermediate cutting point 352*b* to form a first cut and a second cut respectively, in the band 304. These cuts facilitate bending the band 304 to establish the aforementioned V-shape as well as establish the first inner edge 344 and the second inner edge 346 that contact the first exterior end surface 328 of the buckle 302. Additionally, the second end 308 of the band 304 is cut to trim the excess portion the second end 308. Specifically, the second end 308 is cut at an angle or along a curve from the first lateral edge 310*a* to form the first angled edge 356*a* and from the second lateral edge 310*b* to form the second angled edge 356*b*. By trimming the second end 308 in this way, a tool can be designed that permits the cut or cuts to be made over a defined period of time rather than simultaneously. As a result, less force per unit of time is needed to make the cut or cuts thereby allowing implementation in a hand tool as well as a powered tool.

One way to form the embodiment of the lock referred to in FIGS. 9A–9D is to use the banding tool previously described with a V-blade 382 and a V-knife 384. The V-blade 382 includes a curved edge 386, a first leg 388*a*, a second leg 388*b*, and a buckle contact surface 389 that cooperate with the V-knife 384 to form the locking surface 332. Likewise, the V-knife 384 includes first angled straight edge 390*a*, second angled straight edge 390*b*, first curved edge 392*a*, and second curved edge 392*b* for cooperating with the edges and surfaces of the blade 382 to produce the locking surface 332 and to sever the excess portion of the band 304.

With the V-blade 382 and V-knife 384 installed in the tool and the second end 308 of the band 304 being appropriately tensioned by the tool, formation of the locking surface 332 commences with the V-knife 384 being displaced toward the V-blade 382 by the movement of the cut-off handle 154. As the V-knife is displaced the buckle contact surface 389 comes into contact with the upper member 320 of the buckle 302. Likewise, the first angled straight edge 390*a* and the second angled straight edge 390*b* come into contact with the first face 314*a* of the band 304. With contact established, the V-knife 382 is now further displaced toward the V-blade 384 to establish the locking surface 332 and to sever the excess portion of the second end 308 of the band. Specifically, further displacement of the V-knife 384 results in the first and second angled straight edges 390*a*, 390*b* of the V-knife 384 cooperating with the first and second legs 388*a*, 388*b* of the V-blade 382 to bend the first lateral edge 310*a* and second lateral edge 310*b* of the band 304 away from the lower member 318 of the buckle 302 in the characteristic V-shape. Also as a result, the band 304 immediately adjacent to the first exterior end surface 328*a* of the buckle 302 is cut from the first cutting point 350*a* on the first lateral edge 310*a* to the first intermediate cutting point 350*b* and from the second cutting point 352*a* on the second lateral edge 310*b* to the second intermediate cutting point 352*b* to form the first inner edge 344 and the second inner edge 346 of the locking surface 332, respectively. These cuts are caused by the bending of the band 304 forcing the first face 314*a* of the band 302 into contact with the portion of the first exterior end surface 328*a* associated with the upper member 320 of the buckle 302. The surface is hereinafter referred to as the band cutting edge 396. The lock is now formed by the engagement of the locking surface 332 to the buckle 302 and, more specifically, by the engagement between the first inner edge 344 and the second inner edge 346 of the locking surface 332 with the first exterior end surface 328*a* of the buckle 302.

After formation of the locking surface 332, the band 304 is cut to form a first angled edge 356*a* and a second angled edge 356*b*, which terminate into a point 354, by the opposition of first and second curved edges 392*a*, 392*b* of the V-knife 384 against the curved edge 386 of the V-blade 384. Due to the curve of the first and second curved edges 392*a*, 392*b*, the cuts required to form the first and second angled edges occur over a period of time rather than simultaneously. Consequently, the force required to sever the excess portion of the second end 308 of the band 304 is substantially reduced and as a result can be readily accomplished with the hand banding tool as well as a powered banding tool. Further, the lock is established while avoiding a release of tension in the band and relative rotation between the band and the clamped object together with the thinning that is associated with this rotation.

Referring to FIGS. 10A–10D, this embodiment of the lock is further characterized by shaping the portion of the second end 308 of the band 304 that emerges from the buckle 302 so that the lateral cross-section of the locking surface 332 is substantially U-shaped in accordance with the method previously discussed. The forming or shaping of the locking surface 332 also includes cutting the band 304 from the first cutting point 350*a* to the first intermediate cutting point 350*b* and from the second cutting point 352*a* to the second intermediate cutting point 352*b* to form a first cut and a second cut, respectively, in the band 304 that facilitate the bending of the first and second lateral edge 310*a*, 310*b* the band 304 substantially parallel to the longitudinal axis 312 to achieve the U-shape characteristic of this particular embodiment of the lock. Further, the cuts establish the first inner edge 344 and second inner edge 346 that engage the first exterior end surface 328 of the buckle 302. Also, in conjunction with forming the locking surface 332, the second end 308 of the band 304 is trimmed.

One way to form the embodiment of the lock referred to in FIGS. 10A–10D is to use the banding tool with the cut-off blade 86*b* and cut-off knife 180*b* previously described. To reiterate, as the cut-off knife 180*b* is pushed in the direction 224 by the movement of the cut-off handle 154, a buckle contact surface 400 of the cut-off knife 180*b* contacts the upper member 320 of the buckle 302. Further, the lower surface 238 of the cut-off knife 180*b* comes into contact with the first face 314*a* of the band 304. After contact is established, the cut-off knife 180*b* is now further displaced towards the cut-off blade 86*b* to form the locking surface 332 and to trim the excess portion of the second end 308 of the band 304. Specifically, further displacement of the cut-off knife 180*b* results in the lower surface 238 cooperating with the extensions 242 of the cut-off blade 86*b* to bend the first lateral edge 310*a* and second lateral edge 310*b* of the band 304 away from the lower member 318 of the buckle 302 to form the characteristic U-shape of the lock. Also, as a result, the band 304 immediately adjacent to the first exterior end surface 328*a* of the buckle 302 is cut from the first cutting point 350*a* on the first lateral edge 310*a* to the first intermediate cutting point 350*b* and from the second cutting point 352*a* on the second lateral edge 310*b* to the second intermediate cutting point 352*b* to form the first inner edge 344 and the second inner edge 346 of the locking surface 332, respectively. These cuts are caused by the bending of the portion of the band 304 forcing the first face 314*a* of the band 304 into contact with the band cutting edge 396. The lock is now formed by the engagement of the locking surface 332 to the buckle 302 and, more specifically by the engagement of the first inner edge 334 and the second inner edge 346 of the locking surface 332 with the first exterior end surface 328*a* of the buckle 302. It should also be noted that the lock is established while substantially avoiding the release of tension in the band and relative rotation of the band and the clamped object together with the thinning resulting from rotation.

FIGS. 11A–11D and 12A–12D illustrate two embodiments of the lock of the present invention. In these embodiments of the lock, the locking surface 332 is formed by shaping the portion of the second end 308 of the band 304 that emerges from the buckle 302 so that if the locking surface 332 is viewed in lateral cross-section, the intermediate point 338 on the band 304 is a greater distance from the lower member 318 of the buckle 302 than the first point 336 and the second point 340. Further, in the lateral cross-section, the distance of the first point 336 on the first lateral edge 310*a* from the lower member 318 of the buckle 302 and the distance of the second point 340 from the lower member 318 are substantially equal. Stated another way, the lateral cross-section of the locking surface 332 is substantially Omega-shaped. Further, the portion of the band 304 is bent, deformed or otherwise processed to cause the intermediate edge 360 to be substantially even with the upper member 320 of the buckle 302. As before, the lock is created in a manner that largely circumvents any need to release tension in the band and relative rotation between the band and the clamped object and the thinning due to rotation.

One way to form the embodiment of the lock referred to in FIGS. 11A–11D is to use the Ω-knife 404 and Ω-blade 406 shown in FIGS. 15A–15D with the banding tool previously described. The Ω-knife 404 includes a first leg 408*a*, a second leg 408*b*, a buckle contact surface 410, band contact surface 412, and a first cutting edge 414 for cooperating with the Ω-blade 406 to produce the lock and sever excess band. The n-blade 406 includes a tongue 416 and a second cutting edge 418 for cooperating with the Ω-knife 404 to form the lock and trim any excess portion of the band 304.

With the Ω-knife 404 and Ω-blade 406 installed in the tool and with the band 304 appropriately tensioned by the tool, formation of the locking surface 332 commences with the Ω-knife 404 being displaced towards the n-blade 406 by the movement of the cut-off handle 154. As the Ω-knife 404 is displaced, the buckle contact surface comes into contact with the upper member 320 of the buckle 302 and the first and second legs 408*a*, 408*b* come into contact with the band 304. Further displacement of the Ω-knife 404 towards the Ω-blade 406 serves to form the locking surface 332. Specifically, further displacement of the Ω-knife 404 results in the first and second legs 408*a*, 408*b* of the Ω-knife 404 cooperating with the tongue 416 to form the locking surface 332 by displacing the portion of the band 304 located intermediate the first and second lateral edges 310*a*, 310*b* to be bent away from the lower member 318 of the buckle 302 in the characteristic Ω-shape. Also as a result of the bending, the portion of the band 304 immediately adjacent to the first exterior end surface 328*a* of the buckle 302 is cut from the first internal cutting point 362*a* to the second internal cutting point 362*b* to form the intermediate edge 360. This cut is caused by the bending of this portion of the band 304 forcing the first face 314*a* of the band 304 to contact the band cutting edge 396. The band cutting edge 396 is the interface of the interior surface 322 and upper member 320 of the buckle 302. The lock is now formed by the engagement of the locking surface 332 to the buckle 302 and more specifically, by the engagement between the intermediate edge 360 of the locking surface 332 and the first exterior end surface 328*a* of the buckle 302.

Consequently, all but a narrow portion of the excess band 304 is severed from the locking surface 332 during lock formation. More precisely, upon completing the lock, a portion of the band 304 between the tongue 416 and the Ω-knife 404 remains uncut. To completely detach the newly formed lock from the excess band portion, tension is again applied to the excess band portion by applying force to the pull up handle 116 in the direction 126. Note that prior to using the pull up handle 116, the tensioning assembly 24 may require adjusting such that this assembly can withstand a greater tension, i.e., a tension sufficient to tear away the excess band from the newly formed lock.

One way to form the embodiment of the lock referred to in FIGS. 12A–12D is to use, in the previously described banding tool, the Ω-knife 404 and Ω-blade 406 shown in FIGS. 15A–15D with the appropriate modifications to accommodate the lock cover 366. Particularly, the Ω-knife 404 is modified so that it substantially corresponds to the cross-sectional shape of the lock cover 366. When in operation the Ω-knife contacts the lock cover 366 as well as the upper member 320 of the buckle 302. In all other respects the use of the Ω-knife 404 and Ω-blade 406 in the banding tool to form the lock illustrated in FIGS. 12A–12D is identical to that previously described for forming the lock shown in FIGS. 11A–11D. Also, the lock is made in a fashion that largely circumvents the need to release tension in the band and relative rotation between the band and the clamped object and hence the thinning associated with rotation.

Figure 16:
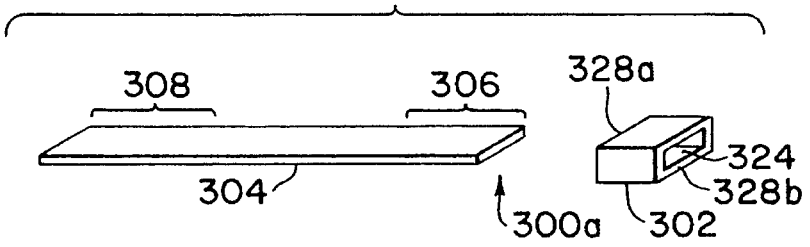
FIG. 16 illustrates an alternative embodiment of the band clamp where the buckle and the band are separated.
Figure 17:
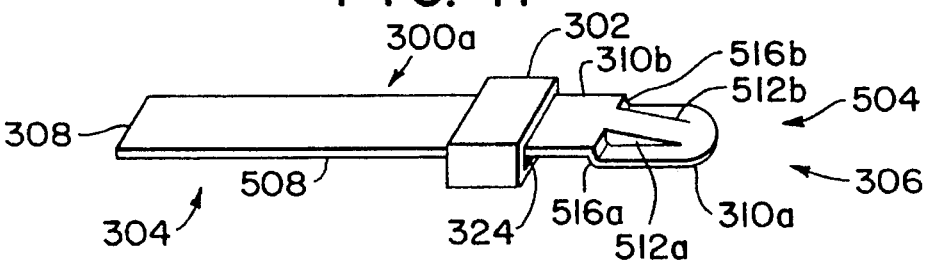
FIG. 17 represents the alternative embodiment of the band clamp with the band inserted into the detachable buckle and a buckle retaining member formed on one end of the band.
Figure 18:
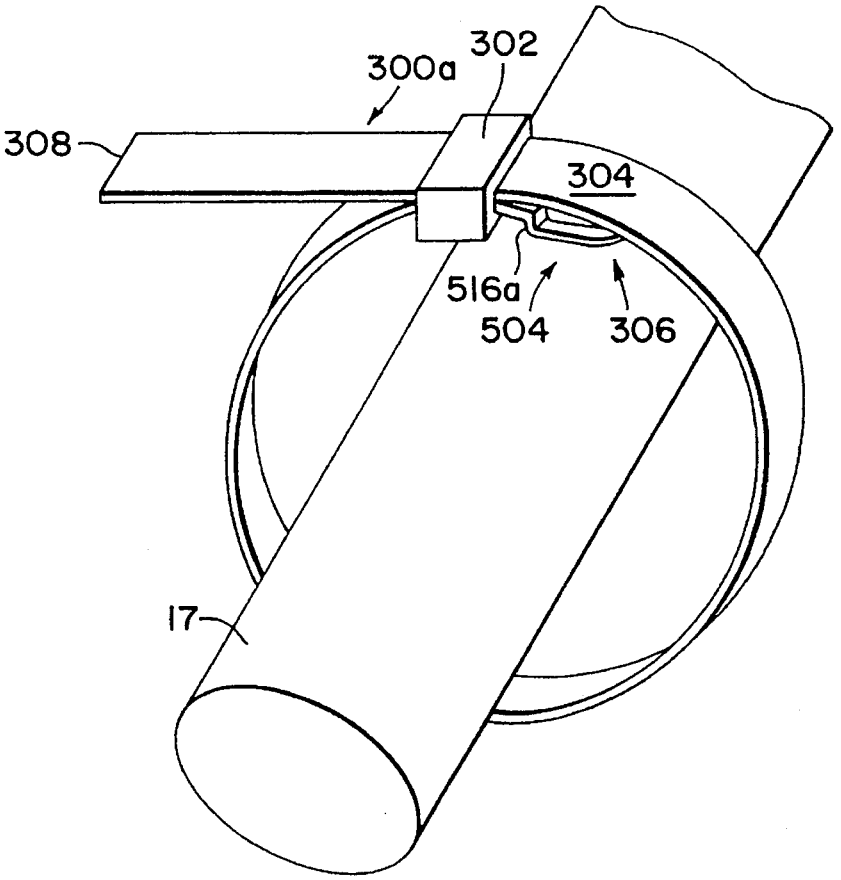
FIG. 18 illustrates wrapping the alternative embodiment of the band clamp about an object in preparation for using a banding tool.

In another embodiment of the present invention, various blade/knife configurations can be used in a dual purpose manner with a second embodiment of the band clamp hereinafter denoted band clamp 300*a* (as shown in FIGS. 16–18). That is, as shown in FIG. 16, the buckle 302 of band clamp 300*a* having a passageway 324, and first and second exterior end surfaces 328A, 328B, respectively, is no longer fixedly attached to the band 304. Instead, once the band 304 is inserted into the buckle passageway 324, a lock-like "retaining member" can also be formed by the banding tool 10 at the first end 306*a* of the band 304, as well as a lock on the second band end 308*a*. That is, the retaining member on the first end 306 is used to prevent the buckle 302 from sliding off the first end 306. The retaining member can be described in various alternative ways:

(2.1) a cross-section of the retaining member has points from the same face or surface of the band 304 that are not collinear;

(2.2) a cross-section of the retaining member has points within it such that a line segment between them has a portion outside the cross-section; or (2.3) the retaining member has at least one point on a face on the band 304 that both contacts the second exterior end surface 328*b* on the buckle 302 and is inwardly disposed toward the object being clamped further than the passageway 324.

These descriptors will be apparent to one skilled in the art from the discussion below.

As an example, in FIG. 17, one embodiment of a retaining member is presented, i.e., retaining member 504. In this configuration of a retaining member, band portions 512*a* and 512*b* adjacent to the first and second lateral edges 310*a* and 310*b*, respectively, of the first end 306 are misaligned from the remainder of the band 508. In particular, wedges 512*a* and 512*b* are formed such that the misalignments at the offset 516*a* and a similar offset 516*b* are sufficient, for all practical purposes, to prevent the band 304 from being removed from the buckle passageway 324 via first end 306. Thus, by wrapping the band 304 of band clamp 300*a* about, for example, shield 17, as shown in FIG. 18, and inserting the band second end 308 through the buckle passageway 324, the band first end 306 is sandwiched between the shield 17 and an extent of overlapping band 304. Note that such a band clamp embodiment when tightened about shield 17 provides an extremely secure tension maintaining connection at band first end 306 due to both contact between the buckle 302 and the offsets 516*a* and 516*b*, and the friction on the first end 306 resulting from being sandwiched between the shield 17 and the overlapping extent of band 304. Thus, given the configuration of band clamp 300*a* in FIG. 18, the banding tool 10 can be utilized as previously described by inserting band second end 308 into the banding tool 10 as shown in FIG. 3A.

The novel aspects relating to a banding tool 10 embodiment allowing both a lock and a retaining member to be formed reside substantially in (a) the cutoff blade 86 and cutoff knife 180 combination, and (b) enhancements in the method of operating the banding tool 10. Briefly, by using certain configurations of cutoff blade 86 and cutoff knife 180 combinations (as will be described below), a retaining member can be formed on a band first end 306 either by (3.1) inserting the first end 306 into the banding tool 10 in a forward direction 128 as in FIG. 3A (however, preferably not further than tension holding pin 92), or (3.2) inserting the first end 306 into the banding tool 10 in the reverse direction such that the band exit from the banding tool for an excess band portion cutoff upon band lock formation is now the insertion location for the band 304.

Thus, whether the first end 306 is inserted forwardly or reversely, when the first end 306 (or a band 304 portion substantially near the first end 306) resides between the cutoff blade 86 and the cutoff knife 180 a retaining member can be formed. Note that either before or after the retaining member formation, the band 304 can be inserted into the buckle passageway 324 such that a band clamp 300*a* configuration as in FIG. 17 results thereby allowing an operator to proceed as discussed in FIG. 18 and subsequently use the banding tool 10 to form a band lock.

Figures 19A, 19B, 19C, 19D, 19E, 19F, 19G:
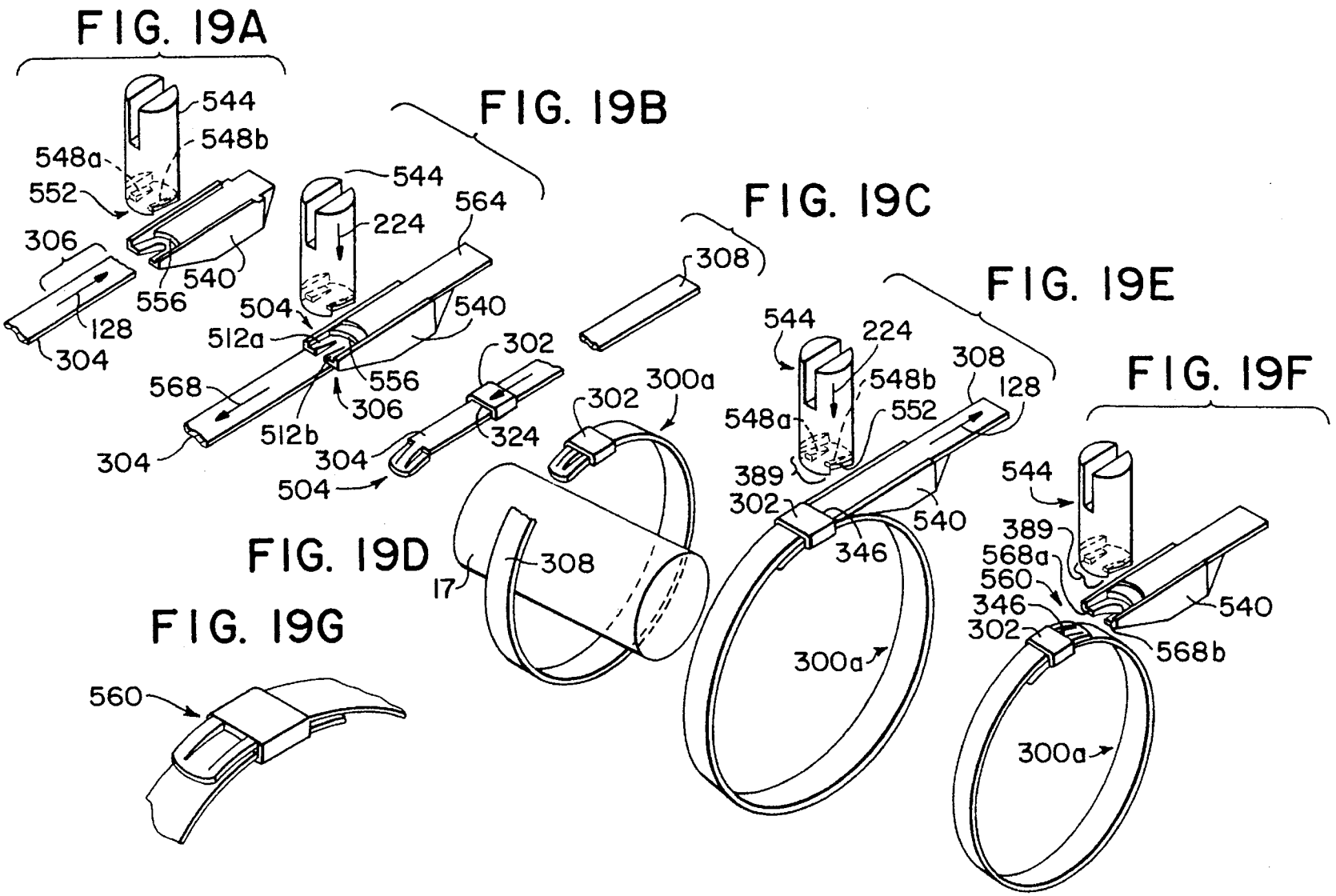
FIGS. 19A–19G illustrate a banding tool in which the knife and blade are used to form both the retaining member and subsequently the band lock.

For more detail in using the banding tool 10 for the dual purposes of forming both the retaining member and the band lock, reference is made to FIGS. 19A–19G. In these figures, note that the embodiment of the cutoff blade 86 and the cutoff knife 180 combination represented here, that is, blade 540 and knife 544, is distinct from the previous embodiments presented. In particular, substantially identical wedge indentations 548*a* and 548*b* formed on the band/buckle contacting surface 552 of the knife 544 provide a contour which results in wedge shaped portions of the band 304 being formed on the band as the knife 544 exerts a force in direction 224 thereby severing the band positioned between the knife 544 and blade 540 at the cutoff shear 556. For example, as indicated in FIGS. 19A and 19B, wedges 512*a* and 512*b* of FIG. 17 (upside down here) are formed on the first end 306 when this end is inserted between knife 544 and blade 540 along direction 128. In addition, in FIGS. 19E–19G, note that this same knife and blade combination also produces the wedge lock 560.

Thus, the operation of the banding tool 10 embodied in FIGS. 19A–19F can be described as follows. A band first end 306 is inserted forwardly (direction 128) into the banding tool 10 (FIG. 19A). Once the first end 306 is positioned to contact the entire band/buckle contacting surface 552, the cutoff handle 154 is rotated or activated in the direction 220 (FIG. 6A) and subsequently released to return its resting position. This action results in the configuration of FIG. 19B whereby the knife 544 has both severed, along cutoff shear 556, an excess band portion 564 from the band 304 and formed the wedges 512*a* and 512*b* of the retaining member on the (newly cropped) first end 306. Subsequently, the retaining member 504 is removed from the banding tool 10 by an operator pulling the band 304 in the direction 568 and (if not already inserted) the band 304 is inserted into the buckle passageway 324 via the second band end 308 as illustrated in FIG. 19C. Following this, the band 304 is wrapped about an object such as shield 17 to be banded as in FIG. 19D and, by subsequently inserting the second band end 308 back through the buckle passageway 324, the configuration of FIG. 18 is achieved. At this point, the banding tool 10 can be used to form a band lock 560 in a manner substantially similar to previous descriptions of band lock formations. That is, (i) an excess portion of the band 304 extending from the second end 308 to the buckle 302 is inserted in direction 128 into the banding tool 10 such that some portion of the band 304 is past the tension pin 78 via activation of tension hold hook 110 (FIGS. 3B and 19E), (ii) the tension hold hook 110 is used to restore the tension pins 78 and 92 to positions where tension can be applied to the band 304, (iii) the pullup handle 116 is subsequently reciprocated causing movement of the band 304 in direction 128 thereby tightening the band about the object to be banded and inherently causing the buckle be positioned immediately adjacent the blade 540 as in FIG. 19E, (iv) subsequently, once a predetermined tension on the band, pulling in the direction substantially opposite from the direction 128, is attained, the cutoff handle 154 is used to force knife 544 in direction 224. This last action thereby causes the buckle contact surface 389 (i.e., the portion of the band/buckle contacting surface 552 that contacts the buckle 302) to induce the cutting or shearing of the band 304 along the cutting edge 346 of the buckle 302 where this edge comes in contact with the blade projection ends 568*a*, 568*b* (FIG. 19F), thus forming the lock 560 of FIGS. 19F and 19G.

Figure 20:
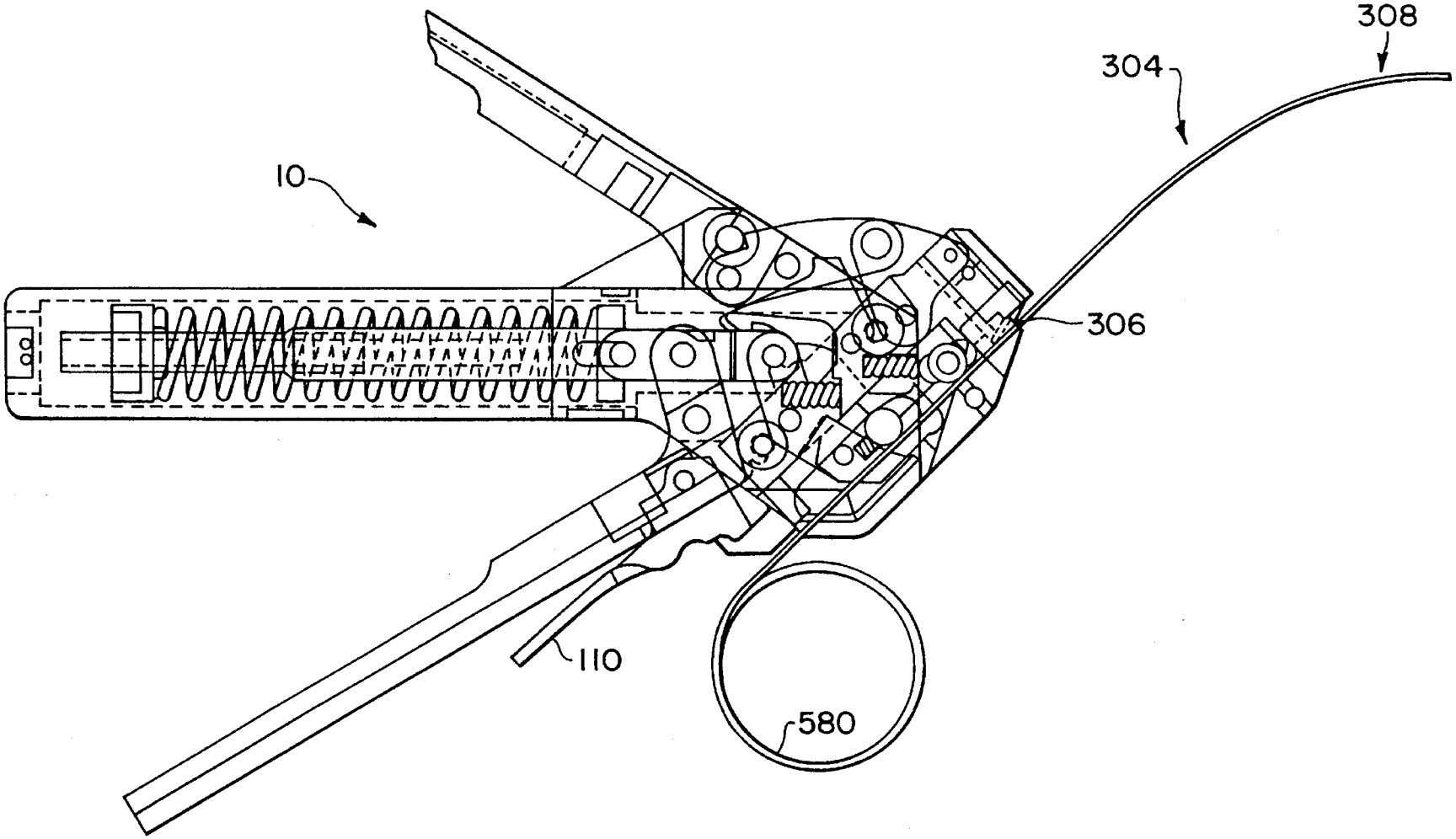
FIG. 20 illustrates an alternative method of using the banding tool 10 whereby the band 304 is inserted in a reverse direction.

In an alternative method of using the banding tool 10 embodiment to form a retaining member, instead of inserting the band first end 306 into the banding tool 10 as shown in FIG. 19A, the band 304 can be threaded reversely through the tool. For example, FIG. 20 illustrates a substantial coil of band material 580 that is threaded in the direction 216 through the band tool 10. In this procedure, the tension hold hook 110 is used to form the gaps G of FIG. 3B whereby a band end can be inserted as shown in FIG. 20. Subsequently, a length of band 304 sufficient to create the band clamp 300*a* is drawn out the previous band entry location adjacent or between the knife 544 and the blade 548. Consequently, since the portion of the band between the knife 544 and blade 540 can be considered the first end 306 of the band 304 portion drawn out of the previous band entry, the remainder of the procedure described in reference to FIGS. 19A–19G applies. Therefore, the band clamp 300*a* can be locked about an object as indicated in FIGS. 19A–19G.

The Ω-knife 404 and Ω-blade 406 can also be used with the alternative band clamp 300*a*. For example, by inserting the band clamp 300*a* in the reverse direction as described in (1.2) and shown in FIG. 20, the band 304 can be positioned between the Ω-knife 404 and the Ω-blade 406 as presented in FIGS. 21A–21C. Thus, a force on the Ω-knife 404 in the direction 224 causes the retaining member 600 to be formed on the first end 306. Subsequently, when the Ω-knife 404 is disengaged from the band 304, a sufficient length of band to form a desired band clamp can be drawn through the banding tool 10 in the direction 604 and cut off (without using the banding tool 10). Following this, the cutoff length of band drawn out of the banding tool 10 can be inserted into a buckle passageway 324 to obtain the band clamp 300*a* of FIG. 21C.

Figures 21A, 21B, 21C:
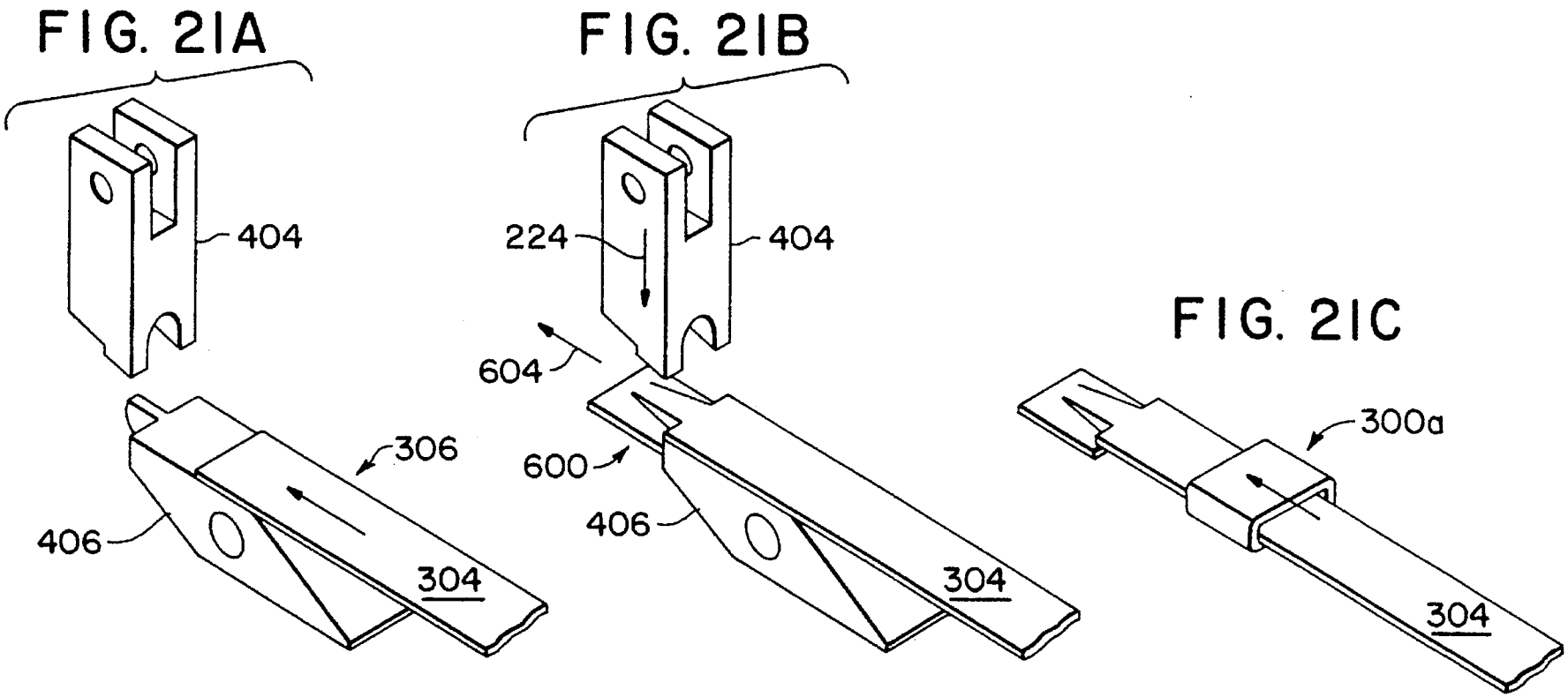
FIGS. 21A–21C illustrate the use of the Ω-knife 404 and Ω-blade 406 in forming a retaining member.
Figures 22A, 22B, 22C, 22D:
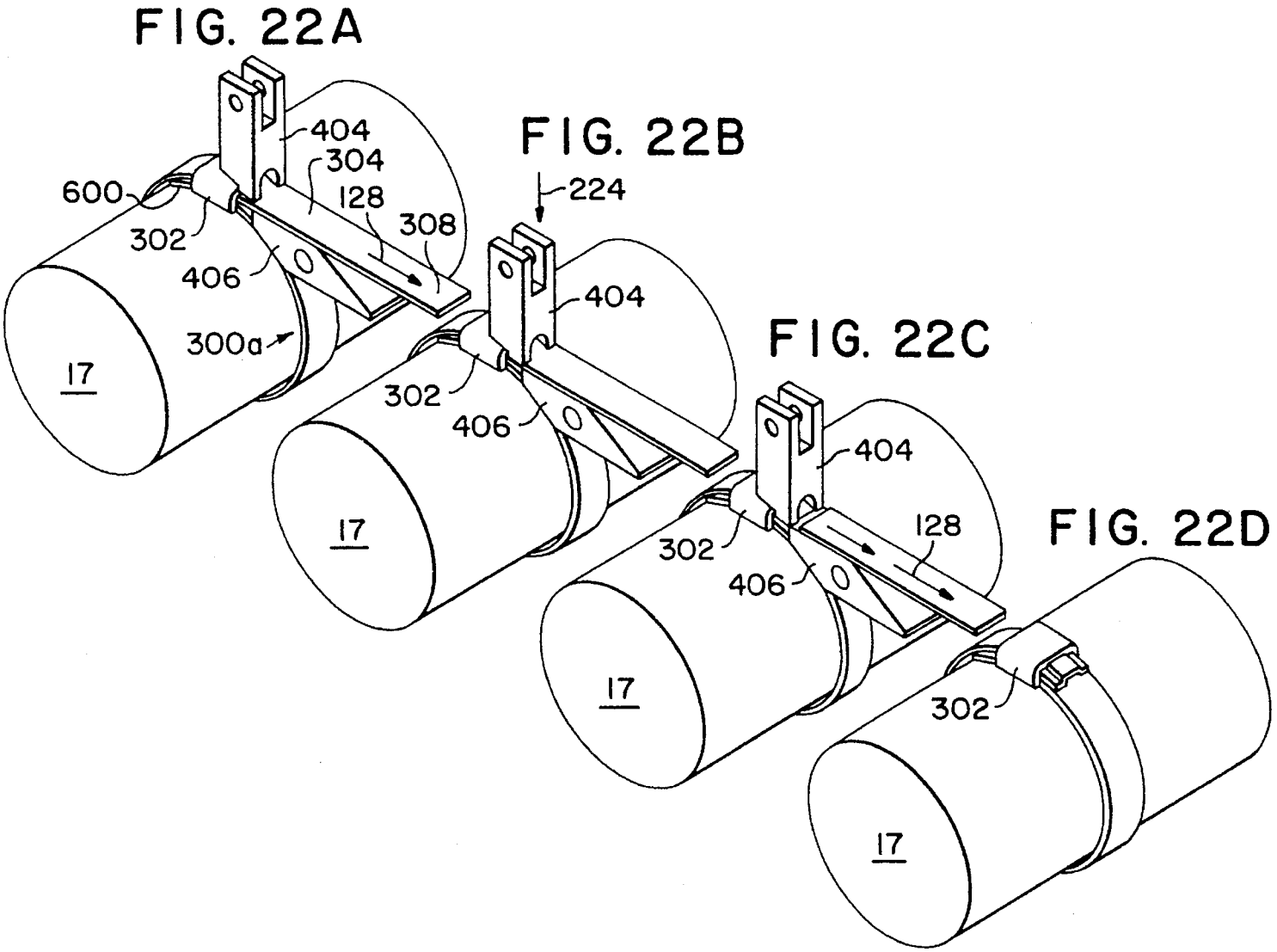
FIGS. 22A–22D illustrate the sequence of steps performed in using the Ω-knife 404 and Ω-blade 406 to form a lock.

Referring now to FIGS. 22A–22D, the newly formed band clamp 300*a* can now be wrapped around an object, such as shield 17, and the second end 308 can be inserted into the banding tool 10 in the forward direction 128 as in FIG. 21A by using the tension hold hook 110 to create gap G (FIG. 3B). Subsequently, the band clamp 300*a* can be tightened about the object and the lock of FIGS. 11A–11D can be formed in the manner described above in reference to FIGS. 15A–15D. Thus, the sequence of FIGS. 22A–22D illustrate how to form the lock using the Ω-knife 404 and Ω-blade 406 in the banding tool 10.

FIGS. 23–28 present an alternative embodiment of the banding tool which is particularly suited for use with the Ω-knife 404 and Ω-blade 406. This alternative banding tool, hereinafter denoted banding tool 650, is manually operated as with banding tool 10. However, substantially all forces required for band insertion, tensioning, lock forming and band cutting (or tearing) are supplied pneumatically.

Figure 23:
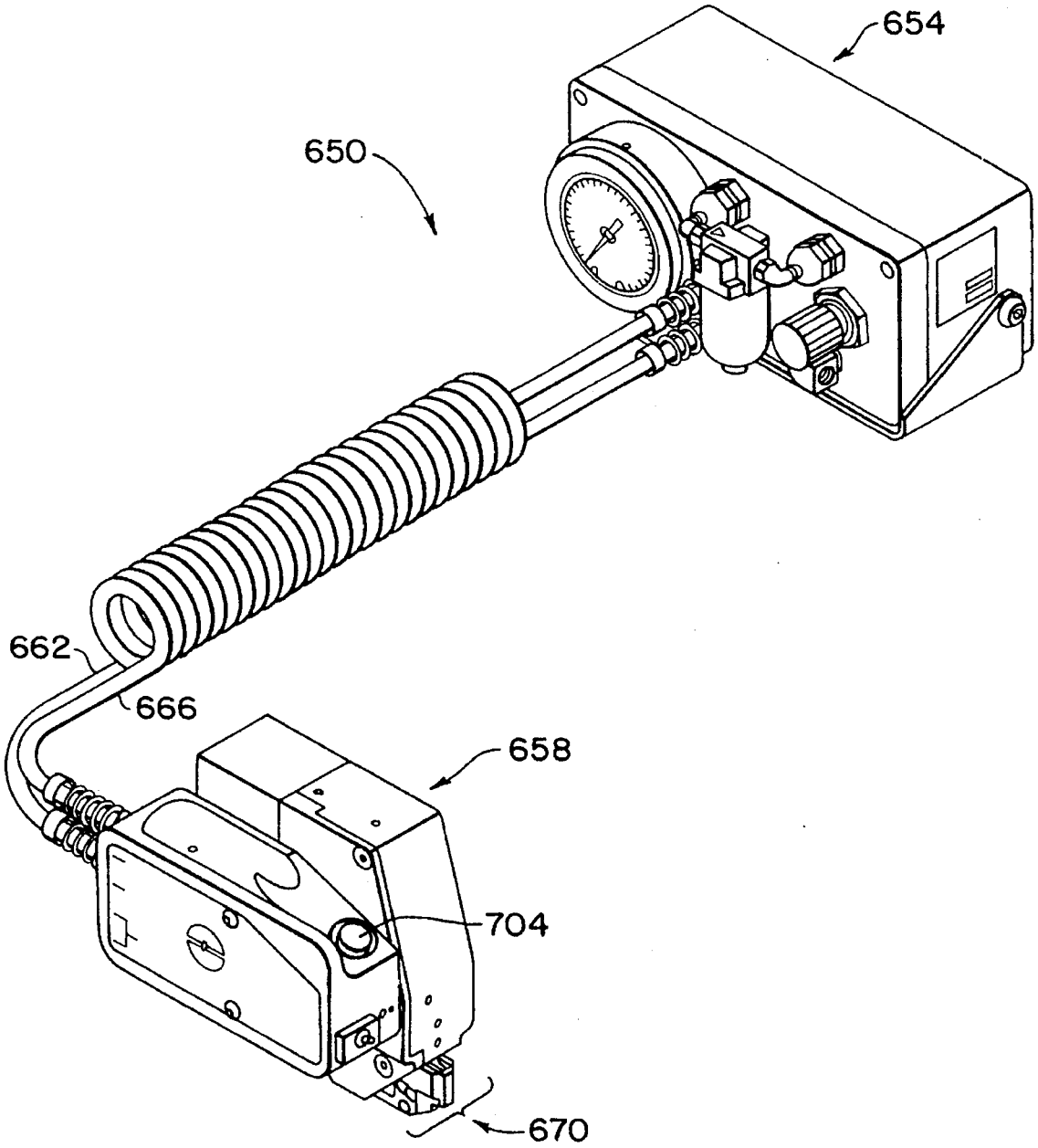
FIG. 23 illustrates a further alternative embodiment of the present invention in which the banding tool is a pneumatic device.

In FIG. 23, the banding tool 650 is shown. The tool includes an air pressure controller 654, a hand held lock forming unit 658 and two pneumatic hoses 662, 666 for conveying pressurized air from the controller 654 to the lock forming unit 658, with hose 662 providing high substantially unregulated pressure while hose 666 provides regulated pressure.

Figure 24:
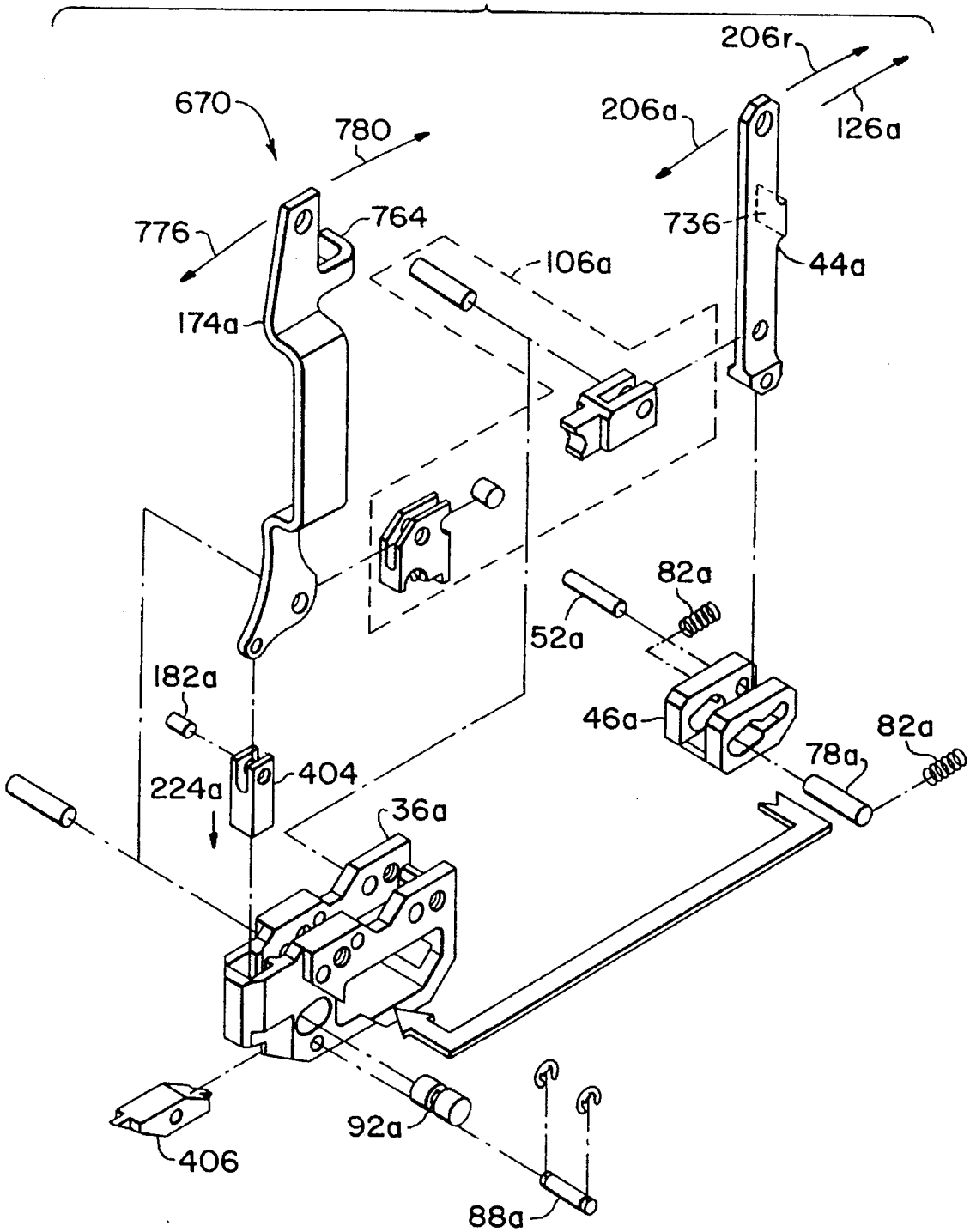
FIG. 24 is an exploded view of the band contacting assembly of the pneumatic embodiment of the banding tool.

Referring to lock forming unit 658, FIG. 23 shows a band lock head assembly 670 which includes substantially all band contacting components; e.g., the band tensioning and lock forming components. In particular, head assembly 670 provides substantially the same functionality as head 36 and those components of banding tool 10 directly connected to and/or included within head 36. More precisely, an expanded view of the components of lock head assembly 670 are presented in FIG. 24. Note that labelings having an "a" in FIG. 24 are intended to be substantially analogous to the similarly labeled component or direction in the banding tool 10 without an "a" in the labeling. In addition, direction label 206*r* is intended to denote the direction analogous to the reverse or counter-clockwise direction to 206 of FIG. 4B.

Figure 25:
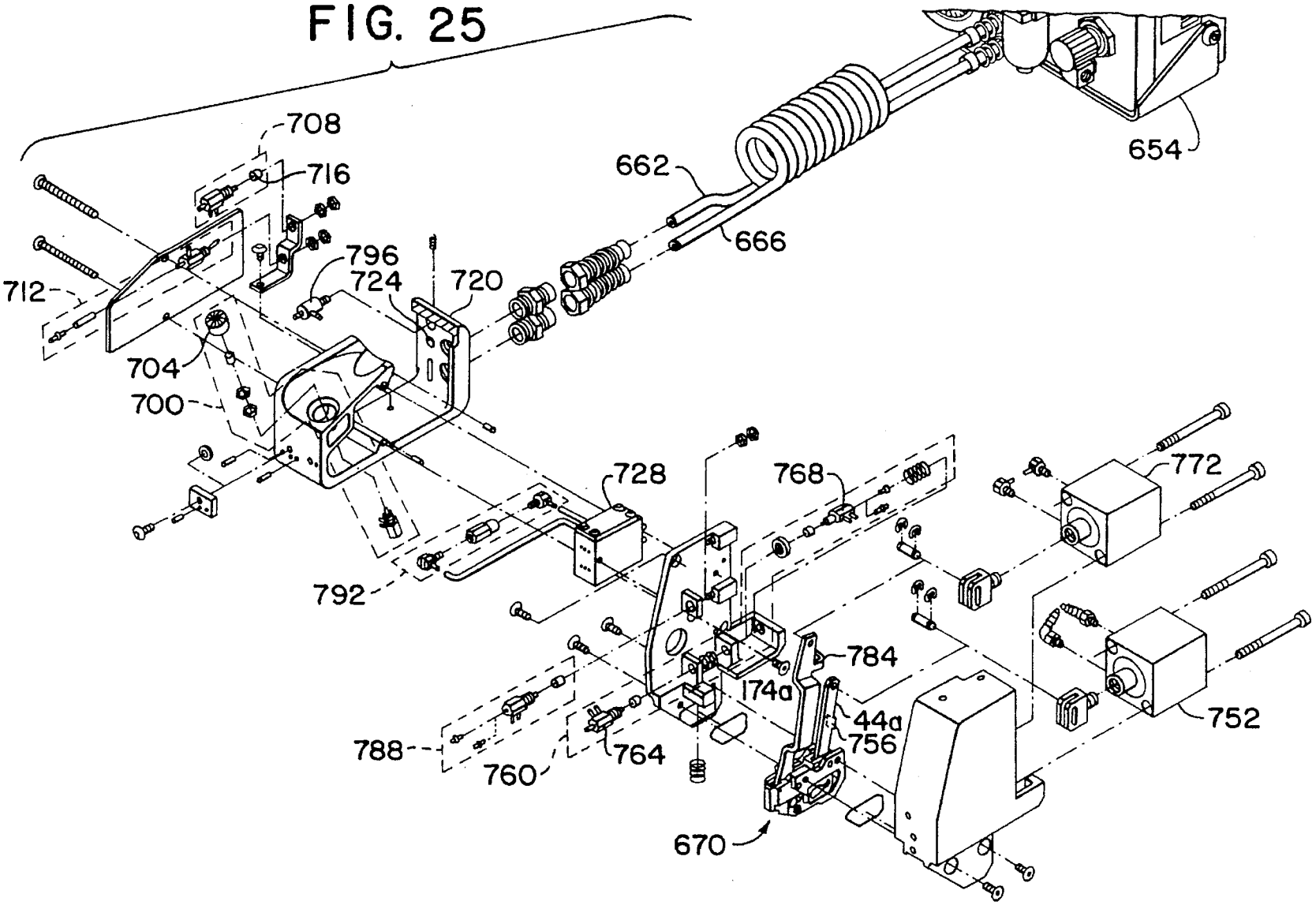
FIG. 25 is an exploded view of the components of the lock forming unit 658 of the pneumatic banding tool of the present invention.
Figure 26:
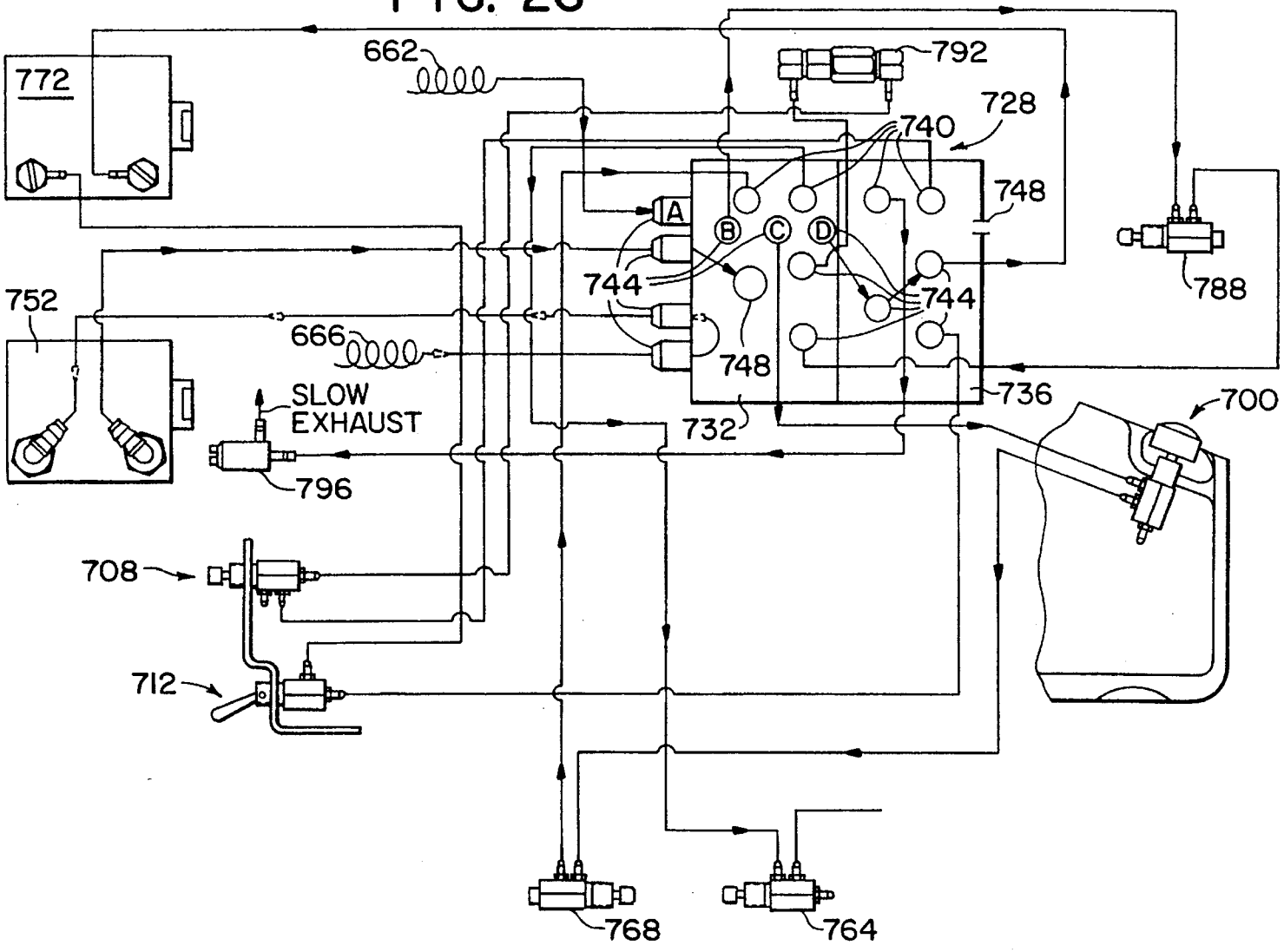
FIG. 26 illustrates schematically air flows between components of the lock forming unit 658 during the tensioning of a band clamp prior to lock formation.
Figure 27:
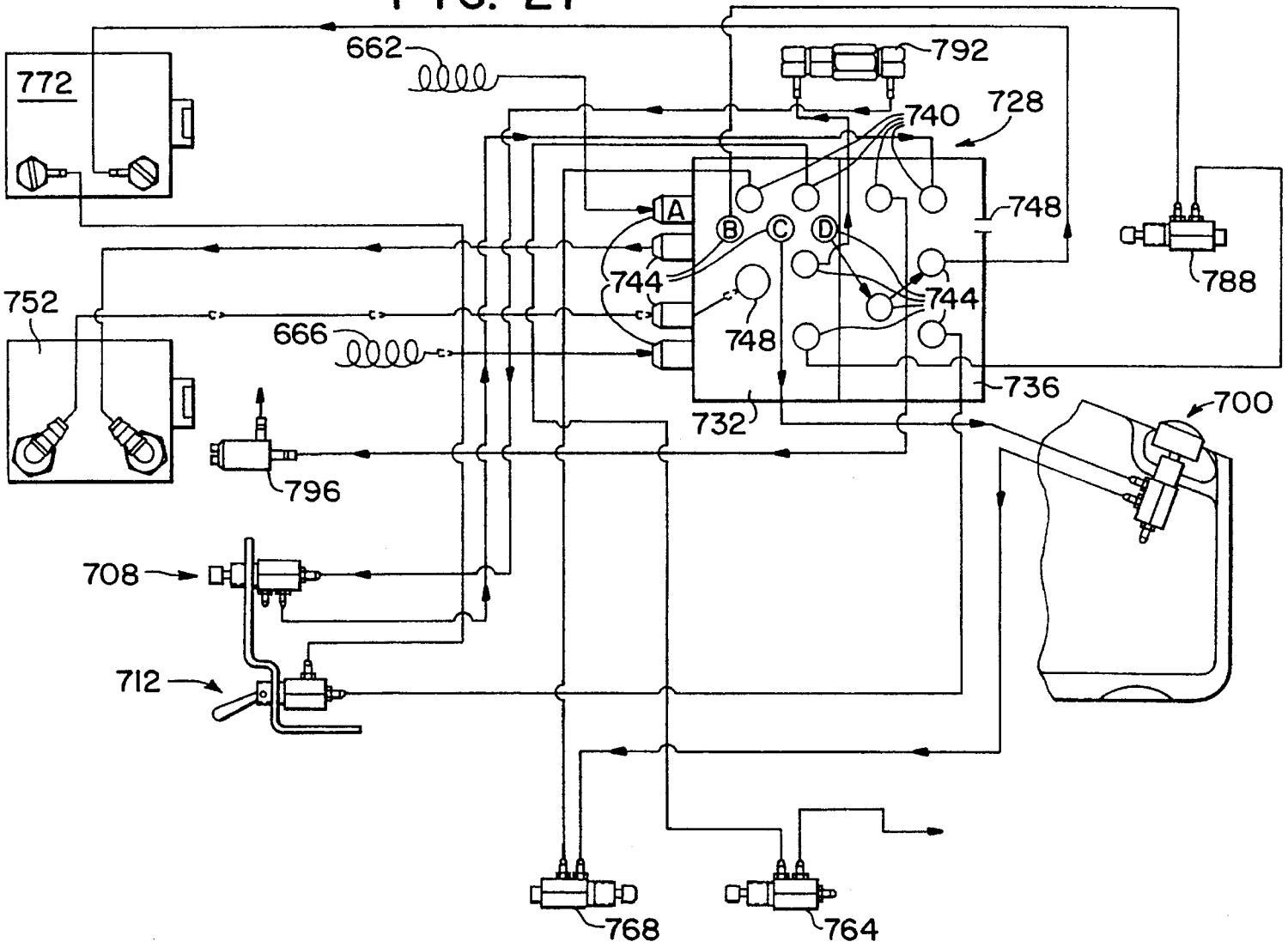
FIG. 27 illustrates the pneumatic interactions between components of the lock forming unit 658, which alternates iteratively with the configuration of FIG. 26, and is used in maintaining tension on a band 304.
Figure 28:
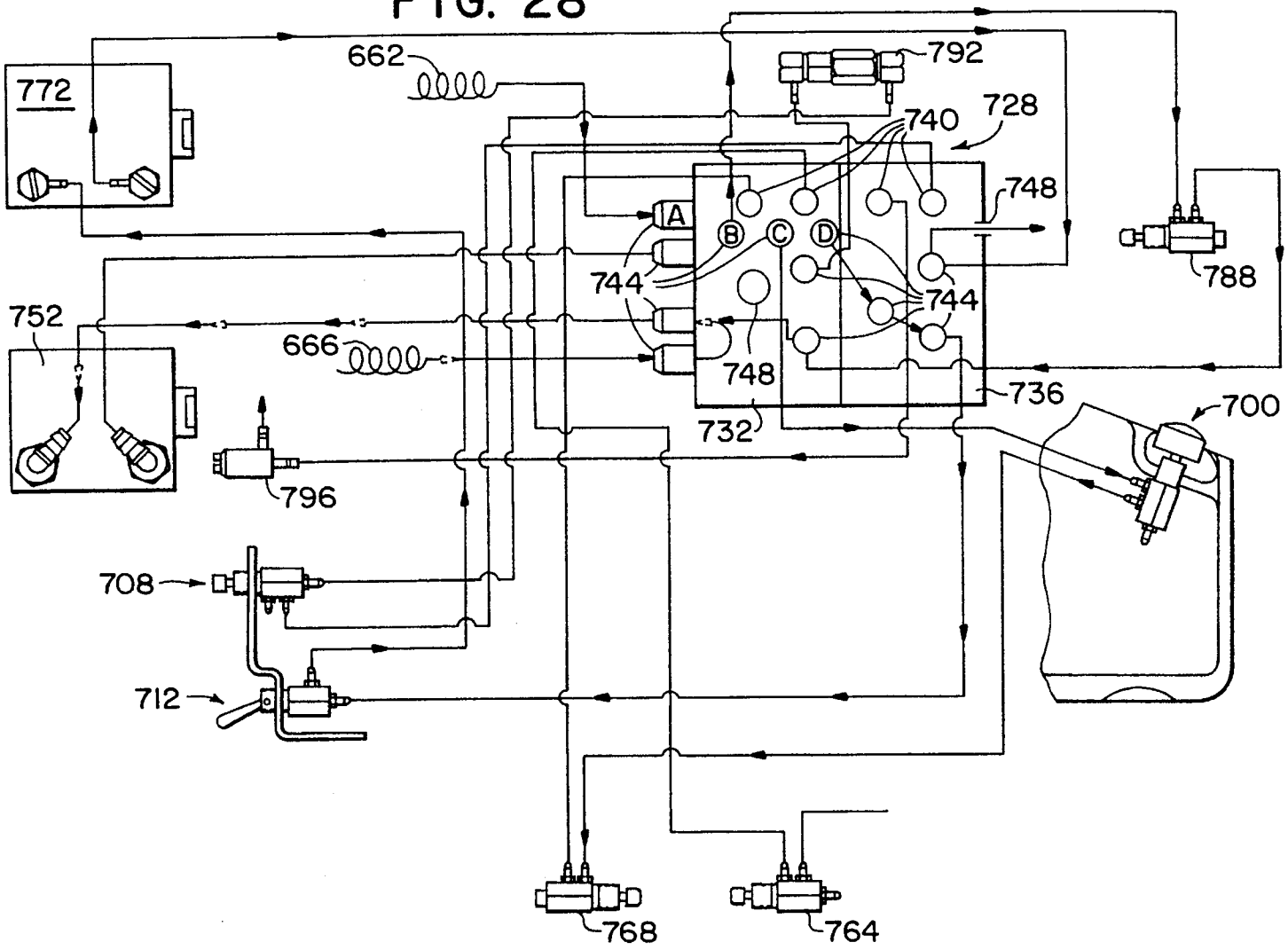
FIG. 28 illustrates the pneumatic interactions between the components of the lock forming unit 658 during lock formation.

FIG. 25 shows an expanded view of the components of the lock forming unit 658 while FIGS. 26–28 show the pneumatic connections and flows between various components of lock forming unit 658. That is, FIG. 26 shows the airflows between the lock forming unit 658 components during the tensioning of a band 304 when lever 44*a* moves in direction 206*a*. FIG. 27 shows the airflows between the lock forming unit 658 components as the lever 44 moves in the direction 206*r*. And, FIG. 27 shows the airflows during lock formation.

Given the description of the lock forming unit 658 components below, it is left to those skilled in the art to fully appreciate the pneumatic interactions between the components. However, it is worth mentioning that the dashed arrows used in FIGS. 26–28 indicate a direction for the flow of regulated pressure initially obtained from hose 666 and the solid arrows indicate a direction for the flow of high substantially unregulated pressure initially obtained from hose 662.

In FIG. 25, the components of the lock forming unit 658 relating to the pneumatic control of the lock head assembly 670 will now be discussed. Tension activating assembly 700 is used for activating the tensioning of a band 304 (band not shown in FIG. 25). That is, whenever the tension activating assembly button 704 (also shown in FIG. 23) remains depressed, the tension activating assembly 700 causes regulated air pressure from line 666 to be used in tensioning a band clamp inserted into the lock head assembly 670 as in FIGS. 22A–22D. Further, whenever the button is not depressed, a gap analogous to gap G (FIG. 3B) is formed in the lock head assembly 670 for easy insertion of a band.

Other operator controls included in the lock forming unit 658 are a retaining member formation switch 708 and a tear off tension disable switch assembly 712. The retaining member formation assembly 708 is used for activating the appropriate pneumatic components such that a retaining member is formed on a band 304, in particular, without a predetermined band tension and without subsequent tear off tension. Note that the button 716 extends through the control housing 720 at hole 724. The tear off tension disable switch assembly is used to allow an operator to experiment with various band tensions about an object prior to committing to forming a lock.

Each of the above-mentioned operator controls are pneumatically connected to a pneumatic internal control 728 as the pneumatics schematics of FIGS. 26–28 indicate. The internal controller 728 includes two conventional pneumatically controlled cylinder-piston combinations 732, 736 (FIGS. 26–28) for routing pressurized air between the operator controls and the various internal pneumatic switches and pneumatic cylinders. In particular, there are three types of air ports for attachment to the internal controller 728. Air ports 740 control the routing of air flow through substantially all other air ports. Air ports 744 communicate air between the operator controls and the various internal pneumatic devices. Note that ports 744*a*, 744*b*, 744*c* and 744*d* are in continual pneumatic communication with one another. Finally, air ports 748 are exhaust ports for exhausting air into the environment.

Connected to the internal controller 728 is a two-way activated pneumatic cylinder 752, hereinafter denoted the tensioning cylinder, which supplies the forces to move the lever 44*a* in the directions (and corresponding magnitude) of the arrows 206*a*, 206*r* and 126*a*. Thus, when the tensioning cylinder 752 toggles the lever 44*a* according to direction arrows 206*a* and 206*r*, the tension block 46*a* increases the tension on a band 304 in the same manner as the tension transfer block 46 of the banding tool 10. In this context, to reverse movement of lever 44*a* between directions 206*a* and 206*r*, a tab portion 756 (also see FIG. 24) contacts a dual switch valve controller, hereinafter denoted the tension switch assembly 760, having pneumatic switches 764 and 768. That is, the tab portion 756 contacts switches 764 and 768 alternately during tensioning of a band 304. As can be seen in FIG. 26, both switches 764 and 768 are pneumatically connected to the internal controller 728 which, in turn, routes air pressure from the switches to the tensioning cylinder 752 to induce toggling of the lever 44*a*.

The internal controller 728 is also pneumatically connected to a second two-way activated pneumatic cylinder 772, hereinafter denoted the knife activation cylinder, which is substantially identical to the tensioning cylinder 752. Upon impetus of receiving pressurized air from the internal controller 728, the knife activation cylinder 772 supplies the forces to move the lever 174*a* in the directions 776 and 780 (FIG. 24). Thus, when the lever 174*a* is induced to move in the direction 776, the knife 404 moves to engage the blade 406 (i.e., moves in direction 224*a*) and when the lever 174*a* is induced to move in the direction 780, the knife 404 moves in substantially the opposite direction thereby disengaging from the blade 406. Further note, when the lever 174*a* moves sufficiently forward such that the knife 404 fully engages the blade 406, tab portion 784 contacts pneumatic knife disengage switch 788 which induces the lever 174*a* to move in direction 780. That is, activation of the knife disengage switch 788 induces pressurized air to flow through the switch 788 and between two air ports 744 of the internal controller 728 such that pressurized air is in turn communicated to the knife engaging cylinder 772 to induce movement of the lever 174*a* in direction 780. Moreover, in this context, activation of knife disengage switch 788 also induces, via internal controller 728, activation of the tensioning cylinder 732 with unregulated air pressure to pull the lever 44*a* in the direction 206*a* such that the tension being communicated via tension transfer block 46*a* to a band 304 is increased sufficiently (in direction 128, FIG. 21C) to tear away the excess band from the lock.

The timing for commencing engagement between the knife 404 and the blade 406 is governed by check valve assembly 792 and needle valve 796. That is, once the predetermined tension has been obtained for forming a lock, or the retaining member formation switch 708 has been activated, there is an operator controllable time delay prior to the activation of the knife 404 to engage the blade 406. To accomplish this, the check valve assembly 792 communicates one way air pressure from the cylinder-piston combination 732 to a piston control portion of cylinder-piston combination 736 periodically. However, when the pressure in this piston control portion decreases to a predetermined level by escaping through needle valve 796, air flow commences to the knife engaging cylinder 772 resulting in the engagement of the knife 404 and blade 406.

Figure 29:
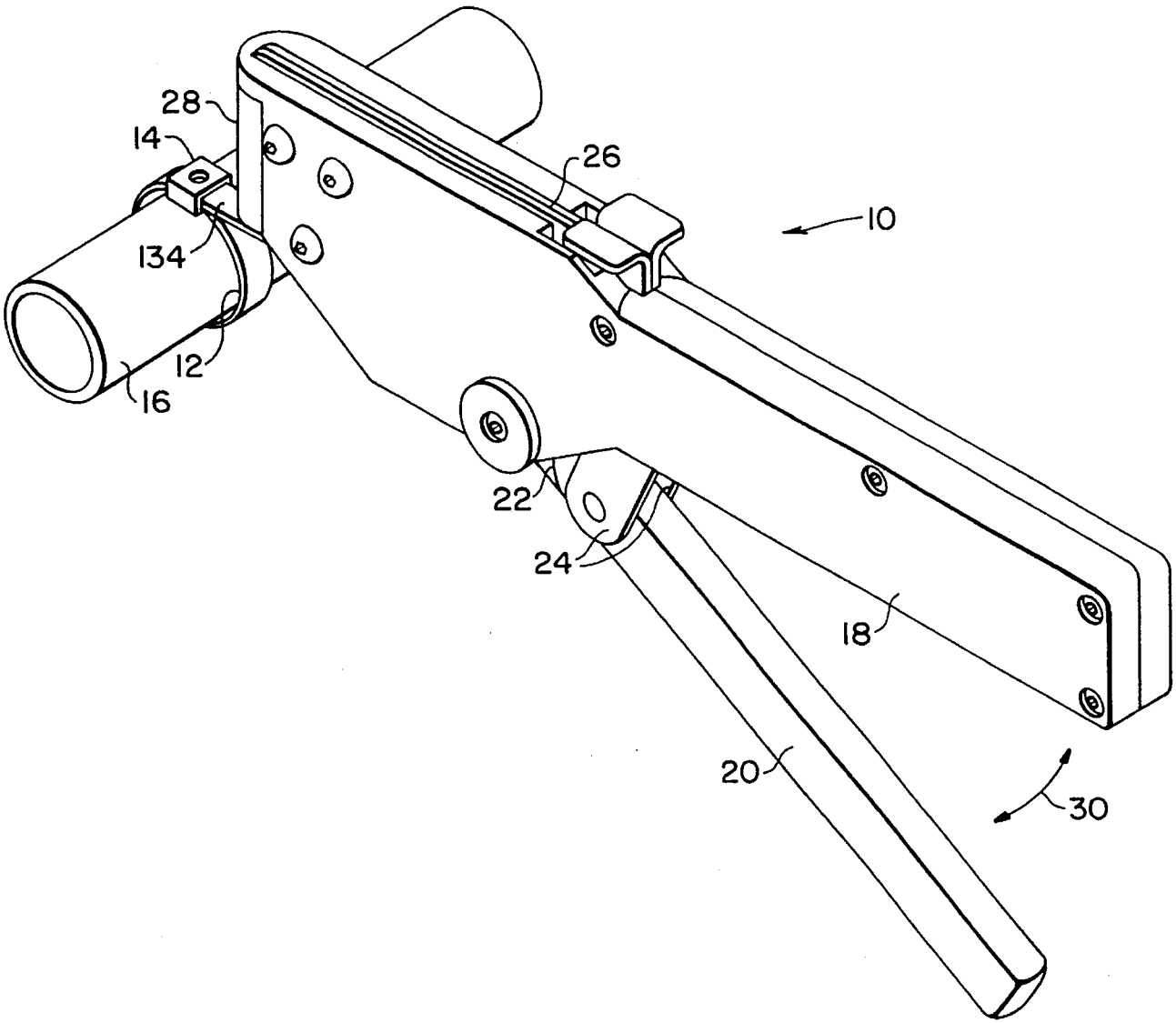
FIG. 29 is an oblique view of an alternative embodiment of a banding tool 10 to which the present invention pertains.
Figure 30:
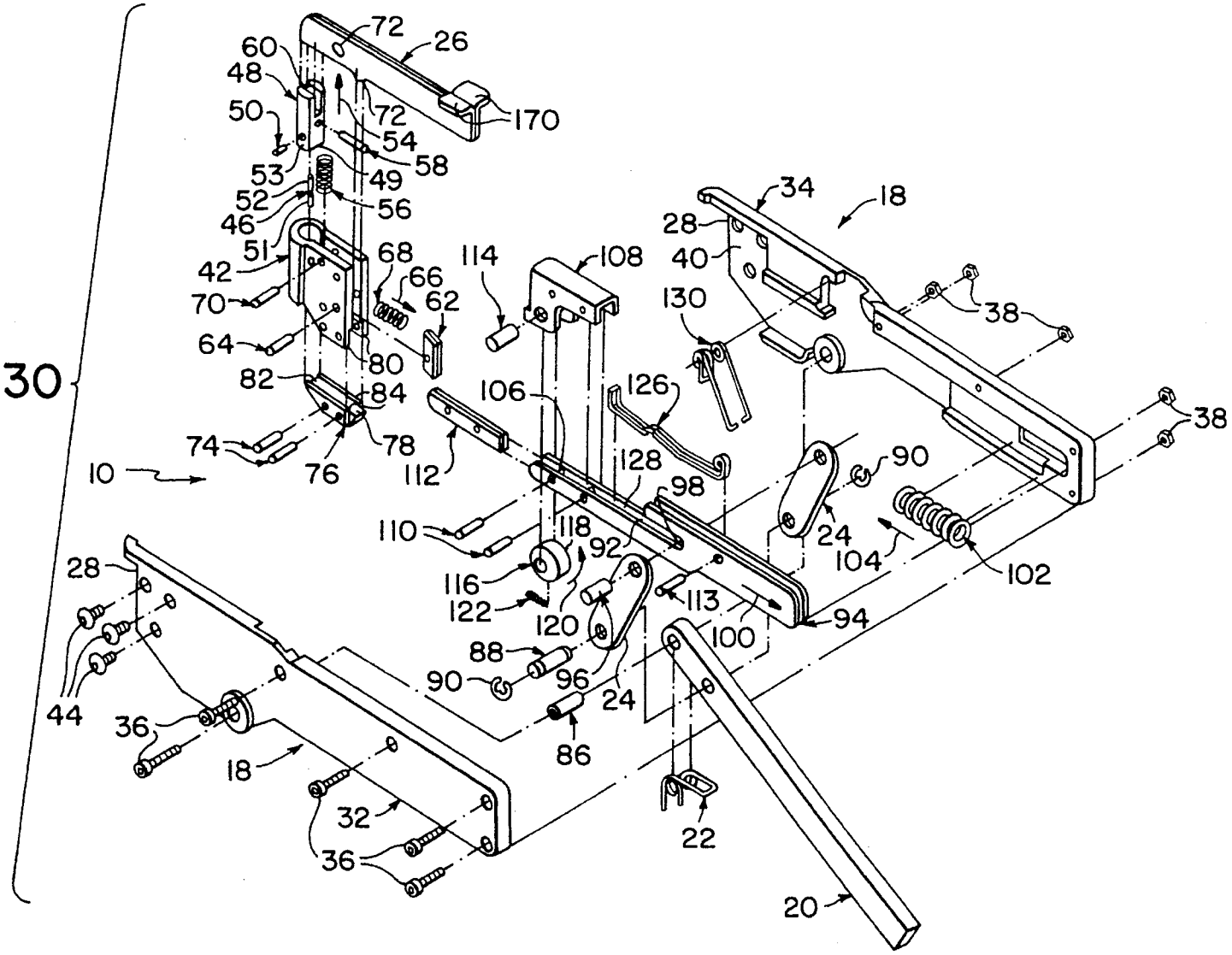
FIG. 30 is an exploded view of the banding tool 10 of FIG. 29.

FIGS. 29 and 30 present an external and exploded view, respectively, of another embodiment of a banding tool 10 wherein the blade 540 and knife 544 configuration of FIGS. 19A–19G can be used. In particular, the blade 76 and the knife 48 of FIG. 30 can be modified to provide the blade and knife configuration of FIGS. 19A–19G. That is, the band/buckle contacting surface 552 (FIG. 19A) can be provided on the lower surface 53 of FIG. 30 and the blade 540 configuration having blade projection ends 568*a* and 568*b* can be provided on the blade tip 82 of FIG. 30. Note that a full description of the banding tool 10 disclosed in FIGS. 29 and 30 is provided in U.S. Pat. No. 5,123,456 to Jansen issued Jun. 23, 1992 which is hereby incorporated by reference.

Figure 31:
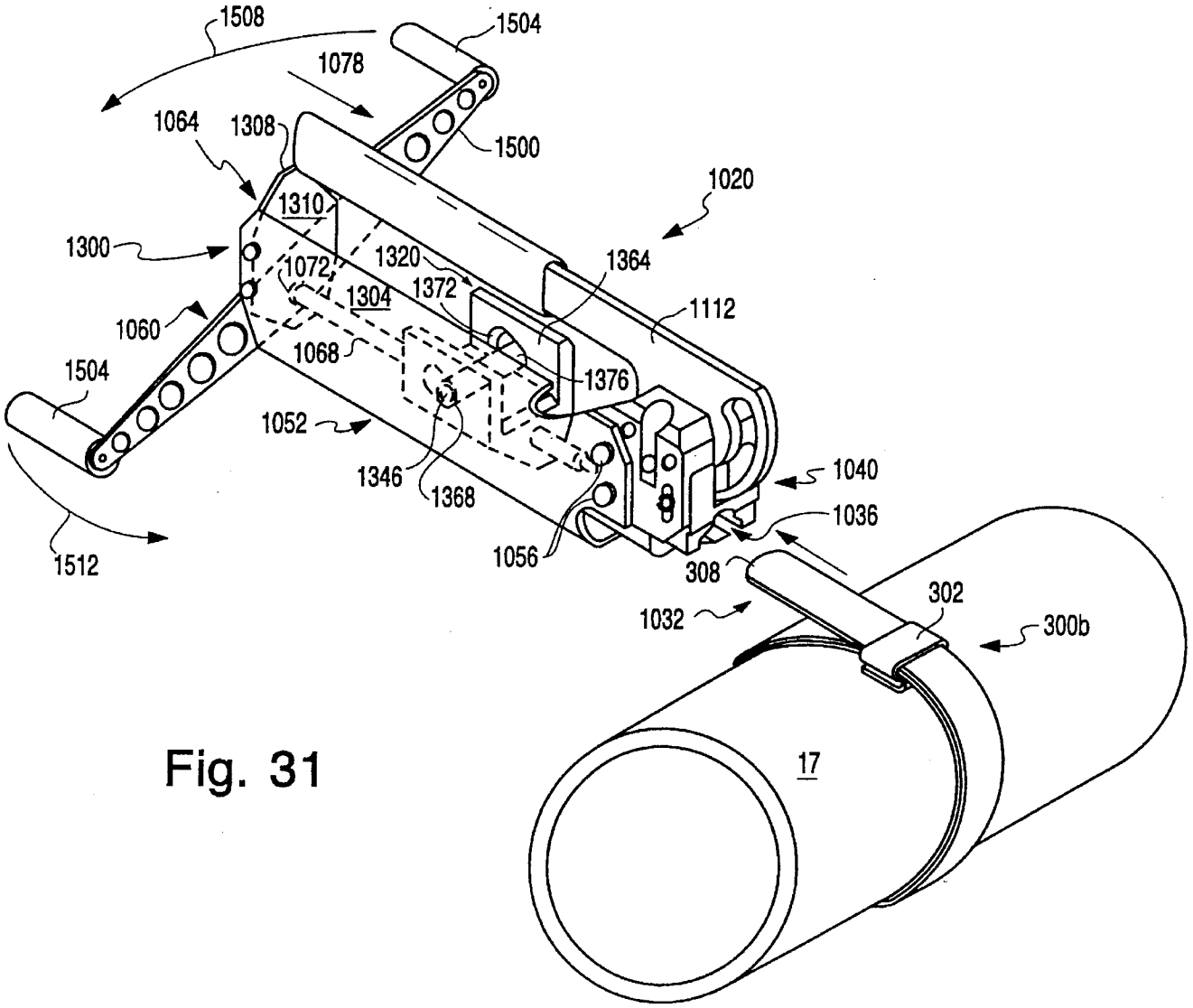
FIG. 31 is an oblique view of the banding tool 1020 of the present invention together with a band clamp having an excess length to be inserted into the banding tool.
Figure 38:
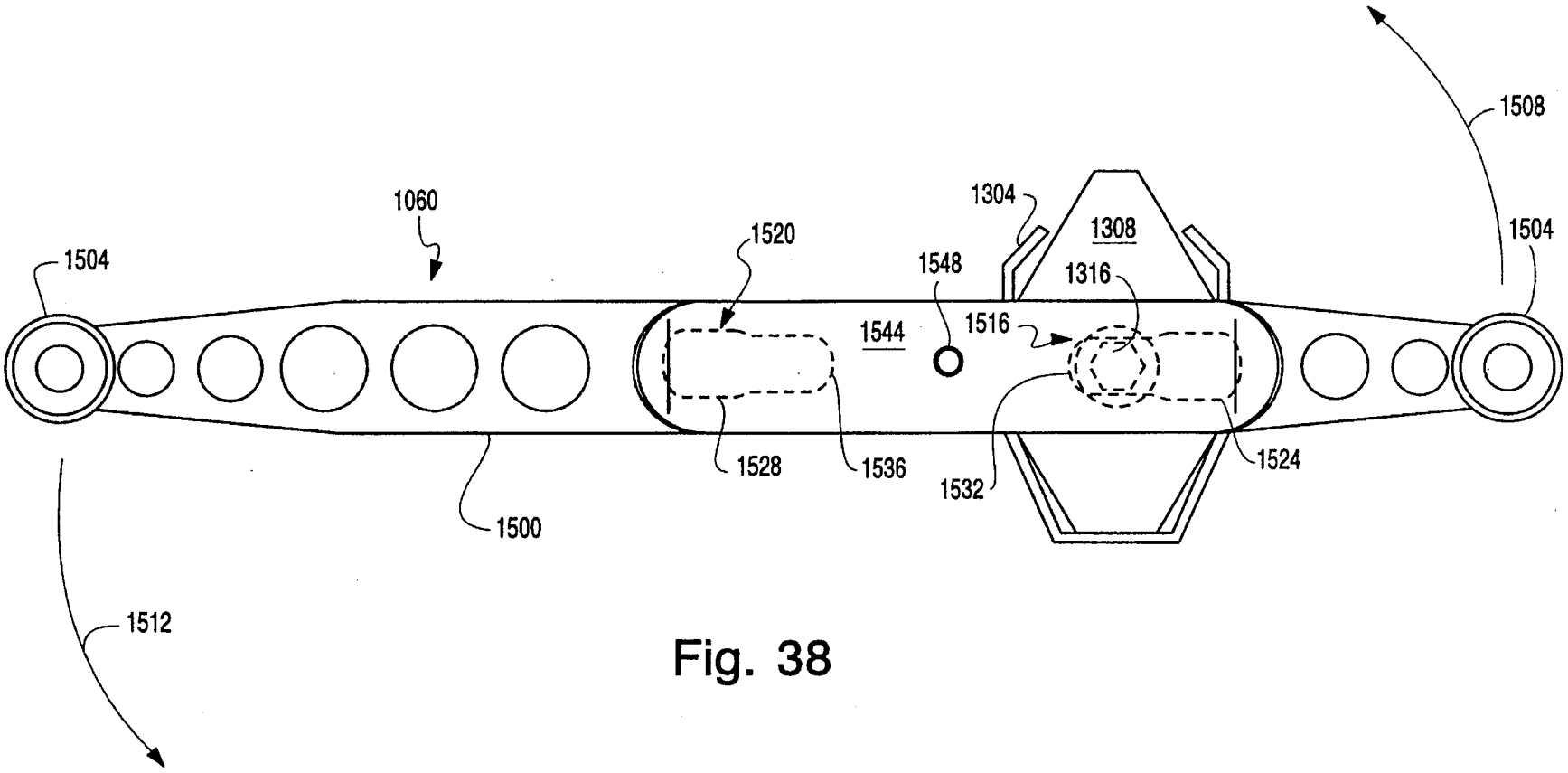
FIG. 38 is a rear view of the banding tool 1020 having the manual crank 1060 attached thereto in an offset manner.

Referring now to FIG. 31, a further embodiment of the banding tool of the present invention, herein labeled 1020, is illustrated along with a band clamp 300*b*. The band clamp 300*b* is doubly wrapped about an object 17 in preparation for insertion of the band second end 308 and of an excess band portion 1032 into a band insertion slot 1036. The banding tool 1020 includes three major assemblies which provide substantially all the functionality of the present banding tool embodiment. These assemblies are:

(4.1) A band lock forming assembly 1040 for receiving the band of the band clamp 300*b* into the banding tool 1020 and for providing a securing lock 1044 (FIG. 2) adjacent to the band clamp buckle 302;

(4.2) A band tensioning assembly 1052 for gripping and applying tension to the excess band portion 1032 of the band once the excess band portion 1032 has been inserted into the banding tool 1020. Note that the tensioning assembly 1052 is secured to the lock forming assembly 1040 by four hex head bolts 1056, two of which are shown in FIG. 1. The other two such bolts are in corresponding positions on the hidden side of the banding tool 1020 as shown in FIG. 31. Thus, it is a simple matter for an operator to detach the lock forming assembly 1040 from the tensioning assembly 1052 for modification or repair of either of these two assemblies;

(4.3) A tension activation assembly (or crank) 1060 is presently illustrated as attached to the distal end 1064 of the tensioning assembly 1052. More precisely, the tension activation assembly 1060 is attached to the distal end 1072 of a threaded tensioning rod 1068 included in the tensioning assembly 1052. Note that the tension activation assembly 1060 can be easily attached or detached from the distal end 1072 without the use of any tools, as will be discussed further below. Also note that FIG. 38 provides an alternative view of the tension activation assembly 1060 along line of sight 1078 (FIG. 31) wherein the tension activation assembly is attached at a different position from that illustrated in FIG. 31.

The components of each of these three assemblies will be, in turn, discussed below.

Figure 36:
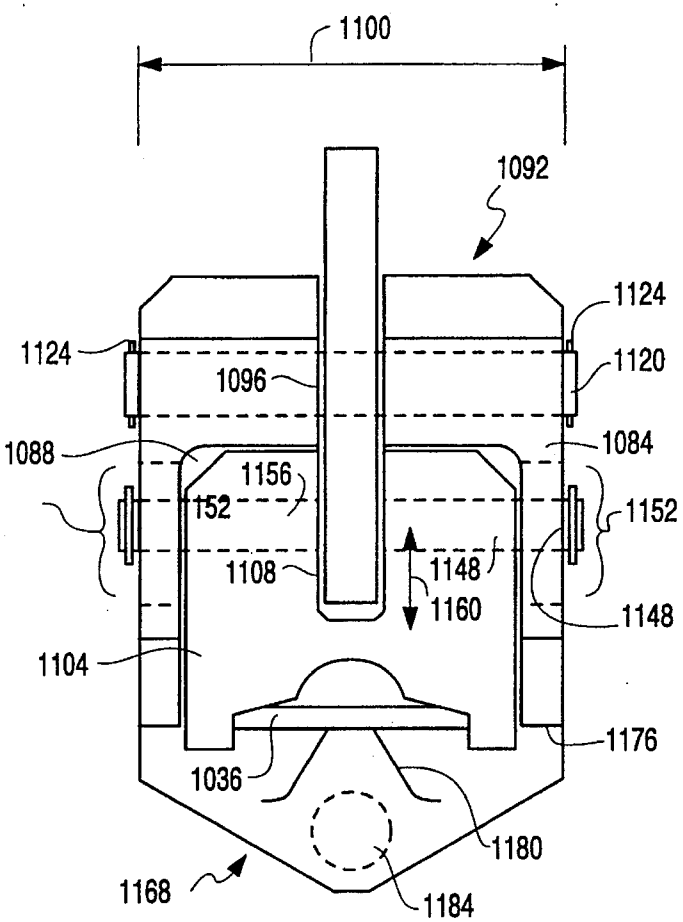
FIG. 36 is a front view of the lock forming assembly 1040 which corresponds with the side view of FIG. 35.
Figure 35:
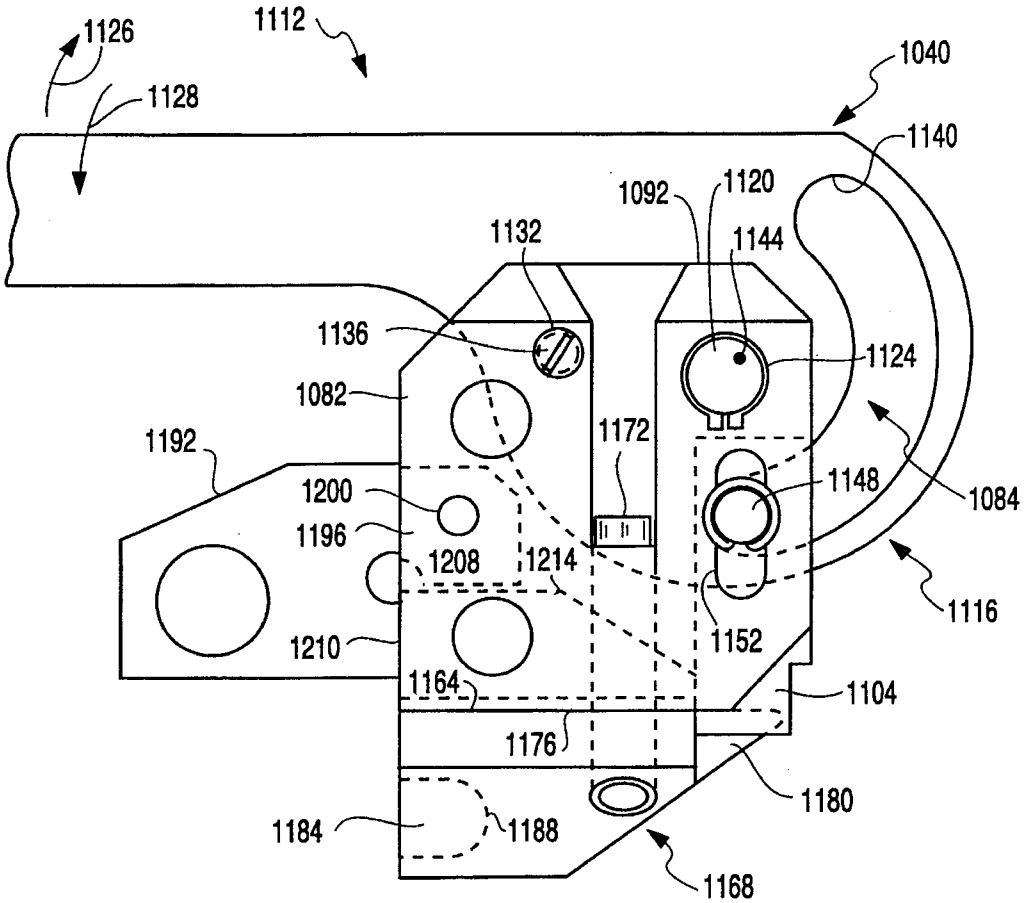
FIG. 35 provides a detailed side view of the lock forming assembly 1040 wherein a free or second end of an excess band portion may be inserted into the banding tool 1020 for tightening of a band clamp and subsequent formation of a band clamp lock.

Commencing with the lock forming assembly 1040, reference is made to FIGS. 31, 35, 36 and 39. Referring especially to FIGS. 35 and 36, the lock forming assembly 1040 includes an attachment block 1082 to which substantially all other components of the lock forming assembly 1040 are attached and to which the tensioning assembly 1052 is also attached. The front portion 1084 of the attachment block has a downwardly opening rectangular recess 1088 (FIG. 36). The front portion 1084 and the top portion 1092 of the attachment block 1082 has a central recess 1096 which: (a) perpendicularly bisects the width 1100 of the attachment block and (b) is also perpendicular to the rectangular recess 1088 through which it substantially cuts. Note that a band cutting knife 1104 is slidably received within the rectangular recess 1088. The knife 1104 is used for severing an excess portion of band from the band clamp 300*b* when the excess band portion 1032 is inserted into band insertion slot 1036. Further, note that the knife 1104 also substantially conforms to the shape of the rectangular recess 1088 on the front portion 1084. Moreover, the knife 1104 has a upwardly opening vertical slot 1108 which substantially conforms (although not exactly) to the contour of the central recess 1096 on the front portion 1084.

Figure 33:
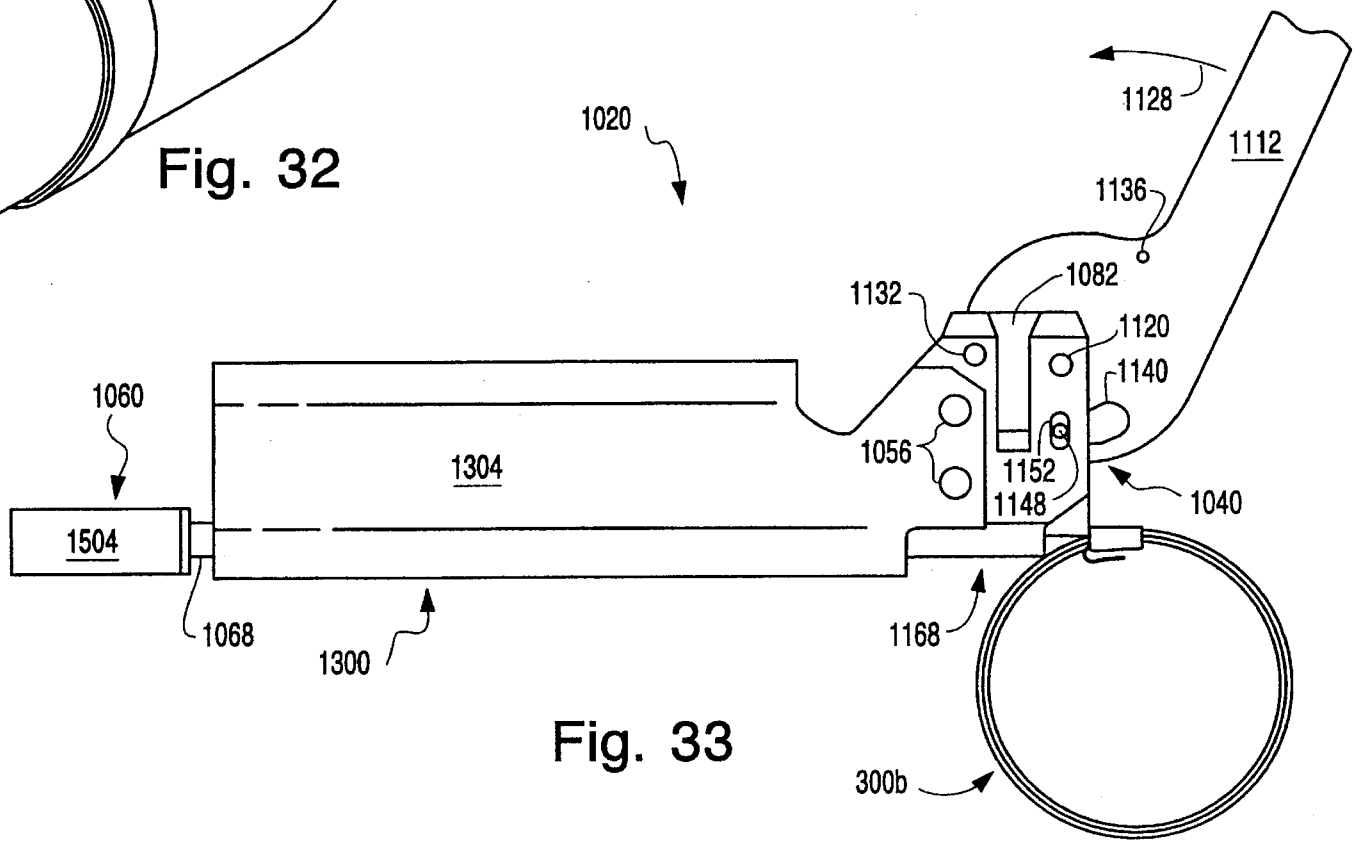
FIG. 33 is a side view of the banding tool 1020 as used to provide a securing lock on a band clamp.
Figure 32:
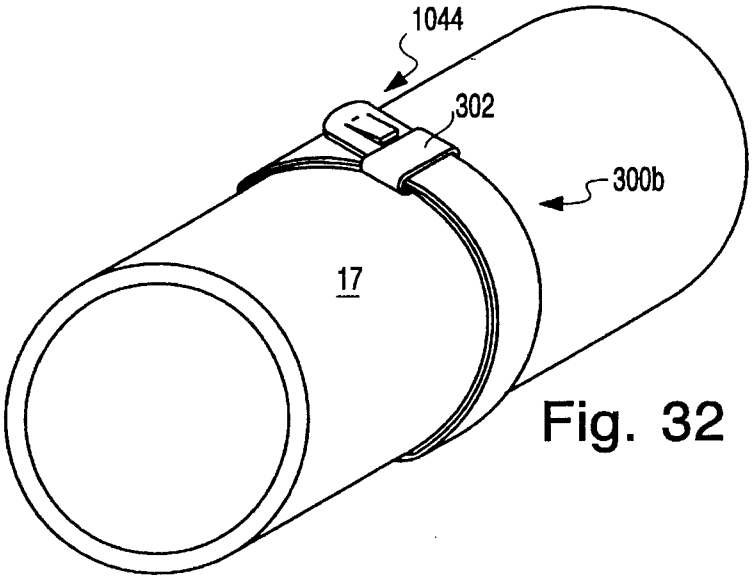
FIG. 32 presents the results of using the banding tool 1020 to provide a tightened and lock secured band clamp about an object.

A severing handle 1112 has a front curved portion 1116 which substantially conforms and is disposed within the central recess 1096 such that the severing handle 1112 is able to pivot about pivot pin 1120 which is secured in a width 1100 traversing bore of the attachment block 1082 by securing clamps 1124. Thus, the severing handle 1112 rotates about the pivot pin 1120 having a rotation along the arcuate directional arrow 1126 from the severing handle position in FIG. 35 to the severing handle position shown in FIG. 33 and a reverse rotation along the arcuate directional arrow 1128 (FIG. 33). Note that the severing handle 1112 can be held or secured in the position shown in FIG. 35 by the use of two opposed spring loaded screws 1132 threaded into in-line opposed threaded bores of the attachment block 1082 such that each screw 1132 has an internal element (not shown) urged against a side of the severing handle, one such threaded bore and screw 1132 being on each side of the severing handle 1112. Thus, by providing indentations 1136 (FIG. 33) on each side of the severing handle 1112, such indentations can mate with the interior element of the screws 1132 so that the severing handle can be secured in the position of FIG. 35. In addition, the front curved portion 1116 of the severing handle includes a circular cam slot 1140 having a center for this arc of circular cam slot at center point 1144 which is, importantly, offset from the center of the pivot pin 120. During movement of the severing handle 1112, the circular cam slot 1140 provides reciprocal, vertical movement of a knife securing pin 1148 within a pair of elongated slots collectively labeled by the numeral 1152 (FIG. 36) wherein the elongated slots pierce each side of the attachment block 1082 and communicate with the rectangular recess 1088. Thus, since the knife securing pin 1148 also extends through a knife bore 1156 (best shown in FIG. 39), the linear reciprocating movement of the knife securing pin 1148 within the elongated slot 1152 results in similar movement of the knife 1104 in the directions of the bidirectional arrow 1160 (FIG. 36). Thus, as the severing handle 1112 is moved in the direction of the directional arrow 1126 (FIG. 35), the knife 1104 is urged in the downward direction of the bidirectional arrow 1160 due to the offset of the center point 1144 from the center of the pivot pin 1120. Conversely, when the severing handle 1112 is moved in the direction of the directional arrow 1128 (from, for example, the position in FIG. 33), the knife 1104 is urged in the upward direction of the bidirectional arrow 1160.

Figure 34:
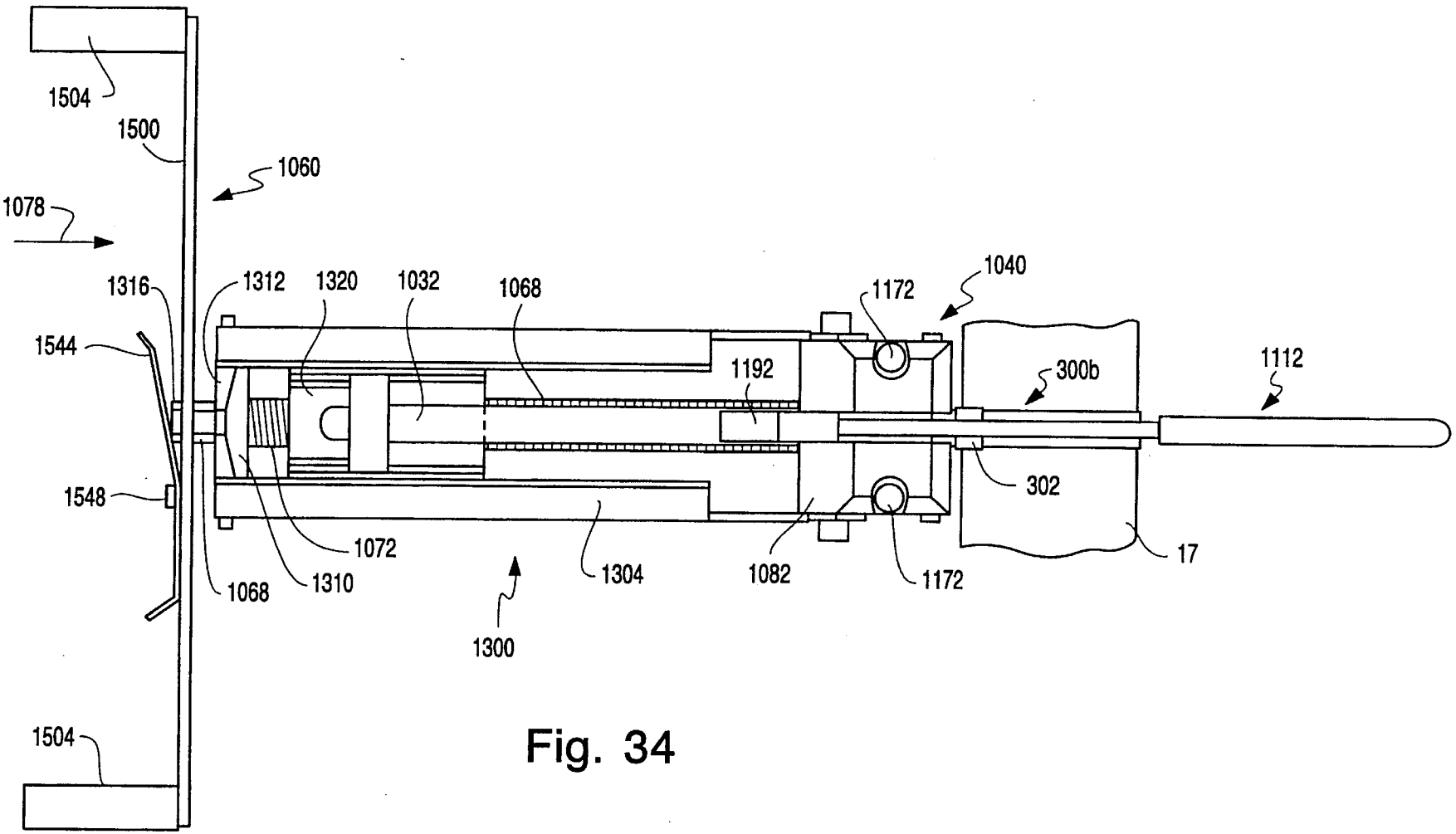
FIG. 34 is a top view of the banding tool 1020 corresponding to the side view of FIG. 33.

Attached to the bottom portion 1164 of the attachment block 1082 (FIG. 35) is a blade platform 1168, the blade platform being attached to the attachment block 1082 by a pair of threaded hex head bolts 1172 (FIGS. 34, 35). Still referring primarily to FIGS. 35 and 36, the upper face 1176 of the blade platform 1168 defines the lower portion of the band insertion slot 1036. Further, a band lock forming blade 1180 is provided on the diagonally shaped end of the blade platform 1168. The blade 1180 is used in conjunction with the knife 1104 to form a band clamp lock 1044 of FIG. 2. The description of how lock 1044 may be formed by deforming a portion of the band clamp band when the knife 1104 is urged downwardly toward the blade 1180 with the band therebetween has been previously described with reference to, for example, FIGS. 8–12. At an opposite end from the blade 1180, the blade platform 1168 includes a circular cavity 1184 having a concave closed end 1188. The use of the circular cavity 1184 will be discussed below in conjunction with the tensioning assembly 1052.

It is noteworthy that the knife 1104 and/or blade platform 1168 can be easily replaced by an operator performing some or all of the following steps:

(5.1) detaching one of the securing clamps 1124, sliding the pin 1200 from the knife bore 1156 and thereby detaching the knife 1104 from the banding tool 1020;

(5.2) unscrewing the hex head bolts 1172 from their engagement with the blade platform 1168, thereby detaching the blade platform from the banding tool 1020; and/or (5.3) replacing either (both) the knife 1104 or (and) the blade platform 1168 components and reversing the above step(s) (5.1) and/or (5.2) to reattach the desired replacement components.

Figure 41:
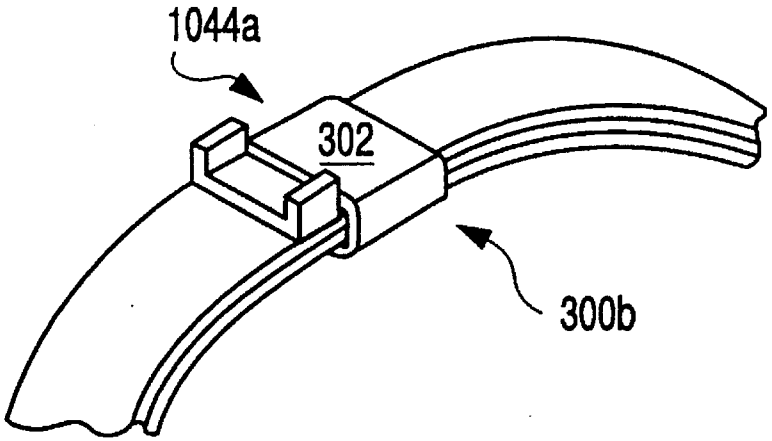
FIG. 41 illustrates the band clamp lock which may be formed by the components illustrated in FIG. 40.
Figure 40:
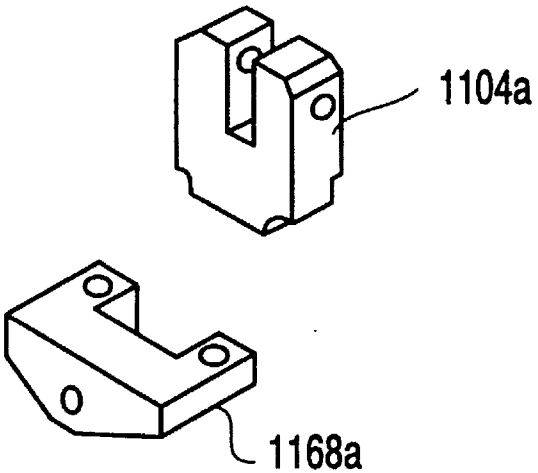
FIG. 40 presents an alternative knife and blade platform combination for forming a different band clamp lock.

Thus, it is not difficult for an operator to replace the knife 1104 and blade platform 1168 combination with a different combination such that the banding tool 1020 can provide a lock different from lock 1044 of FIG. 2. As an example, the knife **1104*a* and the blade platform 1168*a* of FIG. 40 may be used to replace knife 1104 and blade platform 1168, thereby providing the banding tool 1020 with the ability to form the band clamp lock 1044*a* of FIG. 41**.

Also attached to the attachment block 1082 is an irregularly shaped projection 1192 (FIGS. 35 and 31) which protrudes from the rear portion 1196 of the attachment block. This projection is connected to the attachment block 1082 by a pin 1200 which is slidably received through a bore 1204 piercing the width 1100 of the attachment block 1082. Thus, the projection 1192 is held in position: (a) by the pin 1200 snugly fitting through a hole in the projection which aligns with the bore 1204, and (b) by the perpendicular surfaces 1208 and 1210 of the projection 1192, these surfaces respectively abutting an attachment block internal surface 1214 (FIG. 35) and the surface of the rear portion 1196. Note that the usefulness of projection 1192 will become evident in the description of the operation of banding tool 1020 below.

Figure 39:
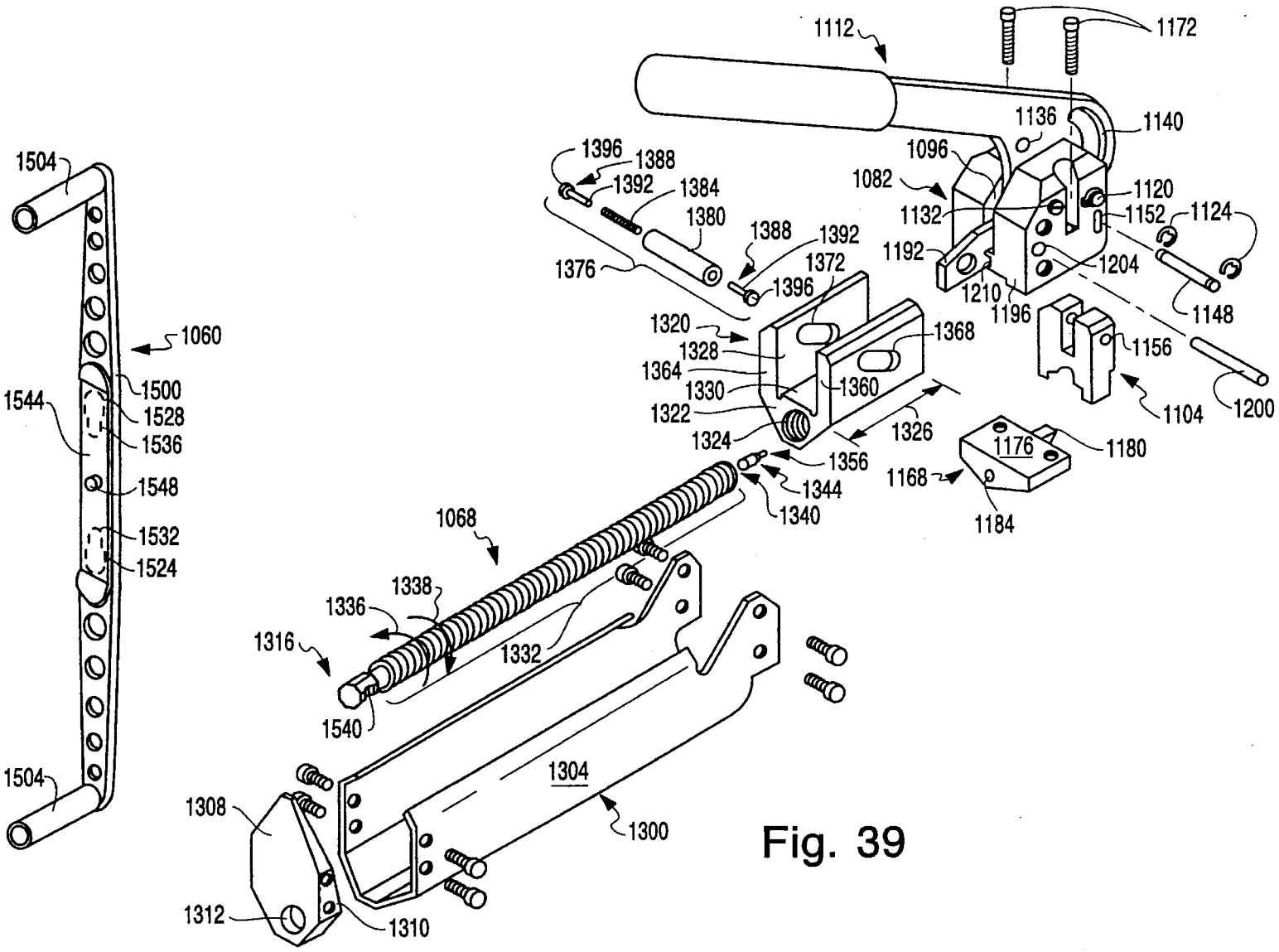
FIG. 39 is an exploded view of the components of the banding tool 1020.

In describing the components of the tensioning assembly 1052, reference is made to FIGS. 31, 34 and 39. This assembly includes a housing subassembly 1300 having a U-shaped, preferably metal, casing 1304 running substantially the length of the banding tool 1020. Additionally, the housing subassembly 1300 includes a back plate 1308 which is bolted to the casing 1304. Also, note that the back plate 1308 has an outwardly angled interior surface 1310, the angle being important to the operation of the banding tool 1020 as will be shown when describing the operation of the banding tool further below. Note that the back plate has a hole 1312 (FIG. 39) through which the rear hex head end 1316 of the tensioning rod 1068 projects. Further note that the tensioning rod 1068 is substantially interior to the casing 1304 and traverses its length. Also received within the casing 1304 is a slotted platform-like component 1320 hereinafter known as a gripping platform. As illustrated by the contour of the gripping platform end surface 1322, the gripping platform 1320 has an exterior shape which substantially matches the interior of the casing 1304 such that the gripping platform 1320 can move the interior length of the casing 1304 without encumbrance. Further, note that the gripping platform 1320 includes a threaded bore 1324 (FIG. 39) that pierces the length 1326 of the gripping platform below a right angled upwardly directed slot 1328. Referring to FIG. 39, note that the threaded portion 1332 of the tensioning rod 1068 is threaded through the threaded bore 1324 such that when the tensioning rod 1068 is rotated in the direction of the arcuate directional arrow 1336, the gripping platform 1320 is urged via the meshing of the threads of the rod 1068 and the threads of the bore 1324 to move toward the back plate 1308. Conversely, when the tensioning rod 1068 is rotated in the direction of the arcuate directional arrow 1338, the gripping platform is urged in the opposite direction.

Figure 37:
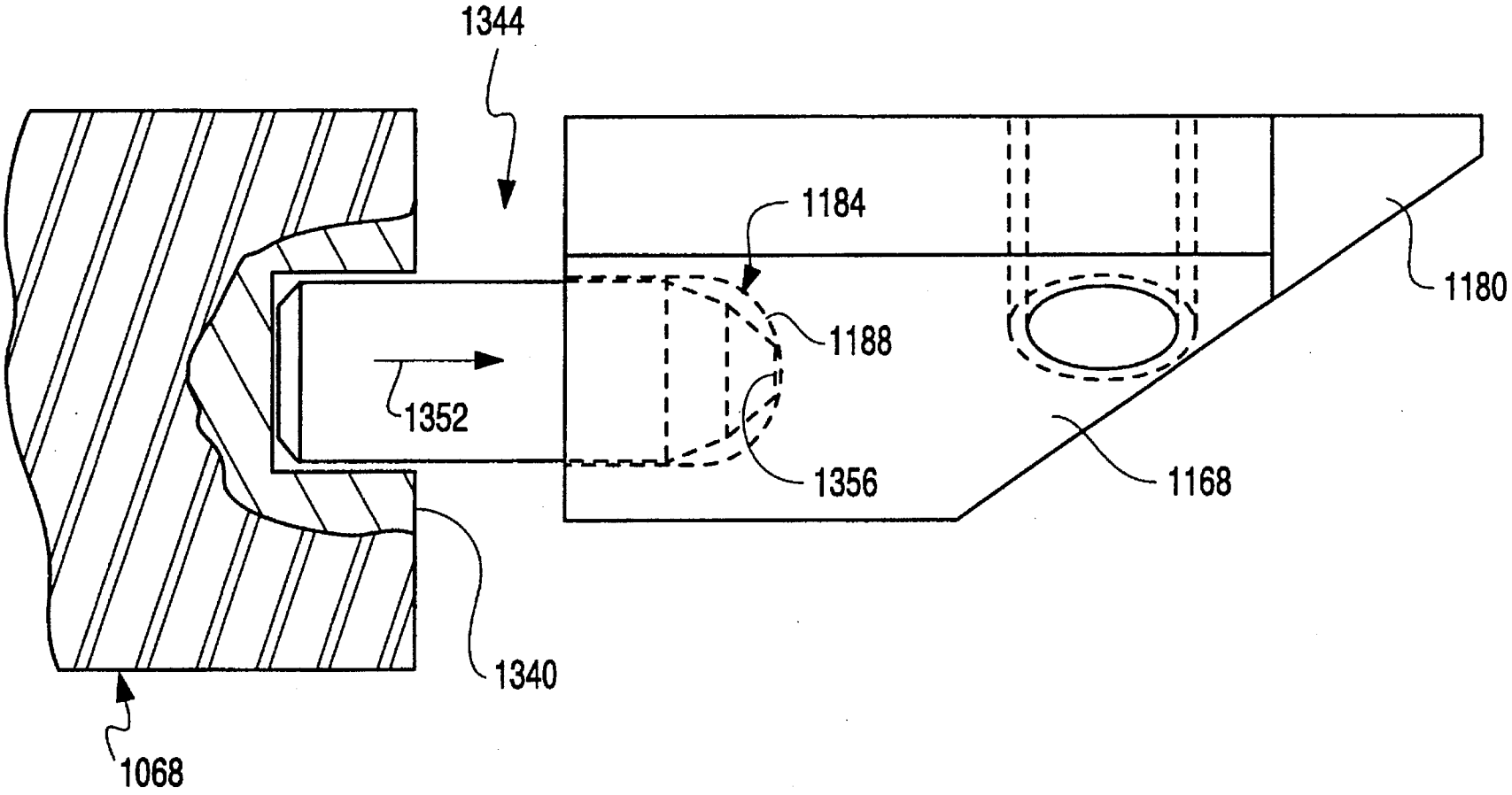
FIG. 37 is a side, partially cut-away view illustrating the use of a connecting pin 1344 for transferring band tightening tension between the tensioning rod 1068 and the blade platform 1168 (or, more generally, the lock forming assembly 40)

Referring now to FIGS. 37 and 39, the front end 1340 of the tensioning rod 1068 is caused to be operatively connected to the lock forming assembly 1040 (and more particularly connected to the blade platform 1168) by a bearingless connecting pin 1344. A cylindrical rear portion of the connecting pin 1344 is received into a cylindrical recess in the front end 1340 of the tensioning rod 1068 and, in addition, a front tapered portion 1348 of the connecting pin is received in the circular cavity 1184 of the blade platform 1168. Thus, the connecting pin 1344: (a) allows an appropriate transfer of band tension in the direction of arrow 1352 (FIG. 37) from the tensioning rod 1068 to the lock forming assembly 1040 when a band clamp **300*b* is being tensioned; (b) assures appropriate alignment of the tensioning rod 1068 with the lock forming assembly 1040 such that band tensioning stresses are transferred along the length of the banding tool 1020 without the creation of stress forces perpendicular to the length of the tensioning rod 1068 that could cause the banding tool 1020 to malfunction during the band tensioning operations requiring a high degree of tension; (c) provides a bearingless pivot area 1356 at the apex of the connecting pin 1344 for ease of cranking in rotating tension rod 1068. Note that the pivot area 1356 deforms slightly to contact a greater portion of the convex closed end 1188 during tensioning of a band; (d) enhances the maintainability of the banding tool 1020 in that the connecting pin 1344 is easily and inexpensively replaced when worn without replacing larger components such as, for example, the tensioning rod 1068**.

Returning once again to the gripping platform 1320, as best illustrated in FIGS. 31 and 39, the right angled slot 1328 has opposing parallel vertical walls 1360 and 1364. Note that within each of these walls is an angled oval cut-out 1368 and 1372, respectively. Further note that the angled oval cut-outs completely pierce the walls and that the cut-outs are identically positioned within both walls. Traversing the slot 1328 between the angled oval cut-outs and also positioned within each of the cut-outs is a gripping cylinder 1376. As best shown in FIG. 39, the gripping cylinder 1376 comprises a gripping rod 1380 having a central bore through its length, a compression spring 1384 which resides in the central bore of the gripping rod 1380, and two gripping rod end caps 1388. Note that each of the end caps 1388 includes a shaft 1392 for insertion into the opposing ends of the bore of the gripping rod with the spring 1384 therebetween. Further, each of the end caps also includes a flattened head 1396. Note that the flattened heads 1396 press against the inner vertical walls of the casing 1304 due to the compression of the spring 1384 against the shafts 1392. Therefore, since the gripping cylinder 1376 frictionally engages the inner walls of the casing 1304, when there is no movement of the gripping platform 1320, the gripping cylinder retains its position and will not easily slide within the angled oval cut-outs 1368 and 1372. However, it is important to note that the friction between the gripping cylinder 1376 and the casing 1304 walls is easily overcome to move the gripping cylinder when the gripping platform 1320 is moved due to the rotation or cranking of the tensioning rod 1068 in either of the directions 1336 or 1338 (FIG. 39).

Regarding the tension activation assembly 1060, reference is made to FIGS. 34, 38 and 39. Referring initially to FIG. 39, the crank 1060 includes an arm 1500 which extends between two cylindrical rotatable handles 1504. When the tension activation assembly 1060 is attached to the hex head end 1316 (as will be described below), an operator can grasp the handles 1504 and rotate the tension activation assembly 1060 as, for example, is illustrated by the arrows 1508 and 1512 (FIGS. 31 and 38). Referring now to FIG. 38 for more detail regarding the tension activation assembly 1060, the tension activation assembly 1060 is shown attached to the hex head end 1316 such that the lengths of the arm 1500 to the handles 1504 are unequal, thus allowing an operator to more easily apply a greater band tensioning torque by using the handle associated with the longer length.

To attach the tension activation assembly 1060 to the hex head end 1316, the tension activation assembly 1060 includes two bolt slides 1516 and 1520, which can be used to receive the hex head end 1316 within their wider receiving areas 1524 and 1528 and subsequently move the hex head end 1316 into a more secure position within the smaller bolt securing area 1532 or 1536. In this regard, it is worthwhile to note that the hex head end 1316 has parallel opposed slots 1540 (one of which is shown in FIG. 39) which are used to engage the portion of the arm 1500 surrounding a bolt securing area. In order to further maintain the hex head end 1316 in a bolt securing area, the tension activation assembly 1060 also includes a resilient securing plate 1544 which is best shown in FIG. 39. This plate is used for applying tension to the hex head end 1316 to facilitate the hex head end remaining in the bolt securing area during a cranking operation. More precisely, since the resilient securing plate 1544 covers both bolt slides 1516 and 1520 and is only attached to the arm 1500 by a rivet 1548 in the middle of the securing plate 1544, when a hex head end 1316 protrudes through a bolt slide, the securing plate 1544 is deformed from its position substantially parallel and adjacent to the arm 1500 (e.g., FIG. 34) and therefore applies a resilient pressure on the hex head end 1316. Further, note that the ends of the securing plate 1544 are angled away from the arm 1500 so that an operator may easily release the tension on a secured hex head end 1316 so that the tension activation assembly 1060 can be removed from the housing assembly 1052 and, for example, be reattached to the hex head end 1316 in an alternative position corresponding to a different one of the bolt slides 1516 and 1520.

Figure 42:
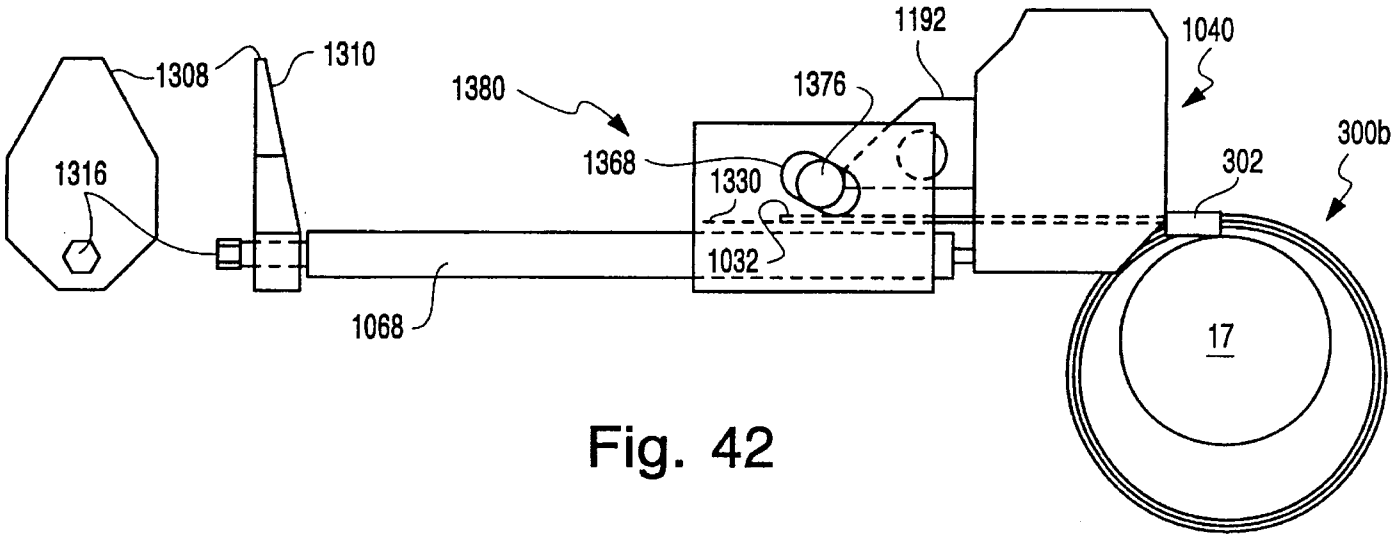
FIGS. 42–47 present a sequence of configurations illustrating how the banding tool 1020 extracts an unspecified length of excess band from a band clamp by iteratively reversing the direction by which the banding tool is cranked.

To describe the operation of the banding tool 1020, reference is made to FIGS. 42–47. These figures are meant to provide an understanding as to how the banding tool 1020 tensions a band clamp band. In particular, FIGS. 42–47 provide successive views of the operation of the banding tool 1020. Thus, FIG. 42 illustrates the configuration of the internals of the banding tool 1020 when the band clamp **300*b* free end 308 is first inserted into the banding tool 1020 and each successive one of FIGS. 43–47 provides a further illustration of the use of the banding tool 1020 during the tensioning operation of a band clamp such that each successive figure illustrates a later point in time during a band tensioning process. Further note that in order to more clearly illustrate the band tensioning process, the casing 1304 is not illustrated in these figures. However, it should be understood that the banding tool 1020 will not operate properly without the casing 1304 since, among other things, there must be frictional engagement between the inner walls of the casing 1304 and the gripping cylinder 1376. Additionally, the back plate 1308 is displayed both assembled with the other portions of the banding tool and separately from a rear view of the banding tool along with a rear view of the hex head end 1316 of the tensioning rod 1068. Such rear views are intended to provide a clear understanding of the direction of rotation (if any) of the tensioning rod 1068** during various steps of the band tensioning operation as disclosed within these figures.

Referring now to FIG. 42, the free end 308 of the band portion of the band clamp 300*b* has been inserted into the banding tool 1020. Note that the gripping platform 1320 has been positioned near the front of the length of the tensioning rod 1068 upon which it travels. Further note that the gripping cylinder 1376 is contacted by the projection 1192 so that the gripping cylinder remains sufficiently above the gripping surface 1330 to allow a space therebetween for the free end 308 of the band to be easily inserted somewhat beyond the gripping cylinder.

Figure 43:
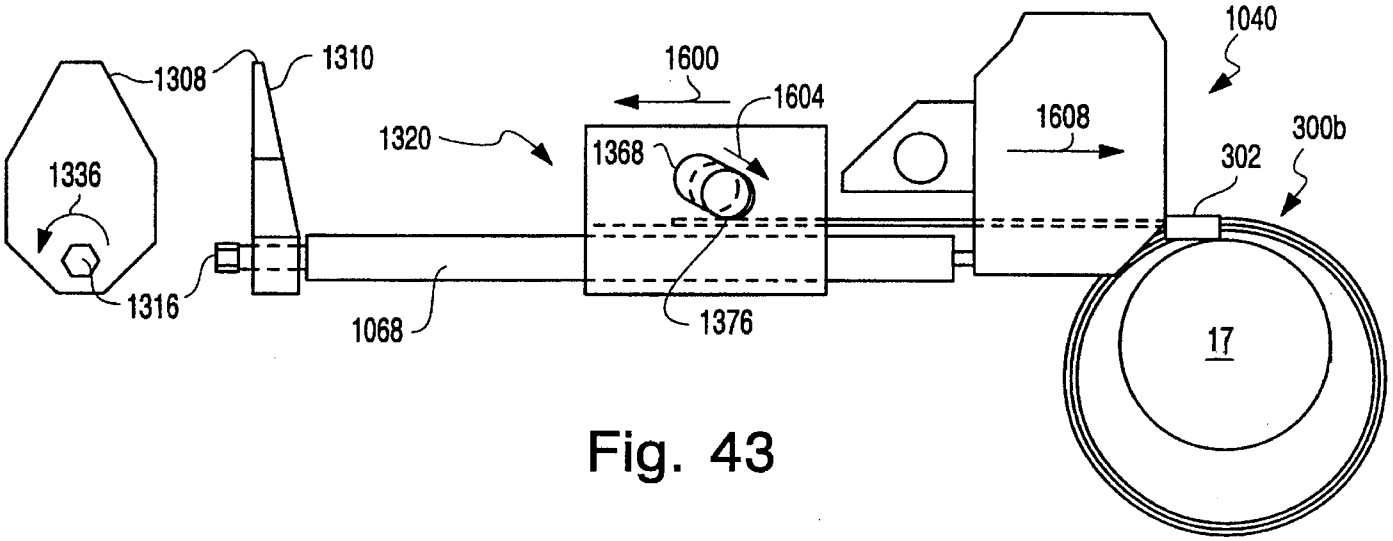

Referring now to FIG. 43, the banding tool 1020 is illustrated in a configuration shortly after commencing cranking of the tensioning rod 1068 in the direction 1336. In this context, the gripping platform 1320 moves along the tensioning rod 1068 in the direction of arrow 1600, thereby causing the gripping cylinder 1376 to move toward the lower end of the angled oval cut-outs 1368 and 1372 in the direction of arrow 1604. As illustrated in this figure, the gripping cylinder 1376 thereby contacts the band portion 1032 such that the greater the opposing tension in the direction 1608 caused by rigidity within the band of the band clamp 300*b*, the further the gripping cylinder 1376 becomes wedged into the lower portion of the angled oval cut-outs 1368 and 1372 and, thus, the firmer the grip of the band portion 1032 by the gripping cylinder 1376.

Figure 44:
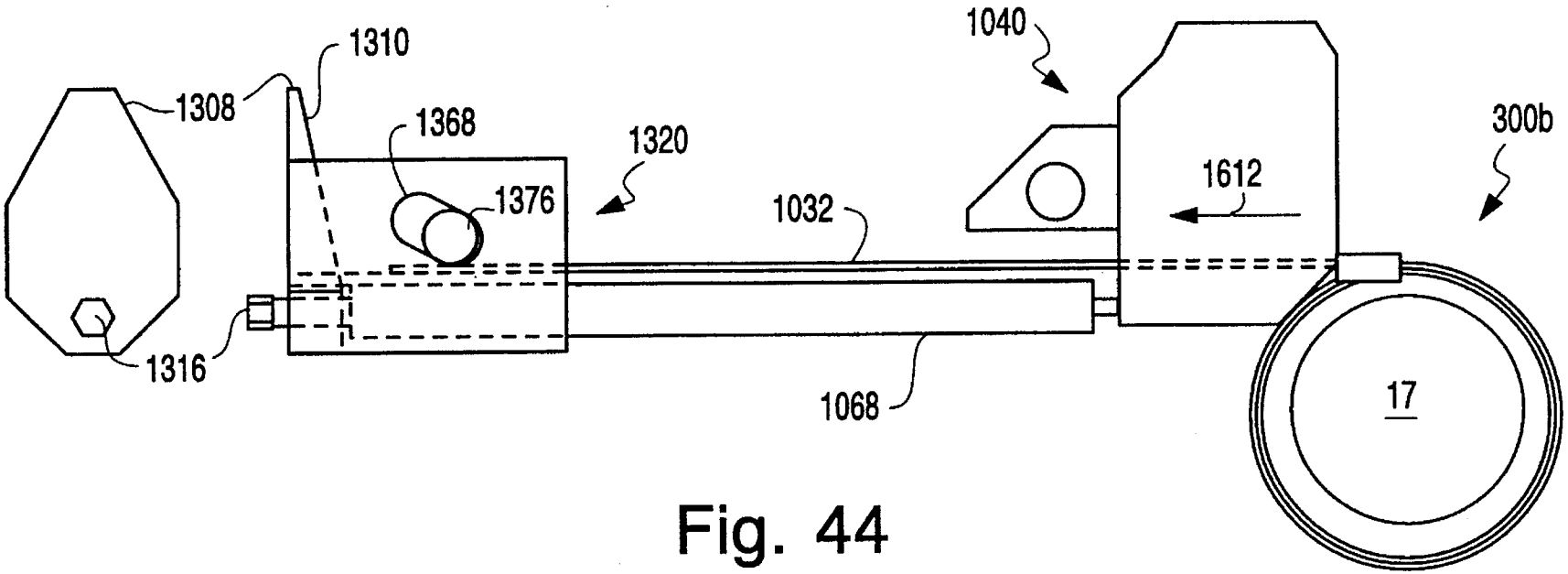

Referring now to FIG. 44, the banding tool 1020 is shown in a configuration whereby the gripping platform 1320 has moved substantially the length of the tensioning rod 1068 and is now adjacent to the back plate 1308. In this context, note that the band portion 1032 has been significantly lengthened since it has been pulled or extracted from the doubly wrapped band of the band clamp 300*b*. Thus, as can be seen, the band clamp 300*b* has become smaller in diameter.

Figure 45:
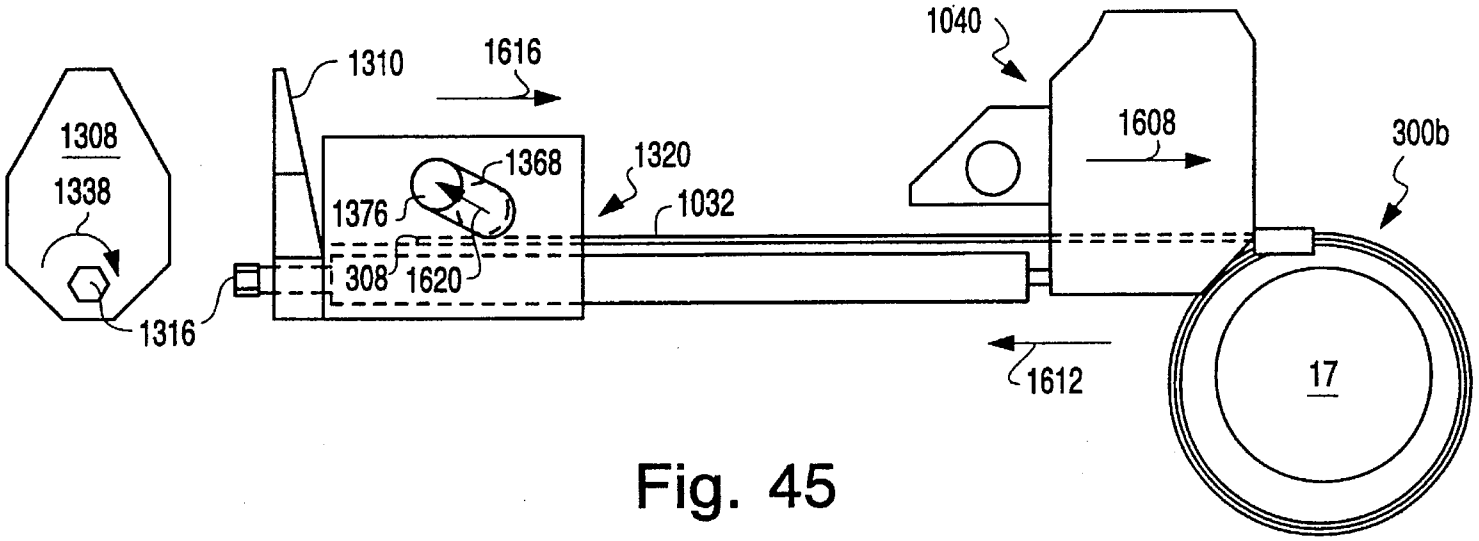

Referring now to FIG. 45, note that since the band clamp 300*b* is doubly wrapped, there is sufficient friction between the two band layers within the band clamp 300*b* to substantially prevent the band clamp from expanding even though no tension is applied to the band portion 1032 in the direction 1612. Thus, as FIG. 45 illustrates, by reversing the direction of cranking as indicated by directional arrow 1338, the gripping platform 1320 commences to move in direction 1616 and the gripping cylinder commences to move away from contact with the band portion 1032 and toward the upper end of the angled oval cut-outs 1368 and 1372 without the band portion 1032 withdrawing from the banding tool 1020 in the direction 1608. Therefore, the gripping platform 1320 can be moved substantially the length of the tensioning rod 1068 while the band portion 1032 remains in place within the banding tool 1020.

Figure 46:
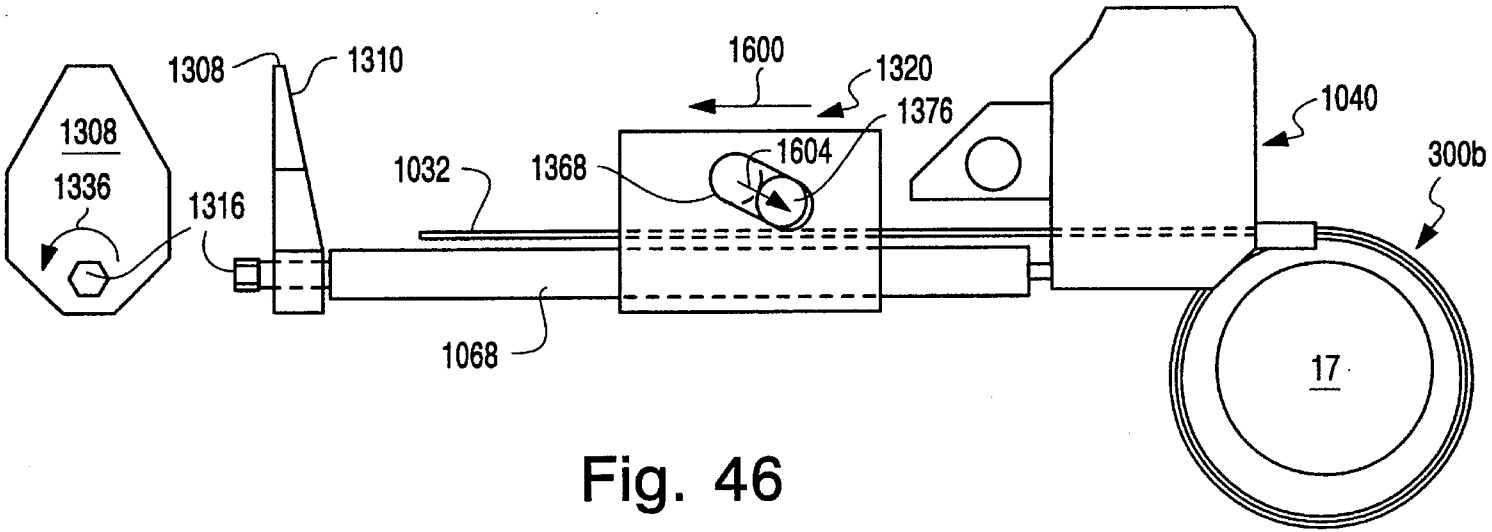

Referring now to FIG. 46, the gripping platform 1320 is shown near the front of the tensioning rod 1068 and the cranking direction as applied to the hex head end 1316 of the tensioning rod has again been reversed. Thus, in like manner to the coordination of movements in FIG. 42, as the gripping platform 1320 moves in the direction 1600, the gripping cylinder 1376 moves downwardly in the angled oval cut-outs 1368 and 1372 such that the gripping cylinder again grips the band portion 1032 sufficiently such that the movement of the gripping platform in direction 1600 causes an additional portion of band to be extracted from the band clamp 300*b*.

Figure 47:
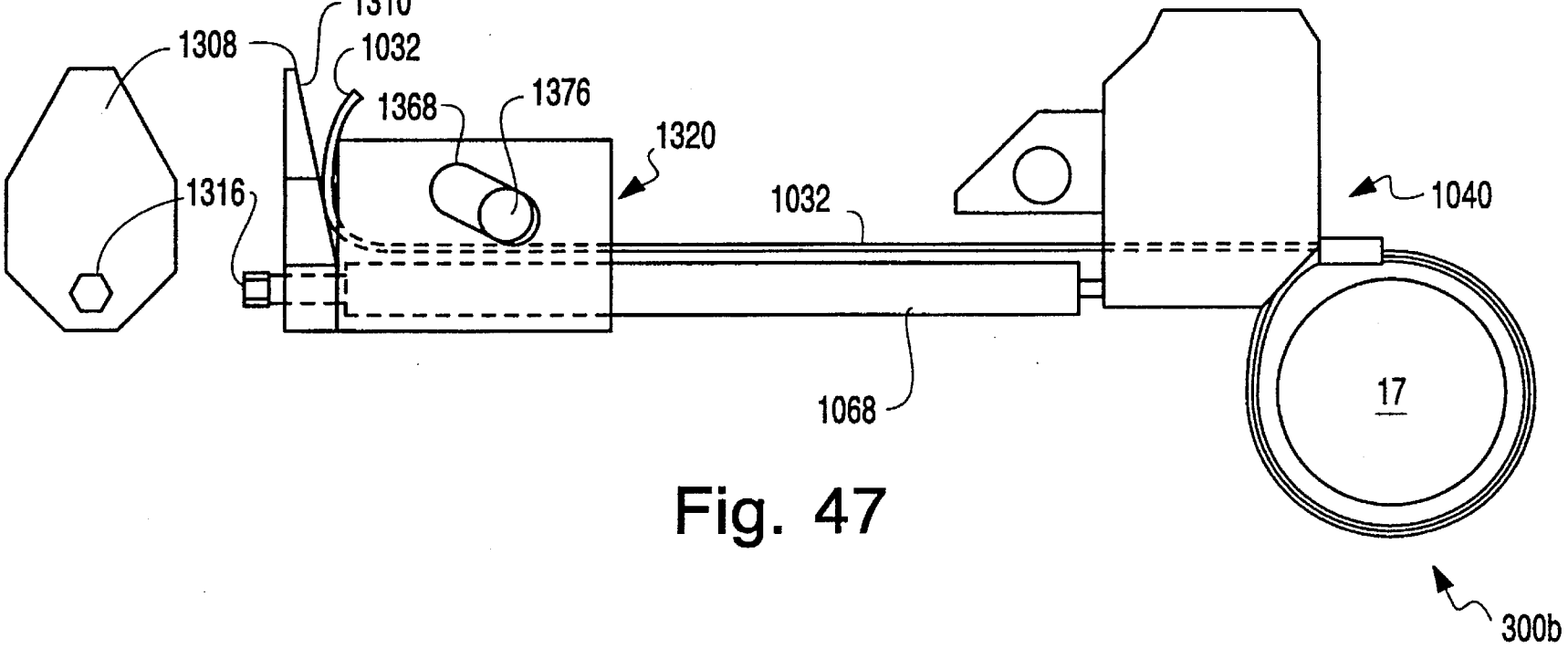

Referring now to FIG. 47, the banding tool 1020 is illustrated in a configuration where once again the gripping platform 1320 is substantially adjacent the back plate 1308. However, note that since an additional length of band material 1032 has been extracted from the band clamp 300*b*, the initial amount of the band portion 1032 extracted is caused to curl up as it contacts the outwardly angled interior surface 1310. Thus, the band tensioning operations illustrated in FIGS. 45, 46 and 47 can be repeated iteratively, thereby extracting additional amounts of band from the band clamp 300*b* until the band clamp is sufficiently tight about an object 17 to secure the band clamp with a lock 1044 using the severing handle 1112 and the knife blade combination 1104 and 1180, respectively.

Although the present invention has been described with respect to a specific preferred embodiment thereof, various changes and modifications may be suggested to one skilled in the art and it is intended that the present invention encompass such changes and modifications as fall within the scope of the appended claims.

What is claimed is:

1. A banding tool, comprising:

a housing assembly having a length and a proximal end adjacent to which a band is first inserted into said tool and a distal end located at an end opposite from said proximal end; and a tensioning assembly connected to said housing assembly, said tensioning assembly including means for carrying a load related to tensioning of the band, said means for carrying located more adjacent to said proximal end than said distal end of said housing assembly, said tensioning assembly including a rotatable tensioning rod, wherein said rotatable tensioning rod has a longitudinal extent in which said longitudinal extent is provided in a direction of the length of the band and in which said tensioning rod is fixed in position so that said tensioning rod rotates but remains stationary in a linear direction along said length of said housing assembly, said tensioning assembly further including a gripping assembly that moves along said longitudinal extent of said rotatable tensioning rod from adjacent to said proximal end toward said distal end when the band is being tensioned and said tensioning rod is rotated in a first direction and said gripping assembly returns from said distal end toward said proximal end along said rotatable tensioning rod when said tensioning rod is rotated in a direction opposite said first direction.

2. A tool, as claimed in claim 1, wherein:

said means for carrying includes a connecting pin having a tip and said tensioning rod is operatively connected to said connecting pin.

3. A tool, as claimed in claim 2, wherein:

said tip has a shorter width than remaining portions of said connecting pin.

4. A tool, as claimed in claim 3, wherein:

said tip is made of a material that slightly deforms to thereby increase a contact area sufficient to support a force applied to said connecting pin, between said tip and a cavity surface during tensioning of the band.

5. A tool, as claimed in claim 4, wherein:

said cavity surface is part of a band lock forming assembly that is removably connected to said housing assembly.

6. A tool, as claimed in claim 1, further including:

a first lock forming assembly connected to said housing assembly for forming a lock in the band after tensioning thereof.

7. A tool, as claimed in claim 6, wherein:

said first lock forming assembly is removably attached to said housing assembly and in which at least a second lock forming assembly, different from said first lock forming assembly, is substitutable for said first lock forming assembly whereby said tool is able to form different band locks.

8. A tool, as claimed in claim 1, wherein:

said housing assembly includes a casing having a bottom and two side walls and said tensioning rod is disposed within the said bottom end and sidewalls whereby said tensioning rod is able to be lubricated without such lubrication contacting a user when said tool is being used to tension the band.

9. A tool, as claimed in claim 1, wherein:

said gripping assembly has side walls with angled cut-outs formed in said side walls, said gripping assembly includes a gripping pin positioned in said angled cut-outs, said gripping pin being able to move relative to said cut-outs for engaging and releasing the band.

10. A tool, as claimed in claim 1, wherein:

said tensioning assembly includes a tension activation assembly that includes a handle connected to portions of said tensioning assembly, said handle being connected at a selected one of a number of positions along the length of said handle.

11. A tool, as claimed in claim 1, wherein:

the band includes first and second lateral edges and said first lock forming assembly forms a cut beginning at the first lateral edge and ending at a point located in between the first lateral edge and the second lateral edge.

12. A tool, as claimed in claim 1, wherein:

the band includes first and second lateral edges and said first lock forming assembly forms a cut that begins at a first point which is located in between the first and second lateral edges and terminates at a second point that is different from the first point and is located in between the first and second lateral edges.

13. A banding tool for tensioning a band with a buckle, comprising:

a housing assembly having a length and a proximal end adjacent to which a band is first received and a distal end located at an end opposite from said proximal end;

a first lock forming assembly for forming a first lock on the band after the band has been tensioned, said first lock forming assembly being removably attached to said housing assembly wherein at least a second lock forming assembly, different from said first lock forming assembly, is substitutable for said first lock forming assembly so that said tool is able to form different band locks; and a tensioning assembly for receiving a free end of the band and for tensioning the band, said tensioning assembly including means for carrying a load related to tensioning of the band, said means for carrying located more adjacent to said proximal end than said distal end of said housing assembly.

14. A method for tightening a band clamp, comprising:

providing a threaded, rotatable tensioning rod, a gripping assembly rotatable along said tensioning rod and a housing and in which said tensioning rod has a longitudinal extent that extends along a length of said housing;

receiving a free end of a band having a length;

gripping adjacent said free end of said band with said gripping assembly adjacent a first end of said housing;

causing said tensioning rod to rotate while said tensioning rod remains fixed in position in a direction along said longitudinal extent of said tensioning rod;

inducing said gripping assembly to move towards a second end of said housing for tensioning said band when said tensioning rod rotates in a first direction and in which said band length extends in a direction of said longitudinal extent of said tensioning rod;

returning said gripping assembly back to said first end by rotating said tensioning rod in a second direction, opposite from said first direction; and continuing tensioning of said band by again permitting said gripping assembly to move towards said second end.

15. A method, as claimed in claim 14, wherein:

said band clamp includes a buckle and said returning step includes releasing tension applied to said band by said gripping assembly with tension being applied to said band by said buckle.

16. A method, as claimed in claim 15, wherein:

said gripping assembly includes a gripping rod and a platform with at least a first slot formed therein and said gripping step includes gripping said band with said gripping rod in a first position in said first slot and said releasing step includes allowing said gripping rod to move in said first slot away from said first position wherein said gripping rod no longer grips said band.

17. A banding tool, comprising:

a housing assembly having a length and a proximal end adjacent to which a band is first inserted into said tool and a distal end located at an end opposite from said proximal end; and a tensioning assembly connected to said housing assembly, said tensioning assembly including means for carrying a load related to tensioning of the band, said means for carrying located more adjacent to said proximal end than said distal end of said housing assembly, said tensioning assembly including a tensioning rod that is substantially stationary in a linear direction along said length of said housing assembly during tensioning of the band, said means for carrying including a connecting pin having a tip and said tensioning rod being operatively connected to said connecting pin, with said tip having a shorter width than remaining portions of said connecting pin, said means for carrying further including a cavity being defined by a cavity surface and in which at least one of said tip and said cavity surface is made of a material that slightly deforms to thereby increase a contact area sufficient to support a force supplied to said connecting pin during tensioning of the band.

18. A tool, as claimed in claim 17, wherein:

said tip is made of said material that slightly deforms.

* * * * *